US008411014B2

(12) United States Patent
Kato et al.

(10) Patent No.: US 8,411,014 B2
(45) Date of Patent: Apr. 2, 2013

(54) SIGNAL PROCESSING CIRCUIT AND METHOD

(75) Inventors: Eiji Kato, Kanagawa (JP); Tasuku Fujiki, Kanagawa (JP); Takashi Hirakawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 909 days.

(21) Appl. No.: 11/985,001

(22) Filed: Nov. 13, 2007

(65) Prior Publication Data

US 2008/0111925 A1 May 15, 2008

(30) Foreign Application Priority Data

Nov. 14, 2006 (JP) ..... P2006-308181

(51) Int. Cl.
*G09G 3/36* (2006.01)

(52) U.S. Cl. ..... 345/100; 345/574

(58) Field of Classification Search ..... 345/505, 345/532, 536, 539, 540, 560, 698, 87, 98, 345/100, 571–574
See application file for complete search history.

(56) References Cited

U.S. PATENT DOCUMENTS 4,648,045 A * 3/1987 Demetrescu ..... 345/505
5,929,832 A * 7/1999 Furukawa et al. ..... 345/98
6,157,393 A * 12/2000 Potter et al. ..... 345/505
6,753,856 B1 * 6/2004 Krah et al. ..... 345/204
7,184,010 B2 * 2/2007 Aoki et al. ..... 345/99

FOREIGN PATENT DOCUMENTS

| | | |
|---|---|---|
| JP | 8-171364 | 7/1996 |
| JP | 11-194747 | 7/1999 |
| JP | 2000 122023 | 4/2000 |
| JP | 2001-142448 | 5/2001 |
| JP | 2002 111249 | 4/2002 |
| JP | 2003-107520 | 4/2003 |
| JP | 2003 316330 | 11/2003 |

* cited by examiner

*Primary Examiner* — Chanh Nguyen
*Assistant Examiner* — Roy Rabindranath
(74) *Attorney, Agent, or Firm* — Frommer Lawrence & Haug LLP; William S. Frommer

(57) ABSTRACT

A signal processing circuit includes: multiple digital-signal processing units operating in parallel each including a selecting unit for selecting one of multiple systems of input picture signals, a double-speed converting unit for writing the data equivalent to one field of the picture signal selected by the selecting unit in field memory, and simultaneously reading the data equivalent to one field from the field memory twice at double speed, thereby converting the frequency of the picture signal into double speed, a reading unit for reading the picture signal converted into double speed by the double-speed converting unit and temporarily stored in line memory, and a correction processing unit for subjecting the picture signal read by the reading unit to predetermined correction processing; and a control unit for performing the selection control of the multiple systems of picture signals, and the read position control of a picture signal from the line memory.

5 Claims, 19 Drawing Sheets

RELATED ART

RELATED ART

RELATED ART

RELATED ART

SIGNAL PROCESSING CIRCUIT AND METHOD

CROSS REFERENCES TO RELATED APPLICATIONS

The present invention contains subject matter related to Japanese Patent Application JP 2006-308181 filed in the Japanese Patent Office on Nov. 14, 2006, the entire contents of which are incorporated herein by reference.

BACKGROUND OF THE INVENTION

1. Field of the Invention

The present invention relates to a signal processing circuit and method, and particularly, relates to a signal processing circuit and method which facilitate positional adjustment and correction processing in increments of single dots, and so forth, even in the event of employing multiple signal processing circuits as a display apparatus signal processing system.

2. Description of the Related Art

With a display apparatus in which pixels are disposed in a matrix shape, such as an active matrix type liquid crystal display (LCD), apparatus, a digital signal processing circuit (DSD (Digital Signal Driver), ID (Integrated Circuit)) made up of the MOS process of a gate array is commonly employed as the signal processing system thereof. The digital data subjected to predetermined signal processing at this digital signal processing circuit is converted into an analog signal by an S/H (Sample/Hold) driver or the like, and then supplied to a liquid crystal display apparatus.

With such a liquid crystal display apparatus, in recent years, the mainstream of high pixel standard has advanced to increase in the number of pixels such as from the XGA (1024×768) standard to the SXGA+ (1400×1050) standard, and also the mainstream of frame rate has advanced to increase such as from 60 Hz to 120 Hz, and further to 240 Hz, as a measure against flickering and so forth, and consequently, there has been demand for speeding up of digital signal processing circuits for performing signal processing.

For example, the master clock (driving frequency) in the case of XGA is 65 MHz, and the master clock in the case of SXGA+ is 108 MHz. However, the operating speed of a digital signal processing circuit has a limit, such that a digital signal processing IC cannot operate when the master clock is excessively high, noise is increased by spurious emissions due to a high-frequency clock, and so forth, and consequently, it is difficult for a digital signal processing circuit to operate with the master clock in the case of SXGA+. Accordingly, with liquid crystal display apparatuses, the master clock of each of the digital signal processing circuits is decreased by performing parallel processing within a single digital signal processing IC, or by performing parallel processing using multiple digital signal processing ICs, thereby handling the speeding up thereof.

Also, the writing speed of a liquid crystal display apparatus is not so fast as a picture signal to be input can be written one dot (pixel) at a time in order, so a writing method for writing multiple pixels at a time in parallel in the horizontal direction has been employed in general, and multiple S/H drivers have been sometimes employed depending on the screen resolution of a the liquid crystal display apparatus.

As described above, in order to handle increase in the number of pixels and increase in a frame rate, with a liquid crystal display apparatus, multiple digital signal processing circuits, and multiple S/H drivers, are employed and connected thereto, but in this case, the wiring between the digital signal processing circuits, S/H drivers, and the liquid crystal display apparatus, will be determined inevitably.

FIG. 1 is a diagram illustrating a configuration example of an existing liquid crystal display system. The example in FIG. 1 illustrates an example in the case of employing two DSDICs as digital signal processing circuits, and RGT=H represents that this case is not mirror reversed display but normal display.

The liquid crystal display system in FIG. 1 is made up of a scan converter 11, DSDICs 12-1 and 12-2, S/H drivers 13-1 and 13-2, and a liquid crystal apparatus 14. Note that with the example in FIG. 1, the DSDIC 12-1 serves as a master, and the DSDIC 12-2 serves as a slave, so hereafter, which will be simply referred to as a master IC 12-1 and a slave IC 12-2, respectively.

The scan converter 11 subjects an analog picture signal input from an unshown previous stage to A/D (Analog/Digital) conversion, number-of-pixel conversion, number-of-line conversion, frequency conversion, or the like, and alternately inputs a digital picture signal after conversion to the master IC 12-1 and the slave IC 12-2. That is to say, the odd data of a picture signal (the 1st, 3rd, 5th, 7th, 9th, and 11th data) is input to the master IC 12-1, and the even data of a picture signal (the 2nd, 4th, 6th, 8th, 10th, and 12th data) is input to the slave IC 12-2.

The master IC 12-1 subjects the input odd data to predetermined signal processing, and outputs a signal SIG1 after the signal processing (the 1st, 3rd, 5th, 7th, 9th, and 11th data) to the S/H driver 13-1. Also, the master IC 12-1 supplies clock CLKOUT1 to the S/H driver 13-1, and also generates a timing pulse for driving, and supplies the generated timing pulse to the S/H driver 13-1, S/H driver 13-2, and liquid crystal display apparatus 14.

The slave IC 12-2 subjects the input even data to predetermined signal processing, and outputs a signal SIG2 after the signal processing (the 2nd, 4th, 6th, 8th, 10th, and 12th data) to the S/H driver 13-2. Also, the slave IC 12-2 supplies clock CLKOUT2 to the S/H driver 13-2.

The S/H driver 13-1 inputs, as shown by dotted lines, based on the clock CLKOUT1 from the master IC 12-1, the signal SIG1 (the 1st, 3rd, 5th, 7th, 9th, and 11th data equivalent to six pixels of the liquid crystal display apparatus 14) to the 1st, 3rd, 5th, 7th, 9th, and 11th pixels, which are the horizontal display positions of the liquid crystal display apparatus 14, from the top in the drawing simultaneously.

Based on the clock CLKOUT2 from the slave IC 12-2, the S/H driver 13-2 inputs, as shown by solid lines, the signal SIG2 (the 2nd, 4th, 6th, 8th, 10th, and 12th data equivalent to six pixels of the liquid crystal display apparatus 14) to the 2nd, 4th, 6th, 8th, 10th, and 12th pixels, which are the horizontal display positions of the liquid crystal display apparatus 14, from the top in the drawing simultaneously.

With the liquid crystal display apparatus 14, the pixels are disposed in a matrix shape, and for example, a liquid crystal panel employing a 12-pixel simultaneous writing system for writing 12 pixels in parallel can be employed. With the example in FIG. 1, in order from the top in the drawing, 12 pixels from the first pixel in order in the horizontal direction are illustrated. Note that a number illustrated on each of the pixels represents a data number of a signal to be written in each of the pixels.

The liquid crystal display apparatus 14 writes the signal SIG1 from the S/H driver 13-1 and the signal SIG2 from the S/H driver 13-2 each six pixels at a time in parallel in the horizontal direction based on the timing pulse from the master IC 12-1. At this time, the 1st, 3rd, 5th, 7th, 9th, and 11th data of the signal SIG1 from the S/H driver 13-1 are written in the 1st, 3rd, 5th, 7th, 9th, and 11th pixels from the top of the liquid crystal display apparatus 14, and also the 2nd, 4th, 6th, 8th, 10th, and 12th data of the signal SIG2 from the S/H driver 13-2 are written in the 2nd, 4th, 6th, 8th, 10th, and 12th pixels from the top of the liquid crystal display apparatus 14.

As described above, in the event that the horizontal display positions of the liquid crystal display apparatus 14 are in a default state (HP (Horizontal Position)=default), the 1st through 12th data from the S/H drivers 13-1 and 13-2 are written in the pixels of the liquid crystal display apparatus 14 in order from the top in the drawing. That is to say, in the case of the example in FIG. 1, the wiring between the S/H drivers 13-1 and 13-2 and the liquid crystal display apparatus 14 has been determined such that the data to be written in the odd-numbered pixels of the liquid crystal display apparatus 14 are input from the S/H driver 13-1, and the data to be written in the even-numbered pixels of the liquid crystal display apparatus 14 are input from the S/H driver 13-2.

Thus, in the event of connecting multiple digital signal processing circuits and multiple S/H drivers to a liquid crystal display apparatus, the wiring between the digital signal processing circuits and the S/H drivers and the liquid crystal display apparatus is determined inevitably, so upon the horizontal display positions being moved by one position from the default state, multiple pixels (two pixels in the case of FIG. 1) are moved inevitably, as shown in the arrow at the right side.

That is to say, in the event of moving the horizontal display positions of the liquid crystal display apparatus 14 by one position (HP=Default+1), the 3rd through 14th data of the S/H drivers 13-1 and 13-2 are written in the pixels of the liquid crystal display apparatus 14 in order from the top in the drawing. Accordingly, in the event of moving the horizontal display positions in increments of one pixel (dot), as shown in FIG. 2, the data to be input to the master IC 12-1 and the data to be input the slave IC 12-2 from the scan converter 11 need to be interchanged to shift the data to be input to the slave IC 12-2 by one piece of data.

FIG. 2 illustrates an example of a case in which with the liquid crystal display system in FIG. 1, the data to be input to the master IC 12-1 and the data to be input to the slave IC 12-2 are interchanged. That is to say, in the case of the example in FIG. 2, the even data of the picture signal from the scan converter 11 (the 2nd, 4th, 6th, 8th, 10th, and 12th data) from the scan converter 11 is input to the master IC 12-1, and the odd data of the picture signal (the 1st, 3rd, 5th, 7th, 9th, and 11th data) is input to the slave IC 12-2.

Accordingly, as shown by the dotted lines, the S/H driver 13-1 inputs the signal SIG1 (the 2nd, 4th, 6th, 8th, 10th, and 12th data) from the master IC 12-1 to the 1st, 3rd, 5th, 7th, 9th, and 11th pixels from the top of the liquid crystal display apparatus 14 simultaneously.

As shown by the solid lines, the S/H driver 13-2 inputs the signal SIG2 (the 3rd, 5th, 7th, 9th, 11th, and 13th data) from the slave IC 12-2 to the 2nd, 4th, 6th, 8th, 10th, and 12th pixels from the top of the liquid crystal display apparatus 14 simultaneously.

According to the above-mentioned arrangement, in the event that the horizontal display positions of the liquid crystal display apparatus 14 in FIG. 2 are in a default state (HP (Horizontal Position)=default), the 3rd through 13th data from the S/H drivers 13-1 and 13-2 are written in the pixels of the liquid crystal display apparatus 14 in order from the top in the drawing. Thus, interchanging and shifting between the data to be input to the master IC 12-1 and the data to be input to the slave IC 12-2 from the scan converter 11 are performed, whereby the horizontal display positions of the liquid crystal display apparatus 14 in FIG. 1 can be shifted by one dot.

Also, with the liquid crystal display system in FIG. 1, even in the event of performing mirror reversed display, as shown in FIG. 3, the data to be input to the master IC 12-1 and the data to be input to the slave IC 12-2 from the scan converter 11 need to be interchanged.

FIG. 3 illustrates an example of a case in which with the liquid crystal display system in FIG. 1, mirror reversed display (RGT=L) is set, and also the data to be input to the master IC 12-1 and the data to be input to the slave IC 12-2 are interchanged. That is to say, in the case of the example in FIG. 3, the even data of the picture signal from the scan converter 11 (the 2nd, 4th, 6th, 8th, 10th, and 12th data) is input to the master IC 12-1, and the odd data of the picture signal (the 1st, 3rd, 5th, 7th, 9th, and 11th data) is input to the slave IC 12-2.

Accordingly, as shown by dotted lines, the S/H driver 13-1 inputs the signal SIG1 (the 2nd, 4th, 6th, 8th, 10th, and 12th data) from the master IC 12-1 in reverse order to the 1st, 3rd, 5th, 7th, 9th, and 11th pixels from the top in the drawing of the liquid crystal display apparatus 14 simultaneously.

As shown by solid lines, the S/H driver 13-2 inputs the signal SIG2 (the 1st, 3rd, 5th, 7th, 9th, and 11th data) from the slave IC 12-2 in reverse order to the 2nd, 4th, 6th, 8th, 10th, and 12th pixels from the top in the drawing of the liquid crystal display apparatus 14 simultaneously.

According to the above-mentioned arrangement, in the event that the horizontal display positions of the liquid crystal display apparatus 14 in FIG. 3 are in a default state (HP (Horizontal Position)=default), the 12th through 1st data from the S/H drivers 13-1 and 13-2 are written in the pixels of the liquid crystal display apparatus 14 in order from the top in the drawing. Thus, interchanging between the data to be input to the master IC 12-1 and the data to be input to the slave IC 12-2 from the scan converter 11 is performed, whereby the horizontal display positions of the liquid crystal display apparatus 14 in FIG. 1 can be subjected to mirror reversed display.

Now, for example, with the invention described in Japanese Unexamined Patent Application Publication No. 2002-111249, a single digital signal processing circuit performs multiple inputs, and multiple simultaneous processes, and the movement of the horizontal display positions in increments of single dots is realized by interchanging ports at the time of input or output.

FIG. 4 illustrates a configuration example of a liquid crystal display system in the case of performing the interchanging of ports. The liquid crystal display system shown in FIG. 4 differs from the liquid crystal display system in that the DSDICs 12-1 and 12-2 are replaced with a DSDIC 21, but it is common to both that the scan converter 11, S/H drivers 13-1 and 13-2, and liquid crystal display apparatus 14 are provided.

Specifically, the scan converter 11 inputs the odd data of a picture signal (the 1st, 3rd, 5th, 7th, 9th, and 11th data) and the even data of a picture signal (the 2nd, 4th, 6th, 8th, 10th, and 12th data) to the two input ports of the DSDIC 21, respectively.

The DSDIC 21 is made up of a port interchanging unit 31, a signal processing unit 32, and a port interchanging unit 33. The port interchanging units 31 and 33 interchange output ports so as to output the odd data and even data input from each input port to an output port for the S/H driver 13-1 or an output port for the S/H driver 13-2.

The signal processing unit 32 subjects two systems of data input from the port interchanging unit 31 to signal processing in parallel, and outputs the signals subjected to the signal processing to the port interchanging unit 33. Also, the signal processing unit 32 supplies clock CLKOUT1 and clock CLKOUT2 to the S/H drivers 13-1 and 13-2 respectively, and also generates a timing pulse for driving, and supplies the generated timing pulse to the S/H drivers 13-1 and 13-2, and the liquid crystal display apparatus 14.

Accordingly, the signal SIG1 made up of one data set of the data set of the 1st, 3rd, 5th, 7th, 9th, and 11th data, and the data set of the 2nd, 4th, 6th, 8th, 10th, and 12th data is output from the DSDIC 21 to the S/H driver 13-1, and the signal SIG2 made up of the other data set (which differs from the data set of the signal SIG1) of the data set of the 2nd, 4th, 6th, 8th, 10th, and 12th data, and the data set of the 1st, 3rd, 5th, 7th, 9th, and 11th data is output to the S/H driver 13-2.

For example, in the event that the signal SIG1 is made up of the data set of the 1st, 3rd, 5th, 7th, 9th, and 11th data, and the signal SIG2 is made up of the data set of the 2nd, 4th, 6th, 8th, 10th, and 12th data, as shown by the dotted lines, the S/H driver 13-1 inputs the signal SIG1 (the 1st, 3rd, 5th, 7th, 9th, and 11th data) from the DSDIC 21 to the 1st, 3rd, 5th, 7th, 9th, and 11th pixels from the top in the drawing of the liquid crystal display apparatus 14 simultaneously. As shown by the solid lines, the S/H driver 13-2 inputs the signal SIG2 (the 2nd, 4th, 6th, 8th, 10th, and 12th data) from the DSDIC 21 to the 2nd, 4th, 6th, 8th, 10th, and 12th pixels from the top in the drawing of the liquid crystal display apparatus 14 simultaneously.

According to the above-mentioned arrangement, in the event that the horizontal display positions of the liquid crystal display apparatus 14 in FIG. 3 are in a default state (HP (Horizontal Position)=default), the 1st through 12th data from the S/H drivers 13-1 and 13-2 are written in order from the top in the drawing of the liquid crystal display apparatus 14.

Note that though not shown in the drawing, according to interchanging of the ports by the port interchanging unit 31 or 33, the S/H driver 13-1 can input the signal SIG1 (the 2nd, 4th, 6th, 8th, 10th, and 12th data) from the DSDIC 21 to the 1st, 3rd, 5th, 7th, 9th, and 11th pixels from the top in the drawing of the liquid crystal display apparatus 14 simultaneously, and the S/H driver 13-2 can input the signal SIG2 (the 1st, 3rd, 5th, 7th, 9th, and 11th data) from the DSDIC 21 to the 2nd, 4th, 6th, 8th, 10th, and 12th pixels from the top in the drawing of the liquid crystal display apparatus 14 simultaneously.

As described above, with the liquid crystal display system in FIG. 4, the horizontal display positions has been able to be shifted by one dot according to a request.

Note however, the liquid crystal display system of the example in FIG. 4 is a system in the case of employing a single digital signal processing circuit, and the liquid crystal display system of the example in FIG. 4 has not been able to handle the case of employing multiple digital signal processing circuits.

Also, with the existing liquid crystal display system, in the case of employing multiple digital signal processing circuits, unless data is interchanged in the previous stage wherein a picture signal is input to the digital signal processing circuits, the movement of the horizontal display positions in increments of single dots has not been able to be performed, and further with regard to correction functions in which the precision in increments of single dots is required, such as a luminescent-spot correction function, a color unevenness correction function shown in Japanese Unexamined Patent Application Publication No. 2000-122023, a sharpness function, and a vertical stripe correction function as well, the precision has resulted in a multiple-dots unit (two dots in the case of employing two digital signal processing circuits), and accordingly, the precision of each of the those functions has not been obtained, or those functions themselves have not been able to be used in some cases.

SUMMARY OF THE INVENTION

As described above, in the event of employing multiple digital signal processing circuits as a signal processing system of a liquid crystal display apparatus, in the past, unless interchanging of data and shifting of data are performed at the previous stage before a picture signal is input to the digital signal processing circuits, adjustment has not been able to be performed in increments of single dots.

Accordingly, in the event of employing positional adjustment or a correction function, all that is necessary is originally to change only the setting values of a digital signal processing circuit, but there has been a need to change an input picture signal in accordance with the settings of the digital signal processing circuit.

There has been recognized a need for a signal processing circuit and method which facilitate the display positional adjustment and correction processing and the like in increments of single dots, even in the event of employing multiple signal processing circuits as a signal processing system of a display apparatus.

A signal processing circuit according to an embodiment of the present invention is a signal processing circuit configured to process a picture signal to output to a display unit made up of a collective entity of pixels, including: a plurality of digital signal processing units which operate in parallel each including a selecting unit configured to select one of a plurality of systems of picture signals which are input, a double-speed converting unit configured to write the data equivalent to one field of the picture signal selected by the selecting unit in field memory, and simultaneously read the data equivalent to one field from the field memory twice at double speed, thereby converting the frequency of the picture signal into double speed, i.e., twice as many frequency as the frequency, a reading unit configured to read out the picture signal converted into double speed by the double-speed converting unit and temporarily stored in line memory, and a correction processing unit configured to subject the picture signal read out by the reading unit to predetermined correction processing; and a control unit configured to perform the selection control of the plurality of systems of picture signals using the selecting unit, and the read position control of a picture signal from the line memory using the reading unit, of the plurality of digital signal processing units.

The correction processing unit of the plurality of digital signal processing units obtains the value of linear interpolation regarding each of all of the picture signals to be corrected, which have been converted into double speed by the double-speed converting unit of the plurality of digital signal processing units, and subjects the picture signals to be corrected which have been converted into double speed by the own double-speed converting unit to the predetermined correction processing using the corresponding values of linear interpolation, of the obtained values of linear interpolation.

A signal processing method according to an embodiment of the present invention is a signal processing method of a signal processing circuit including a plurality of digital signal processing units configured to perform processing in parallel wherein the data equivalent to one field of a picture signal to be input is written in field memory, and simultaneously the data equivalent to one field from the field memory twice at double speed, thereby converting the frequency of the picture signal into double speed, i.e., twice as many frequency as the frequency to output to a display unit made up of a collective entity of pixels, the method including the steps of: performing the selection control of one of a plurality of systems of picture signals which are input, and the read position control of the picture stored in temporarily stored in line memory at the plurality of digital signal processing units; selecting one of the plurality of systems of picture signals based on the selection control; writing the data equivalent to one field of the selected picture signal in the field memory, and simultaneously reading the data equivalent to one field from the field memory twice at double speed, thereby converting the frequency of the picture signal into double speed, i.e., twice as many frequency as the frequency; reading out the picture signal converted into double speed, and temporarily stored in the line memory based on the read position control; and subjecting the read picture signal to predetermined correction processing.

With an embodiment of the present invention, a plurality of digital signal processing units perform the selection control of one of a plurality of systems of picture signals which are input, and the read position control of the picture signals stored in temporarily stored in line memory at the plurality of digital signal processing units. Based on the selection control, one of the plurality of systems of picture signals is selected, the data equivalent to one field of the selected picture signal is written in the field memory, and simultaneously the data equivalent to one field is read from the field memory twice at double speed, thereby converting the frequency of the picture signal into double speed, i.e., twice as many frequency as the frequency, reading out the picture signal temporarily stored in the line memory based on the read position control, and subjecting the read picture signal to predetermined correction processing.

According to an embodiment of the present invention, positional adjustment in increments of single dots, and correction processing in increments of single dots can be readily performed even in the event of employing multiple signal processing circuits as a signal processing system of a display apparatus.

DESCRIPTION OF THE PREFERRED EMBODIMENTS

Before describing embodiments of the present invention, the correspondence between the features of the claims and the specific elements disclosed in embodiments of the present invention is discussed below. This description is intended to assure that embodiments supporting the claimed invention are described in this specification. Thus, even if an element in the following embodiments is not described as relating to a certain feature of the present invention, that does not necessarily mean that the element does not relate to that feature of the claims. Conversely, even if an element is described herein as relating to a certain feature of the claims, that does not necessarily mean that the element does not relate to the other features of the claims.

Figure 1:
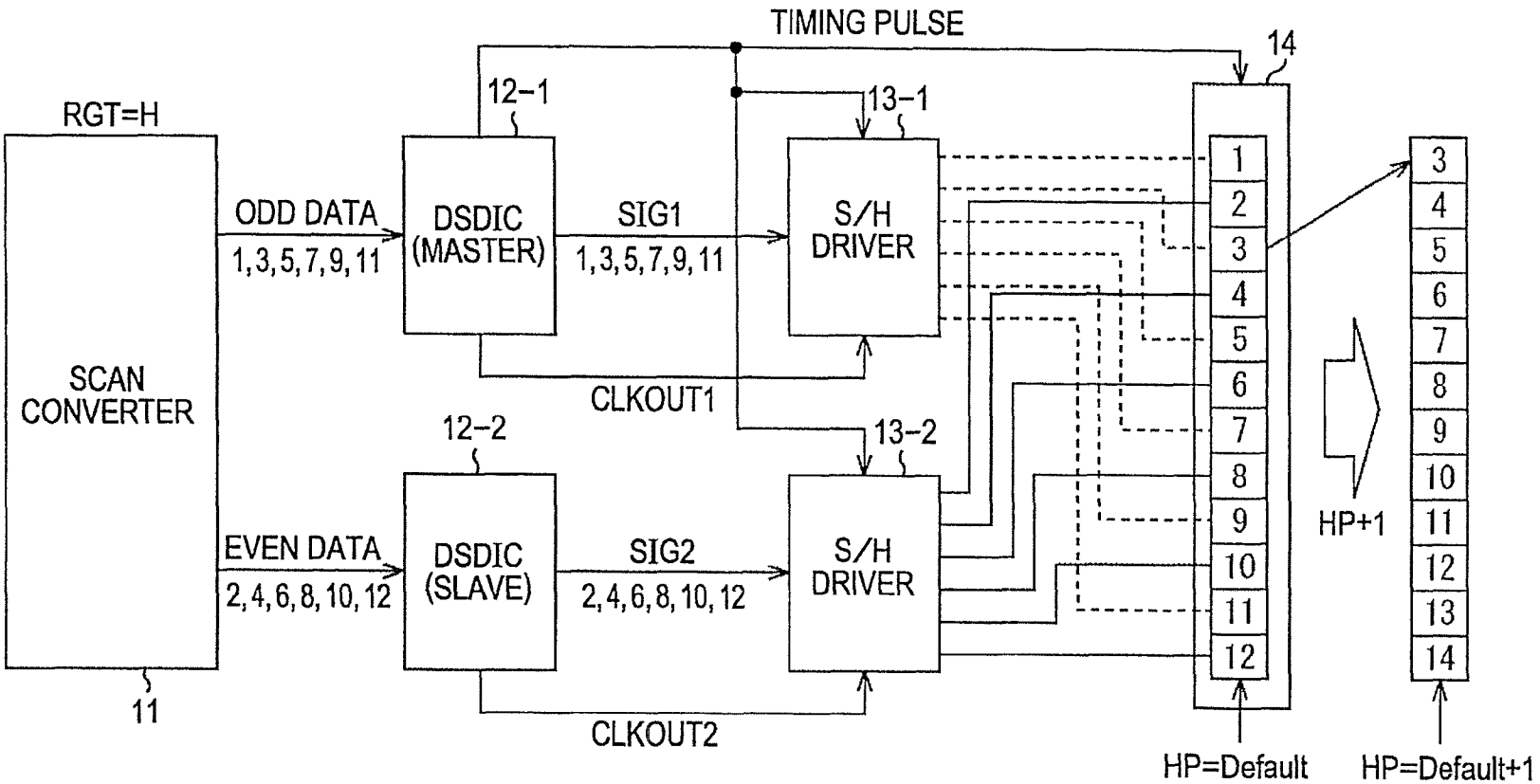
FIG. 1 is a block diagram illustrating a configuration example of an existing liquid crystal display system.
Figure 2:
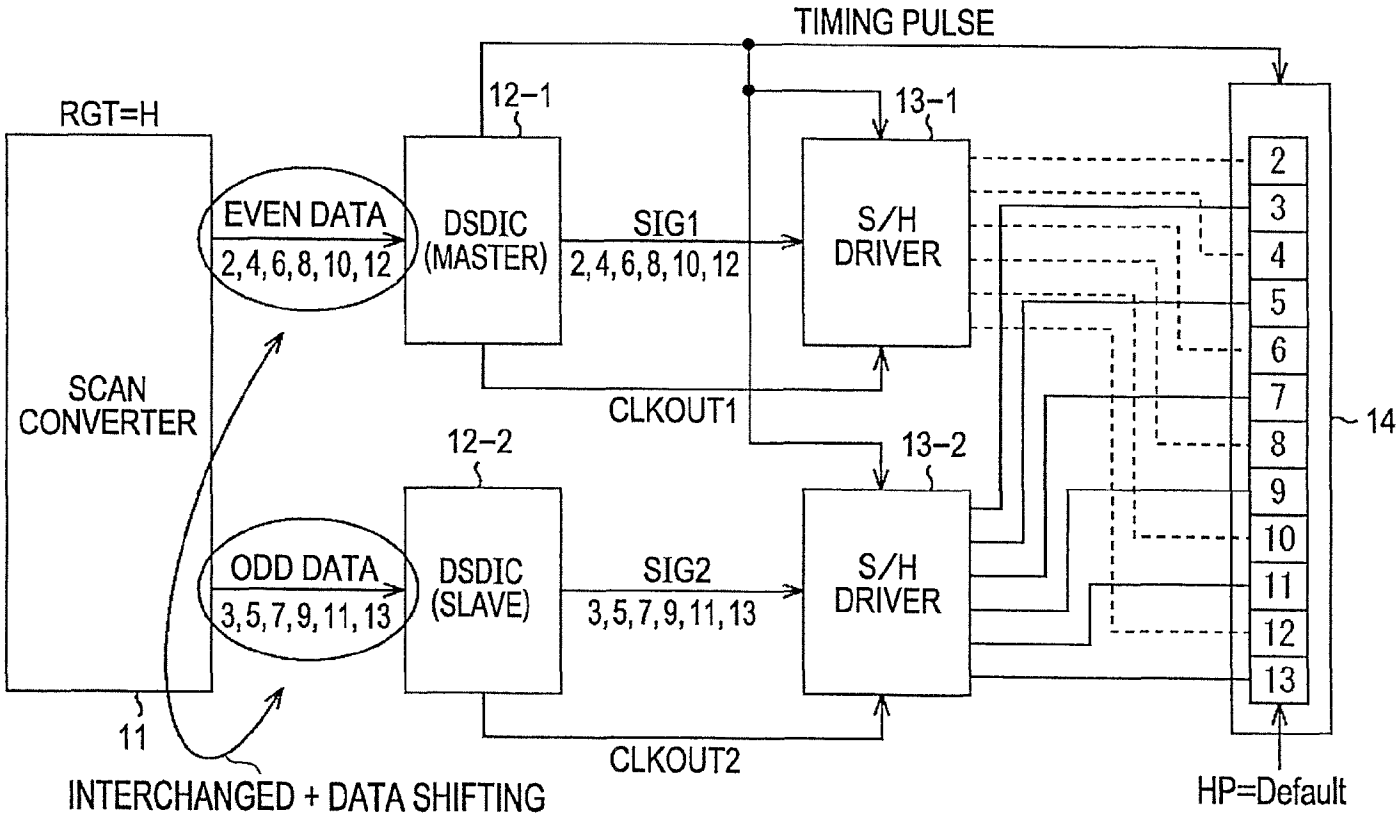
FIG. 2 is a block diagram illustrating a case in which with the liquid crystal display system in FIG. 1, data to be input to a master IC and data to be input to a slave IC are interchanged.
Figure 3:
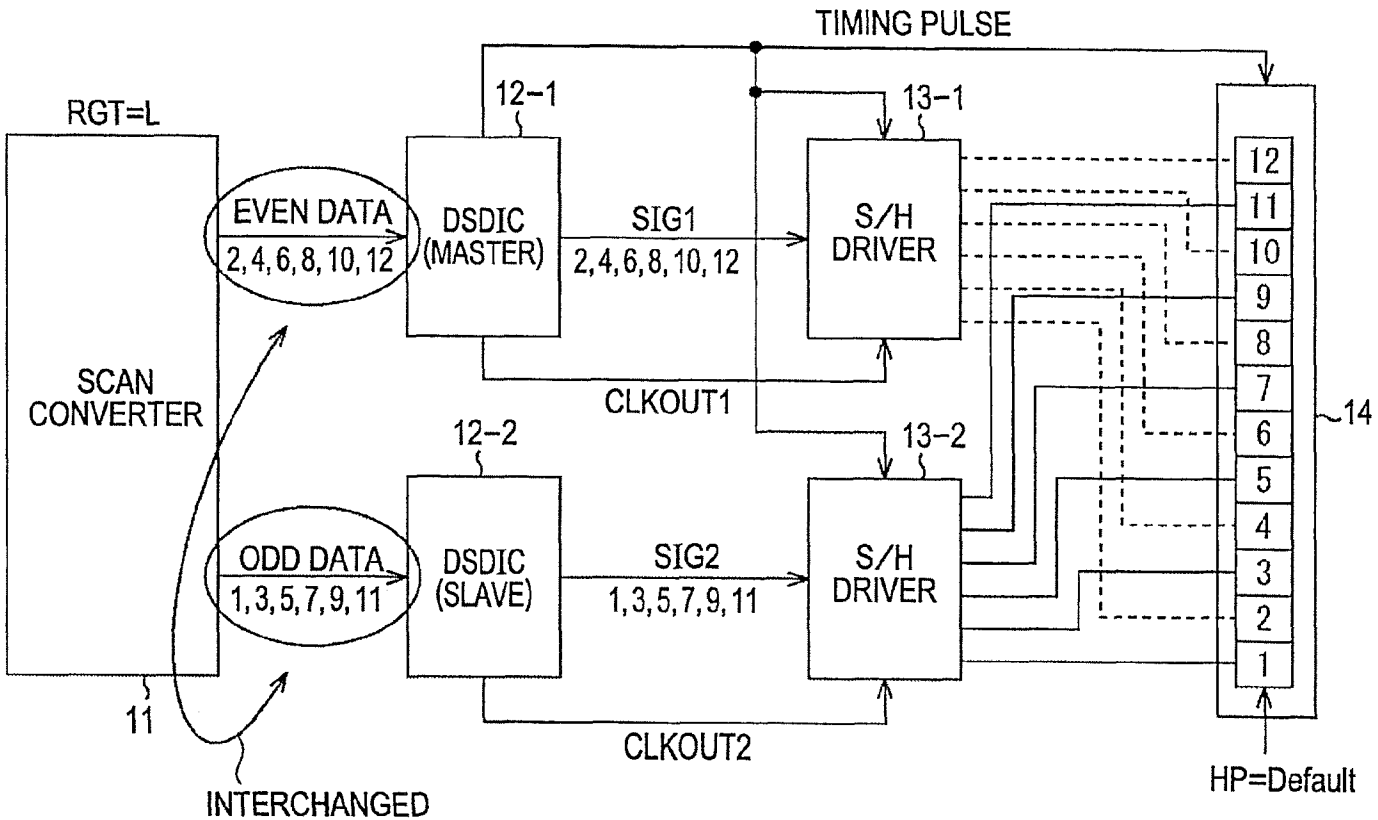
FIG. 3 is a block diagram illustrating a case in which mirror reversed display is performed in the liquid crystal display system in FIG. 1.
Figure 4:
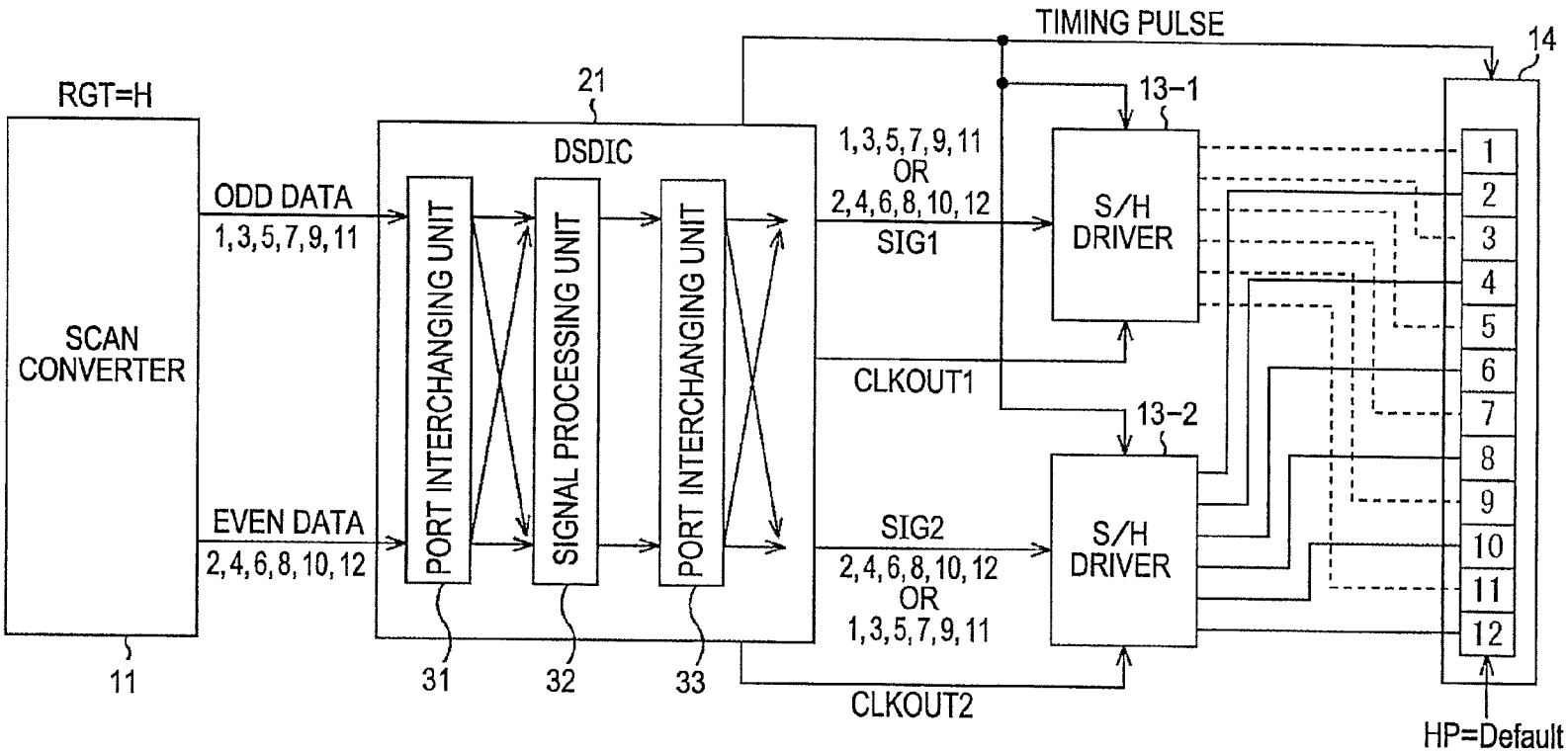
FIG. 4 is a block diagram illustrating another configuration example of an existing liquid crystal display system.
Figure 5:
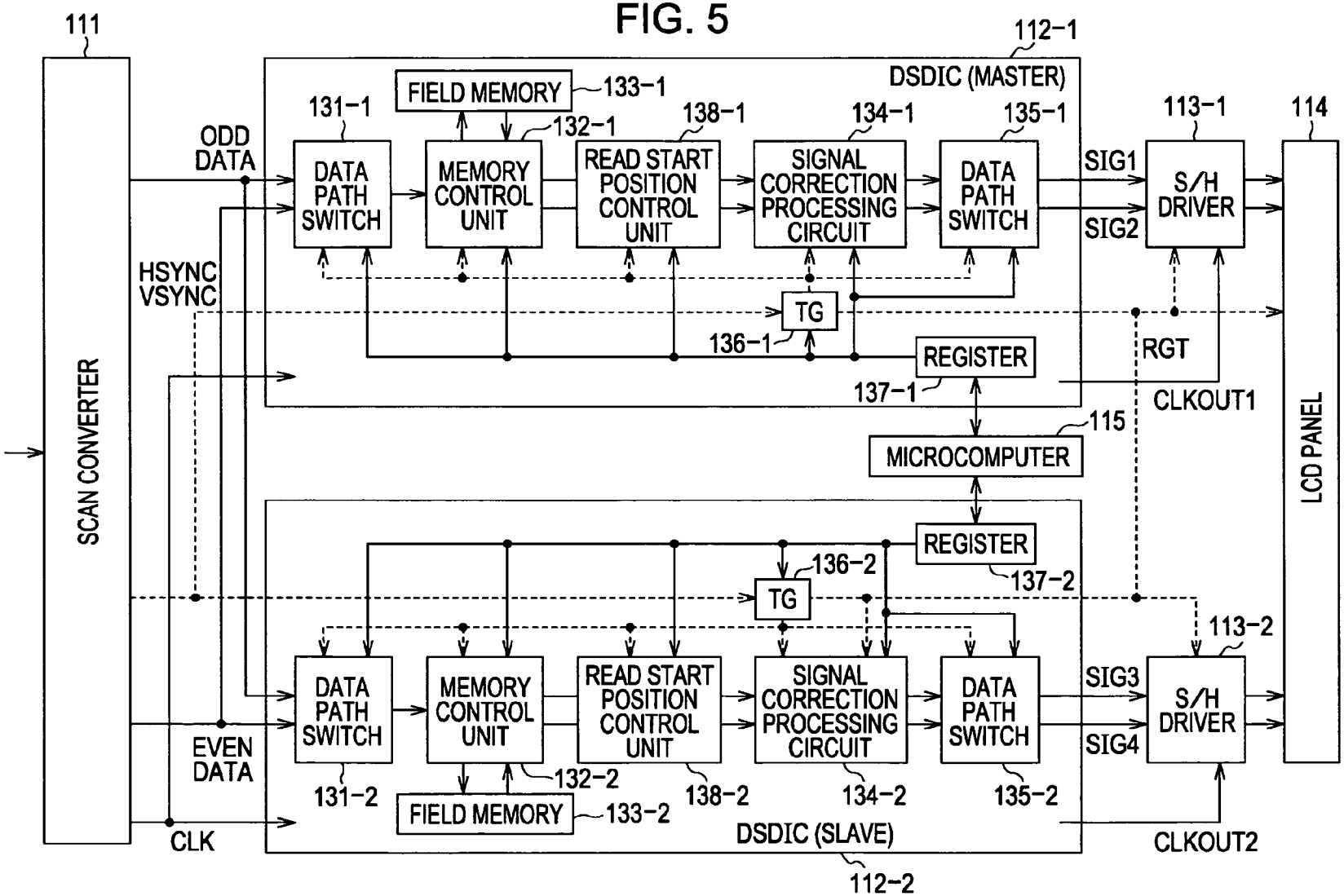
FIG. 5 is a block diagram illustrating a configuration example of a liquid crystal display system to which an embodiment of the present invention is applied.

A signal processing circuit according to an embodiment of the present invention is a signal processing circuit (e.g., liquid crystal display system in FIG. 5) configured to process a picture signal to output to a display unit made up of a collective entity of pixels, including: a plurality of digital signal processing units (e.g., digital signal driver ICs 112-1 and 112-2 in FIG. 5) which operate in parallel each including a selecting unit (e.g., data path switches 131-1 and 131-2 in FIG. 5) configured to select one of a plurality of systems of picture signals which are input, a double-speed converting unit (e.g., memory control units 132-1 and 132-2 in FIG. 5) configured to write the data equivalent to one field of the picture signal selected by the selecting unit in field memory (e.g., field memory 133-1 and field memory 133-2 in FIG. 5), and simultaneously read the data equivalent to one field from the field memory twice at double speed, thereby converting the frequency of the picture signal into double speed, i.e., twice as many frequency as the frequency, a reading unit (e.g., read start position control units 138-1 and 138-2 in FIG. 5) configured to read out the picture signal converted into double speed by the double-speed converting unit and temporarily stored in line memory, and a correction processing unit (e.g., signal correction processing circuits 134-1 and 134-2 in FIG. 5) configured to subject the picture signal read out by the reading unit to predetermined correction processing; and a control unit (e.g., microcomputer 115 in FIG. 5) configured to perform the selection control of the plurality of systems of picture signals using the selecting unit, and the read position control of a picture signal from the line memory using the reading unit, of the plurality of digital signal processing units.

Figure 17:
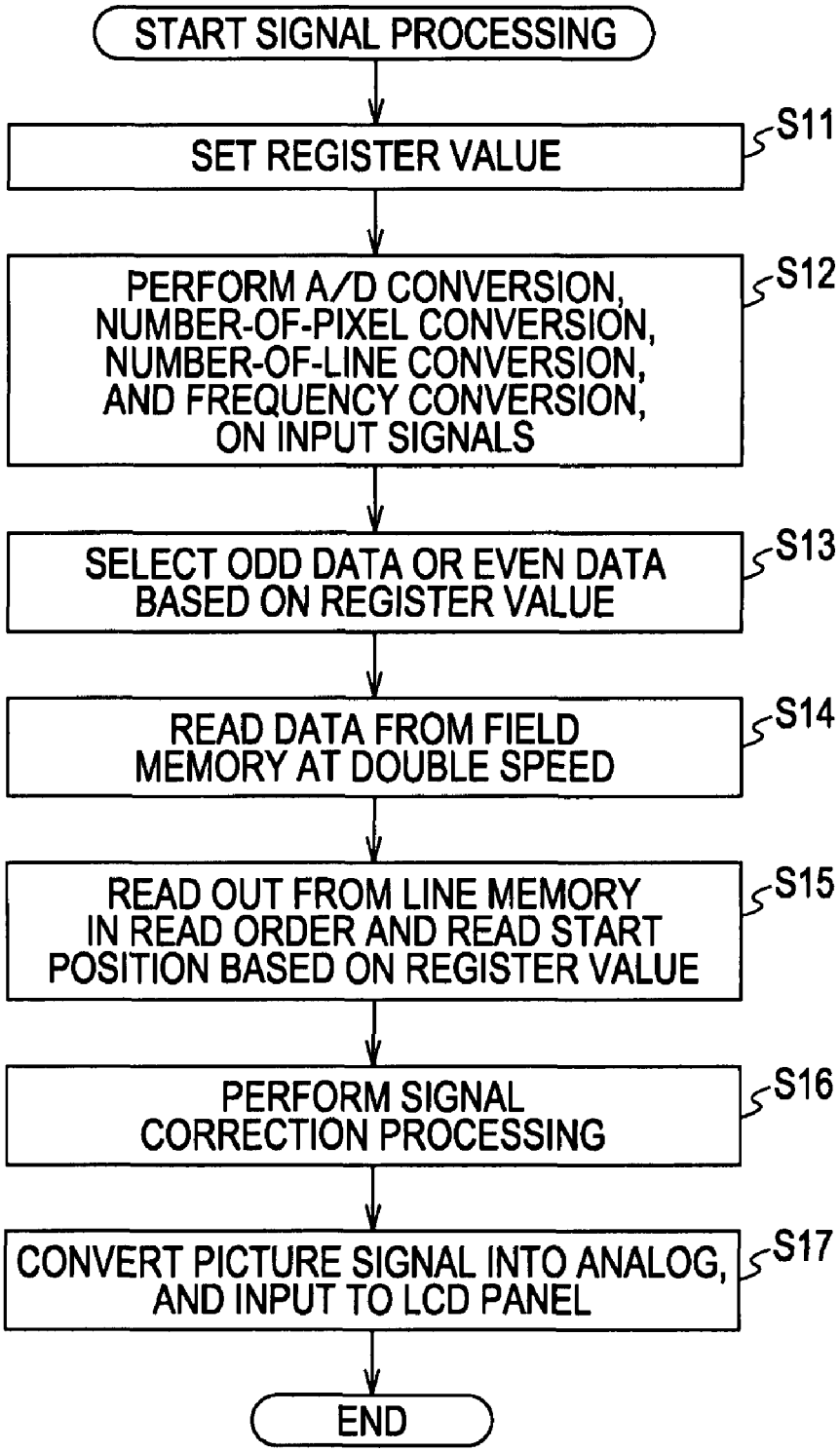
FIG. 17 is a flowchart describing the signal processing of a picture signal for displaying on the LCD panel of the liquid crystal display system in FIG. 5.

A signal processing method according to an embodiment of the present invention is a signal processing method of a signal processing circuit including a plurality of digital signal processing units configured to perform processing in parallel wherein the data equivalent to one field of a picture signal to be input is written in field memory, and simultaneously the data equivalent to one field from the field memory twice at double speed, thereby converting the frequency of the picture signal into double speed, i.e., twice as many frequency as the frequency to output to a display unit made up of a collective entity of pixels, the method including the steps of: performing the selection control of one of a plurality of systems of picture signals which are input, and the read position control of the picture stored in temporarily stored in line memory at the plurality of digital signal processing units (e.g., step S11 in FIG. 17); selecting one of the plurality of systems of picture signals based on the selection control (e.g., step S13 in FIG. 17); writing the data equivalent to one field of the selected picture signal in the field memory, and simultaneously reading the data equivalent to one field from the field memory twice at double speed, thereby converting the frequency of the picture signal into double speed, i.e., twice as many frequency as the frequency (e.g., step S14 in FIG. 17); reading out the picture signal converted into double speed, and temporarily stored in the line memory based on the read position control (e.g., step S15 in FIG. 17); and subjecting the read picture signal to predetermined correction processing (e.g., step S16 in FIG. 17).

Description will be made below regarding embodiments of the present invention with reference to the drawings.

FIG. 5 is a block diagram illustrating a configuration example of a liquid crystal display system to which an embodiment of the present invention is applied. With the example in FIG. 5, the liquid crystal display system is made up of a scan converter 111, digital signal drivers (DSD) IC (Integrated Circuit) 112-1 and 112-2, S/H (Sample/Hold) drivers 113-1 and 113-2, LCD (Liquid Crystal Display) panel 114, and a microcomputer 115, and performs signal processing for displaying a picture signal on the LCD panel 114.

Hereafter, in the event that there is no need to distinguish between the digital signal driver ICs 112-1 and 112-2, and between the S/H drivers 113-1 and 113-2 individually, each of those pairs will also be collectively referred to as a digital signal driver IC 112 and an S/H driver 113.

Note that the example in FIG. 5 illustrates an example in the case of employing the two digital signal driver ICs 112-1 and 112-2 capable of parallel processing, i.e., in the case of processing four signals in parallel, but the number of the digital signal driver ICs 112 is not restricted to two.

Also, of the digital signal driver ICs 112-1 and 112-2, the digital signal driver IC 112-1 serves as a master, and the digital signal driver IC 112-2 serves as a slave, so hereafter, in the event that there is a need to distinguish these individually, these will be also referred to as a master IC 112-1 and a slave IC 112-2, respectively.

An analog picture signal is input serially to the scan converter 111 from an unshown external device (e.g., personal computer) or the like. The scan converter 111 has an unshown A/D (Analog/Digital) conversion circuit built-in, subjects an analog picture signal to A/D conversion, number-of-pixel conversion, number-of-line conversion, frequency conversion, or the like, and outputs the converted picture signal to both of the master IC 112-1 and the slave IC 112-2.

That is to say, both (two systems of data) of the odd data (odd data) of a picture signal and the even data (even data) of a picture signal are input to both of the master IC 112-1 and the slave IC 112-2. The odd and even of a picture signal represent order when regarding the quickest data in time as the 1st. The quick data in time means data with quick display order, i.e., in the case of normal display, this represents data to be written in a pixel at a more left side in the horizontal direction of the LCD panel 114.

The scan converter 111 also supplies master clock CLK, and a horizontal synchronizing signal HSYNC and a vertical synchronizing signal VSYNC regarding a picture signal to the master IC 112-1 and the slave IC 112-2.

The master IC 112-1 selects one of the odd data and even data which are input from the scan converter 111, subjects the selected picture signal to double-speed conversion processing and picture signal processing for LCD panel 114, and outputs the processed picture signals to the S/H driver 113-1 as signals SIG1 and SIG2, under control of the microcomputer 115. Also, in response to the supplied master clock CLK, the master IC 112-1 supplies clock CLKOUT1 to the S/H driver 113-1, and also under the control of the microcomputer 115, generates various types of timing pulses based on the master clock CLK, the horizontal synchronizing signal HSYNC and the vertical synchronizing signal VSYNC regarding a picture signal, and supplies these to the LCD panel 114, slave IC 112-2, and S/H drivers 113-1 and 113-2.

Specifically, the master IC 112-1 is made up of a data path switch 131-1, a memory control unit 132-1, field memory 133-1, a signal correction processing circuit 134-1, a data path switch 135-1, a timing generator (TG) 136-1, a register 137-1, and a read start position control unit 138-1.

The data path switch 131-1 selects one of the ODD data and EVEN data input from the scan converter 111 with reference to a mirror reversed setting RGT of the register 137-1, a master/slave setting, and a horizontal display position setting HP, and outputs the selected data to the memory control unit 132-1 based on the timing pulse supplied from the timing generator 136-1.

The memory control unit 132-1 makes up a double-speed driving circuit for increasing a driving frequency along with the field memory 133-1 principally as a preventive measure for the flicker of the display screen by storing image signals equivalent to one frame in the field memory 133-1, and compressing and reading out the time axis. Also, at this time, serial-to-parallel conversion is performed, thereby enabling operation without increasing internal processing speed.

That is to say, based on the timing pulse supplied from the timing generator 136-1, the memory control unit 132-1 writes data equivalent to one field within one vertical period in the field memory 133-1, and also reads out the data equivalent to one field within one vertical period from the filed memory 133-1 twice, thereby performing processing for obtaining the converted double-speed data. The double-speed data is output to the read start position control unit 138-1.

The read start position control unit 138-1 temporarily stores the data from the memory control unit 132-1, and at the time of reading out the stored data, controls the read order and read start position of the stored data based on the mirror reversed setting RGT of the register 137-1, master/slave setting, and horizontal display position setting HP. Note that of the double-speed data, data with quick read order in time, in other words, data with quick display order will be referred to as data 1-1, and data with slow display order will be referred to as data 1-2.

The signal correction processing circuit 134-1 subjects the data 1-1 and data 1-2 from the read start position control unit 138-1 to signal correction processing in parallel, such as gamma correction, luminescent-spot correction, sharpness function, vertical stripe correction, or color unevenness correction, based on the timing pulse supplied from the timing generator 136-1 with reference to the mirror reversed setting RGT of the register 137-1, master/slave setting, and horizontal display position setting HP.

For example, at the time of color unevenness correction or the like, the signal correction processing circuit 134-1 performs a linear interpolation calculation with the headmost data of pixels equivalent to one port as reference, obtains the value of linear interpolation equivalent to each piece of data in four parallels necessary for correction (each piece of data equivalent to the four pixels of the LCD panel 114), and of the obtained values, selects the value of linear interpolation corresponding to the data to be processed, thereby performing the correction of the data to be processed.

The data path switch 135-1 outputs one of the data 1-1 and data 1-2 subjected to the signal correction processing by the signal correction processing circuit 134-1 to the S/H driver 113-1 as a signal SIG1, and outputs the other to the S/H driver 113-1 as a signal SIG2 with reference to the mirror reversed setting RGT of the register 137-1, master/slave setting, and horizontal display position setting HP.

The timing generator 136-1 generates various types of timing pulses based on the master clock CLK, vertical synchronizing signal VSYNC, and horizontal synchronizing signal HSYNC supplied from the scan converter 111, and performs the timing control of the respective units of the master IC 112-1 (i.e., data path switch 131-1, memory control unit 132-1, signal correction processing circuit 134-1, data path switch 135-1, and read start position control unit 138-1), slave IC 112-2, and LCD panel 114.

For example, the timing generator 136-1 supplies a timing pulse for reflecting the mirror reversed setting RGT to the timing generator 136-2 and signal correction processing circuit 134-2 of the slave IC 112-2, and supplies a driving timing pulse to the LCD panel 114.

The register 137-1 stores various types of values set by the microcomputer 115. For example, the register 137-1 stores values such as the mirror reversed setting RGT for setting the horizontal scan direction of the LCD panel 114, the master/slave setting for setting either the DSDIC 112-1 or the DSDIC 112-2 as the master DSDIC, and the horizontal display position setting HP for setting the display position in the horizontal direction of the LCD panel 114.

The slave IC 112-2 selects, as with the master IC 112-1, under the control of the microcomputer 115, the other (i.e., the data not selected by the master IC 112-1) of the odd data and even data which are input from the scan converter 111, subjects the selected picture signal to double-speed conversion processing and picture signal processing for LCD panel 114, and outputs the processed picture signals to the S/H driver 113-2 as signals SIG3 and SIG4. Also, in response to the supplied master clock CLK, the slave IC 112-2 supplies clock CLKOUT2 to the S/H driver 113-2.

Specifically, the slave IC 112-2 is made up of a data path switch 131-2, a memory control unit 132-2, field memory 133-2, a signal correction processing circuit 134-2, a data path switch 135-2, a timing generator (TG) 136-2, a register 137-2, and a read start position control unit 138-2.

The data path switch 131-2 is configured basically in the same way as the data path switch 131-1, selects the other of the ODD data and EVEN data input from the scan converter 111 with reference to the mirror reversed setting RGT of the register 137-2, the master/slave setting, and the horizontal display position setting HP, and outputs the selected data to the memory control unit 132-2 based on the timing pulse supplied from the timing generator 136-2.

The memory control unit 132-2 is configured basically in the same way as the memory control unit 132-1, and makes up a double-speed driving circuit along with the field memory 133-2. That is to say, based on the timing pulse supplied from the timing generator 136-2, the memory control unit 132-2 writes data equivalent to one field within one vertical period in the field memory 133-2, and also reads out the data equivalent to one field within one vertical period from the filed memory 133-2 twice, thereby performing processing for obtaining the converted double-speed data. The double-speed data is output to the read start position control unit 138-2.

The read start position control unit 138-2 is configured basically in the same way as the read start position control unit 138-1, temporarily stores the data from the memory control unit 132-2, and at the time of reading out the stored data, controls the read order and read start position of the stored data based on the mirror reversed setting RGT of the register 137-2, master/slave setting, and horizontal display position setting HP. Note that of the double-speed data, data with quick read order in time, in other words, data with quick display order will be referred to as data 2-1, and data with slow display order will be referred to as data 2-2.

The signal correction processing circuit 134-2 subjects the data 2-1 and data 2-2 from the read start position control unit 138-2 to signal correction processing in parallel, such as gamma correction, luminescent-spot correction, a sharpness function, and vertical stripe correction, and color unevenness correction, based on the timing pulse supplied from the timing generator 136-2, and the timing pulse for reflecting the mirror reversed setting RGT from the timing generator 136-1 with reference to the mirror reversed setting RGT of the register 137-2, master/slave setting, and horizontal display position setting HP.

At the time of color unevenness correction or the like, the signal correction processing circuit 134-2 also performs a linear interpolation calculation with the headmost data of pixels equivalent to one port as reference, obtains the value of linear interpolation equivalent to each piece of data in four parallels necessary for correction (each piece of data equivalent to the four pixels of the LCD panel 114), and of the obtained values, selects the value of linear interpolation corresponding to the data to be processed, thereby performing the correction of the data to be processed.

The data path switch 135-2 outputs one of the data 1-1 or the data 1-2 subjected to the signal correction processing by the signal correction processing circuit 134-2 to the S/H driver 113-2 as a signal SIG3, and outputs the other to the S/H driver 113-2 as a signal SIG4 with reference to the mirror reversed setting RGT of the register 137-2, master/slave setting, and horizontal display position setting HP.

The timing generator 136-2 generates various types of timing pulses based on the master clock CLK, vertical synchronizing signal VSYNC, and horizontal synchronizing signal HSYNC supplied from the scan converter 111, and performs the timing control of the respective units of the slave IC 112-2 (i.e., data path switch 131-2, memory control unit 132-2, signal correction processing circuit 134-2, data path switch 135-2, and read start position control unit 138-2).

Note that the timing generator 136-2 generates a timing pulse for reflecting the mirror reversed setting RGT to the respective units of the slave IC 112-2, based on the timing pulse for reflecting the mirror reversed setting RGT from the timing generator 136-1 of the master IC 112-1.

The register 137-2 stores, as with the register 137-1, various types of values set by the microcomputer 115. For example, the register 137-2 stores values such as the mirror reversed setting RGT, master/slave setting, and horizontal display position setting HP.

Now, hereafter, in the event that there is no need to distinguish between the data path switches 131-1 and 131-2, between the memory control units 132-1 and 132-2, between the field memory 133-1 and field memory 133-2, between the signal correction processing circuits 134-1 and 134-2, between the data path switches 135-1 and 135-2, between the timing generators 136-1 and 136-2, between the registers 137-1 and 137-2, and between the read start position control units 138-1 and 138-2 individually, each of those pairs will also be simply referred to as a data path switch 131, a memory control unit 132, field memory 133, a signal correction processing circuit 134, a data path switch 135, a timing generator 136, a register 137, and a read start position control unit 138.

Based on the clock CLKOUT1 from the master IC 112-1, the S/H driver 113-1 converts the signals SIG1 and SIG2 which are the digital picture signals input from the master IC 112-1 into analog picture signals, and inputs the analog picture signal converted from the signal SIG1, and the analog picture signal converted from the signal SIG2 to the LCD panel 114 multiple pixels at a time. For example, in the event that the LCD panel 114 is a liquid crystal panel employing a 12-pixel simultaneous writing system for writing 12 pixels in parallel, the S/H driver 113-1 and the slave IC 112-2 write six pixels at a time, so the signal SIG1 and signal SIG2 from the S/H driver 113-1 are input to the LCD panel 114 three pixels at a time.

Based on the clock CLKOUT2 from the slave IC 112-2, the S/H driver 113-2 converts the signal SIG3 and signal SIG4 which are the digital picture signals input from the slave IC 112-2 into analog picture signals, and inputs the analog picture signal converted from the signal SIG3, and the analog picture signal converted from the signal SIG4 to the LCD panel 114 multiple pixels at a time.

The LCD panel 114 is configured of a transparent insulating substrate where a pixel array unit is formed by pixels including liquid crystal cells which are electro-optics elements being two-dimensionally disposed in a matrix shape, which is configured, for example, by a first glass substrate and a second glass substrate being disposed so as to face each other with a predetermined gap, and a liquid crystal material being sealed within the gap. The LCD panel 114 is, for example, a liquid crystal panel employing a 12-pixel simultaneous writing system for writing 12 pixels in parallel, writes each six pixels from the S/H drivers 113-1 and 113-2 in the respective pixels of the LCD panel 114 twelve pixels at a time based on the driving timing pulse from the timing generator 136-1 of the master IC 112-1, thereby displaying the picture corresponding to the picture signals.

Now, in the event of a liquid crystal panel employing a 24-pixel simultaneous writing system for writing 24 pixels in parallel, each 12 pixels at a time, a picture signal of 24 pixels is input. Accordingly, in this case, the picture signals from the S/H drivers 113-1 and 113-2 are written in the respective pixels 24 pixels at a time.

The microcomputer 115 is configured so as to include, for example, a CPU (Central Processing Unit), ROM (Read Only Memory), and RAM (Random Access Memory), and so forth, and controls the processing of each of the units of the liquid crystal display system by executing a user's instruction from an unshown operating unit, and various types of program. For example, the microcomputer 115 performs various types of settings of the liquid crystal display system based on a user's instruction from the operating unit, and writes the value corresponding to each type of settings in the built-in register 137-1 of the master IC 112-1, and the built-in register 137-2 of the slave IC 112-2, thereby controlling the processing of each of the master IC 112-1 and the slave IC 112-2.

Figure 6:
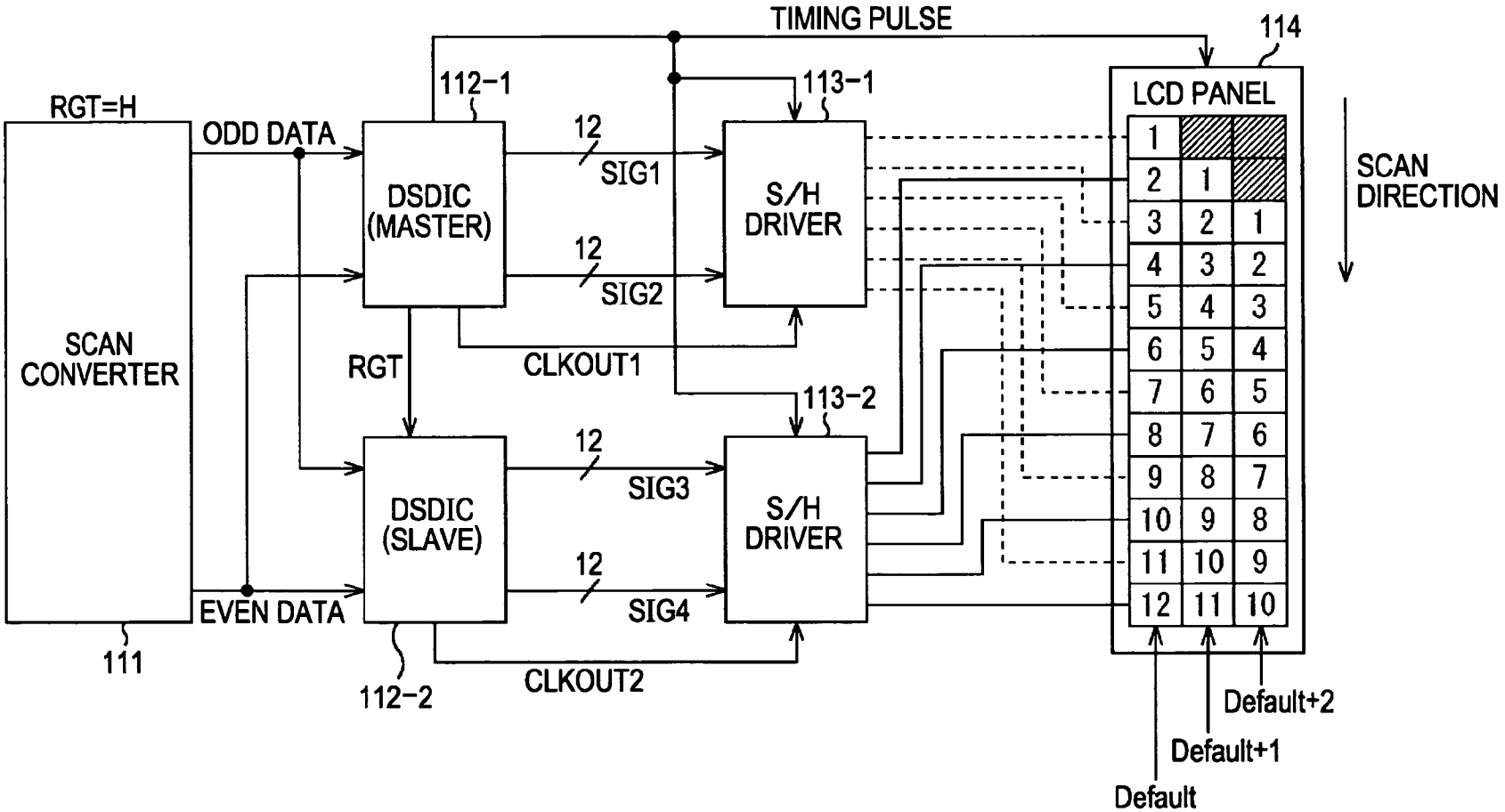
FIG. 6 is a diagram illustrating a wiring example between the S/H drivers and the LCD panel in FIG. 5 in the case of RGT=H.

FIG. 6 illustrates a wiring example between the S/H driver 113 and the LCD panel 114 at the time of RGT=H. The RGT=H represents that display is not mirror reversed display but normal display. Note that the scan direction of the LCD panel 114 in FIG. 6 is illustrated downward in the drawing. Also, on the LCD panel 114, of the pixels making up the LCD panel 114, twelve pixels from the first pixel in the alignment order in the horizontal direction are illustrated in order from the top of the drawing.

With the example in FIG. 6, as shown by the dotted lines, the S/H driver 113-1 is wired so as to input data to the odd (1st, 3rd, 5th, 7th, 9th, and 11th) pixels in the alignment order (i.e., in the horizontal direction) from the top of the drawing, and as shown by the solid lines, the S/H driver 113-2 is wired so as to input data to the even (2nd, 4th, 6th, 8th, 10th, and 12th) pixels in the alignment order (i.e., in the horizontal direction) from the top of the drawing.

Also, a number illustrated on each of the pixels of the LCD panel 114 represents a data number of the valid picture period of a signal to be written in each of the pixels, in order from the left most column, in the case in which the horizontal display position setting HP is a default at the time of RGT=H, in the case of a default+1 (in the case of one dot shifted from default), and in the case of a default+2 (in the case of two dots shifted from default), and the hatch given to a pixel represents that the data within an invalid picture period is written in the pixel thereof.

First, description will be made regarding the case in which the horizontal display position setting HP is default. In the case in which the horizontal display position setting HP is default, of the odd data and even data input from the scan converter 111, the master IC 112-1 selects the odd data, and subjects the selected odd data to double-speed conversion processing, read order and read start position change processing, and picture signal processing for the LCD panel 114. Note that at this time, the timing pulse for reflecting the mirror reversed setting RGT is supplied to the slave IC 112-2 from the master IC 112-1.

The master IC 112-1 outputs the signal SIG1 (e.g., the 1st, 5th, and 9th data) and the signal SIG2 (e.g., the 3rd, 7th, and 11th data) which are picture signals subjected to the processing to the S/H driver 113-1 in 12-bit parallel, and also supplies the clock CLKOUT1 to the S/H driver 113-1. Note that these data numbers represent quick order in time within a valid picture period.

Subsequently, based on the clock CLKOUT1 from the master IC 112-1, the S/H driver 113-1 converts the signals SIG1 and SIG2 which are digital picture signals input from the master IC 112-1 into analog picture signals, and inputs these to the LCD panel 114 three pixels at a time. That is to say, the 1st, 3rd, 5th, 7th, 9th, and 11th data are input from the S/H driver 113-1 to the odd pixels from the top of the drawing of the LCD panel 114 in order from the top.

On the other hand, with reference to the mirror reversed setting RGT (H) of the register 137-2, master/slave setting, horizontal display position setting HP (default), and timing pulse for reflecting the mirror reversed setting RGT supplied from the master IC 112-1, of the odd data and even data input from the scan converter 111, the slave IC 112-2 selects the even data, subjects the selected even data to double-speed conversion processing, read order and read start position change processing, and picture signal processing for the LCD panel 114, outputs the signal SIG3 (e.g., the 2nd, 6th, and 10th data) and the signal SIG4 (e.g., the 4th, 8th, and 12th data) which are picture signals subjected to the processing to the S/H driver 113-2 in 12-bit parallel, and also supplies the clock CLKOUT2 to the S/H driver 113-2.

Subsequently, based on the clock CLKOUT2 from the slave IC 112-2, the S/H driver 113-2 converts the signal SIG3 and signal SIG4 which are digital picture signals input from the slave IC 112-2 into analog picture signals, and input these to the LCD panel 114 three pixels at a time. That is to say, the 2nd, 4th, 6th, 8th, 10th, and 12th data are input from the S/H driver 113-2 to the even pixels from the top of the drawing of the LCD panel 114 in order from the top.

According to the above-mentioned arrangement, in the case in which the horizontal display position setting HP is default at the time of RGT=H, the 1st through 12th data during a valid picture period are written in the 1st through 12th pixels from the top in the drawing of the LCD panel 114 in order from the top simultaneously.

Next, description will be made regarding the case in which the horizontal display position setting HP is default+1. In the case in which the horizontal display position setting HP is default+1, the master IC 112-1 references the mirror reversed setting RGT (H) of the register 137-1, master-slave settings, and horizontal display position setting HP (default+1), selects, of the odd data and even data input from the scan converter 111, the even data, and subjects the selected even data to double-speed conversion processing, read order and read start position change processing, and picture signal processing for the LCD panel 114.

The master IC 112-1 outputs the signal SIG1 (e.g., data other than the valid picture period, and 4th and 8th data) and the signal SIG2 (e.g., the 2nd, 6th, and 10th data) which are picture signals subjected to the processing to the S/H driver 113-1 in 12-bit parallel, and also supplies the clock CLKOUT1 to the S/H driver 113-1.

Subsequently, based on the clock CLKOUT1 from the master IC 112-1, the S/H driver 113-1 converts the signals SIG1 and SIG2 which are digital picture signals input from the master IC 112-1 into analog picture signals, and inputs these to the LCD panel 114 three pixels at a time. That is to say, the 2nd, 4th, 6th, 8th, and 10th data are input from the S/H driver 113-1 to the odd pixels from the top of the drawing of the LCD panel 114 in order from the top.

On the other hand, with reference to the mirror reversed setting RGT (H) of the register 137-2, master/slave setting, horizontal display position setting HP (default+1), and timing pulse for reflecting the mirror reversed setting RGT supplied from the master IC 112-1, of the odd data and even data input from the scan converter 111, the slave IC 112-2 selects the odd data, subjects the selected odd data to double-speed conversion processing, read order and read start position change processing, and picture signal processing for the LCD panel 114, outputs the signal SIG3 (e.g., the 1st, 5th, and 9th data) and the signal SIG4 (e.g., the 3rd, 7th, and 11th data) which are picture signals subjected to the processing to the S/H driver 113-2 in 12-bit parallel, and also supplies the clock CLKOUT2 to the S/H driver 113-2.

Subsequently, based on the clock CLKOUT2 from the slave IC 112-2, the S/H driver 113-2 converts the signals SIG3 and SIG4 which are digital picture signals input from the slave IC 112-2 into analog picture signals, and input these to the LCD panel 114 three pixels at a time. That is to say, the 1st, 3rd, 5th, 7th, 9th, and 11th data are input from the S/H driver 113-2 to the even pixels from the top of the drawing of the LCD panel 114 in order from the top.

According to the above-mentioned arrangement, in the case in which the horizontal display position setting HP is default+1 at the time of RGT=H, the 2nd through 12th data during a valid picture period are written in the 1st through 11th pixels from the top in the drawing of the LCD panel 114 in order from the top simultaneously. That is to say, an image which is shifted by one dot from the case in which the horizontal display position is a default is displayed.

Further, description will be made regarding the case in which the horizontal display position setting HP is default+2. In the case in which the horizontal display position setting HP is default+2, of the odd data and even data input from the scan converter 111, the master IC 112-1 selects the odd data, and subjects the selected odd data to double-speed conversion processing, read order and read start position change processing, and picture signal processing for the LCD panel 114.

The master IC 112-1 outputs the signal SIG1 (e.g., data other than the valid picture period, and 3rd and 7th data) and the signal SIG2 (e.g., the 1st, 5th, and 9th data) which are picture signals subjected to the processing to the S/H driver 113-1 in 12-bit parallel, and also supplies the clock CLKOUT1 to the S/H driver 113-1.

Subsequently, based on the clock CLKOUT1 from the master IC 112-1, the S/H driver 113-1 converts the signals SIG1 and SIG2 which are digital picture signals input from the master IC 112-1 into analog picture signals, and inputs these to the LCD panel 114 three pixels at a time. That is to say, data other than the valid picture period, and the 1st, 3rd, 5th, 7th, and 9th data are input from the S/H driver 113-1 to the odd pixels from the top of the drawing of the LCD panel 114 in order from the top.

On the other hand, with reference to the mirror reversed setting RGT (H) of the register 137-2, master/slave setting, horizontal display position setting HP (default+2), and timing pulse for reflecting the mirror reversed setting RGT supplied from the master IC 112-1, of the odd data and even data input from the scan converter 111, the slave IC 112-2 selects the even data, subjects the selected even data to double-speed conversion processing, read order and read start position change processing, and picture signal processing for the LCD panel 114, outputs the signal SIG3 (e.g., data within an invalid picture period, the 4th, and 8th data) and the signal SIG4 (e.g., the 2nd, 6th, and 10th data) which are picture signals subjected to the processing to the S/H driver 113-2 in 12-bit parallel, and also supplies the clock CLKOUT2 to the S/H driver 113-2.

Subsequently, based on the clock CLKOUT2 from the slave IC 112-2, the S/H driver 113-2 converts the signals SIG3 and SIG4 which are digital picture signals input from the slave IC 112-2 into analog picture signals, and input these to the LCD panel 114 three pixels at a time. That is to say, the 2nd, 4th, 6th, 8th, and 10th data are input from the S/H driver 113-2 to the even pixels from the top of the drawing of the LCD panel 114 in order from the top.

According to the above-mentioned arrangement, in the case in which the horizontal display position setting HP is default+2 at the time of RGT=H, the 1st through 10th data are written in the 3rd through 12th pixels (excluding the 1st and 2nd pixels from the top) from the top in the drawing of the LCD panel 114 in order from the top simultaneously. That is to say, an image which is shifted by two dots from the case in which the horizontal display position is a default is displayed.

Figure 7:
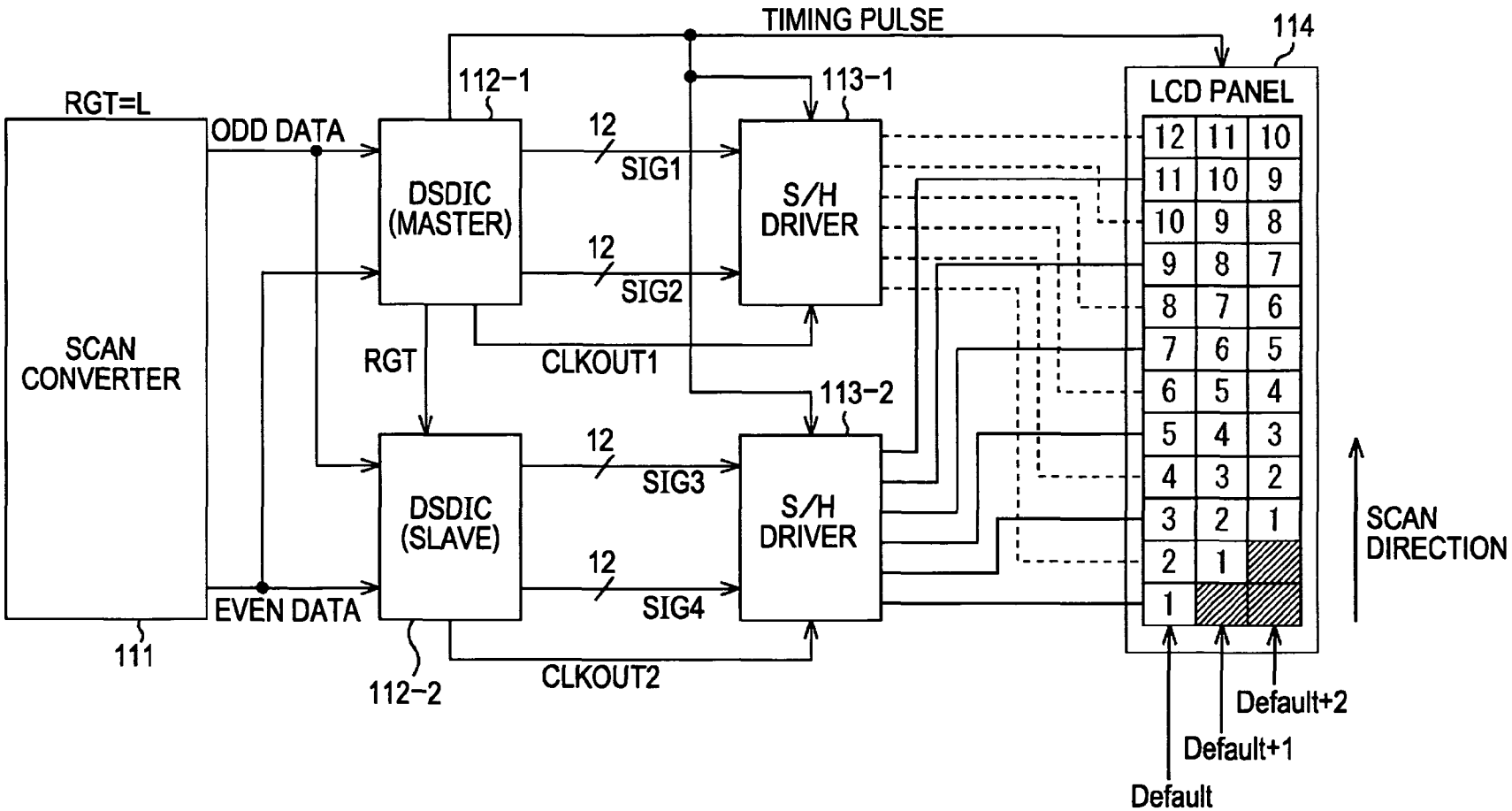
FIG. 7 is a diagram illustrating a wiring example between the S/H drivers and the LCD panel in FIG. 5 in the case of RGT=L.

FIG. 7 illustrates a wiring example between the S/H driver 113 and the LCD panel 114 at the time of RGT=L as to the case of RGT=H in FIG. 6. The RGT=L represents that display is mirror reversed display. Note that the scan direction of the LCD panel 114 in FIG. 7 is illustrated upward in the drawing. Also, on the LCD panel 114, of the pixels making up the LCD panel 114, in order from the bottom in the drawing, 12 pixels from the 1st pixel in the alignment order in the horizontal direction are illustrated.

With the example in FIG. 7, the S/H driver 113-1 is wired to the LCD panel 114 as with the case in FIG. 6. Note that as viewed from the bottom in the drawing, as shown by the dotted lines, the S/H driver 113-1 is wired to the LCD panel 114 so as to write data in the even (the 2nd, 4th, 6th, 8th, 10th, and 12th) pixels in the alignment order from the bottom in the drawing, and as shown by the solid lines, the S/H driver 113-2 is wired to the LCD panel 114 so as to write data in the odd (the 1st, 3rd, 5th, 7th, 9th, and 11th) pixels in the alignment order from the bottom in the drawing.

Also, a number illustrated on each of the pixels of the LCD panel 114 represents, as with the case in the example of FIG. 6, a data number of the valid picture period of a signal to be written in each of the pixels, in order from the left most column, in the case in which the horizontal display position setting HP is a default at the time of RGT=L, in the case of default+1, and in the case of default+2, and the hatch given to a pixel represents that the data other than the valid picture period is written in the pixel thereof.

First, description will be made regarding the case in which the horizontal display position setting HP is a default. In the case in which the horizontal display position setting HP is a default, the master IC 112-1 references the mirror reversed setting RGT (L) of the register 137-1, master/slave setting, and horizontal display position setting HP (default), selects, of the odd data and even data input from the scan converter 111, the even data, and subjects the selected even data to double-speed conversion processing, read order and read start position change processing, and picture signal processing for the LCD panel 114. Note that at this time, the timing pulse for reflecting the mirror reversed setting RGT is supplied to the slave IC 112-2 from the master IC 112-1, as with the case of the example in FIG. 6.

The master IC 112-1 outputs the signal SIG1 (e.g., the 4th, 8th, and 12th data) and the signal SIG2 (e.g., the 2nd, 6th, and 10th data) which are picture signals subjected to the processing to the S/H driver 113-1 in 12-bit parallel, and also supplies the clock CLKOUT1 to the S/H driver 113-1.

Subsequently, based on the clock CLKOUT1 from the master IC 112-1, the S/H driver 113-1 converts the signals SIG1 and SIG2 which are digital picture signals input from the master IC 112-1 into analog picture signals, and inputs these to the LCD panel 114 three pixels at a time. That is to say, the 2nd, 4th, 6th, 8th, 10th, and 12th data are input from the S/H driver 113-1 to the even pixels from the bottom of the drawing of the LCD panel 114 in order from the bottom.

On the other hand, with reference to the mirror reversed setting RGT (L) of the register 137-2, master/slave setting, horizontal display position setting HP (default), and timing pulse for reflecting the mirror reversed setting RGT supplied from the master IC 112-1, of the odd data and even data input from the scan converter 111, the slave IC 112-2 selects the odd data, subjects the selected odd data to double-speed conversion processing, read order and read start position change processing, and picture signal processing for the LCD panel 114, outputs the signal SIG3 (e.g., the 3rd, 7th, and 11th data) and the signal SIG4 (e.g., the 1st, 5th, and 9th data) which are picture signals subjected to the processing to the S/H driver 113-2 in 12-bit parallel, and also supplies the clock CLKOUT2 to the S/H driver 113-2.

Subsequently, based on the clock CLKOUT2 from the slave IC 112-2, the S/H driver 113-2 converts the signals SIG3 and SIG4 which are digital picture signals input from the slave IC 112-2 into analog picture signals, and input these to the LCD panel 114 three pixels at a time. That is to say, the 1st, 3rd, 5th, 7th, 9th, and 11th data are input from the S/H driver 113-2 to the odd pixels from the bottom of the drawing of the LCD panel 114 in order from the bottom.

According to the above-mentioned arrangement, in the case in which the horizontal display position setting HP is a default at the time of RGT=L, the 1st through 12th data during a valid picture period are written in the 1st through 12th pixels from the bottom in the drawing of the LCD panel 114 in order from the bottom simultaneously.

Next, description will be made regarding the case in which the horizontal display position setting HP is a default+1. In the case in which the horizontal display position setting HP is a default+1, the master IC 112 references the mirror reversed setting RGT (L) of the register 137-1, master/slave setting, and horizontal display position setting HP (default+1), selects, of the odd data and even data input from the scan converter 111, the odd data, and subjects the selected odd data to double-speed conversion processing, read order and read start position change processing, and picture signal processing for the LCD panel 114.

The master IC 112-1 outputs the signal SIG1 (e.g., the 3rd, 7th, and 11th data) and the signal SIG2 (e.g., the 1st, 5th, and 9th data) which are picture signals subjected to the processing to the S/H driver 113-1 in 12-bit parallel, and also supplies the clock CLKOUT1 to the S/H driver 113-1.

Subsequently, based on the clock CLKOUT1 from the master IC 112-1, the S/H driver 113-1 converts the signals SIG1 and SIG2 which are digital picture signals input from the master IC 112-1 into analog picture signals, and inputs these to the LCD panel 114 three pixels at a time. That is to say, the 1st, 3rd, 5th, 7th, 9th, and 11th data are input from the S/H driver 113-1 to the even pixels from the bottom of the drawing of the LCD panel 114 in order from the bottom.

On the other hand, with reference to the mirror reversed setting RGT (L) of the register 137-2, master/slave setting, horizontal display position setting HP (default+1), and timing pulse for reflecting the mirror reversed setting RGT supplied from the master IC 112-1, of the odd data and even data input from the scan converter 111, the slave IC 112-2 selects the even data, subjects the selected even data to double-speed conversion processing, read order and read start position change processing, and picture signal processing for the LCD panel 114, outputs the signal SIG3 (e.g., the 2nd, 6th, and 10th data) and the signal SIG4 (e.g., data within an invalid picture period, 4th, and 8th data) which are picture signals subjected to the processing to the S/H driver 113-2 in 12-bit parallel, and also supplies the clock CLKOUT2 to the S/H driver 113-2.

Subsequently, based on the clock CLKOUT2 from the slave IC 112-2, the S/H driver 113-2 converts the signals SIG3 and SIG4 which are digital picture signals input from the slave IC 112-2 into analog picture signals, and inputs these to the LCD panel 114 three pixels at a time. That is to say, the 2nd, 4th, 6th, 8th, and 10th data are input from the S/H driver 113-2 to the odd pixels from the bottom of the drawing of the LCD panel 114 in order from the bottom.

According to the above-mentioned arrangement, in the case in which the horizontal display position setting HP is a default+1 at the time of RGT=L, the 1st through 11th data are written in the 2nd through 12th pixels from the bottom in the drawing of the LCD panel 114 in order from the bottom simultaneously. That is to say, an image which is shifted by one dot from the case in which the horizontal display position is a default is displayed on the LCD panel 114.

Further, description will be made regarding the case in which the horizontal display position setting HP is a default+2. In the case in which the horizontal display position setting HP is a default+2, the master IC 112 references the mirror reversed setting RGT (L) of the register 137-1, master/slave setting, and horizontal display position setting HP (default+2), selects, of the odd data and even data input from the scan converter 111, selects the even data, and subjects the selected even data to double-speed conversion processing, read order and read start position change processing, and picture signal processing for the LCD panel 114.

The master IC 112-1 outputs the signal SIG1 (e.g., the 2nd, 6th, and 10th data) and the signal SIG2 (e.g., data within an invalid picture period, 4th, and 8th data) which are picture signals subjected to the processing to the S/H driver 113-1 in 12-bit parallel, and also supplies the clock CLKOUT1 to the S/H driver 113-1.

Subsequently, based on the clock CLKOUT1 from the master IC 112-1, the S/H driver 113-1 converts the signals SIG1 and SIG2 which are digital picture signals input from the master IC 112-1 into analog picture signals, and inputs these to the LCD panel 114 three pixels at a time. That is to say, data within an invalid picture period, the 2nd, 4th, 6th, 8th, and 10th data are input from the S/H driver 113-1 to the even pixels from the bottom of the drawing of the LCD panel 114 in order from the bottom.

On the other hand, with reference to the mirror reversed setting RGT (L) of the register 137-2, master/slave setting, horizontal display position setting HP (default+2), and timing pulse for reflecting the mirror reversed setting RGT supplied from the master IC 112-1, of the odd data and even data input from the scan converter 111, the slave IC 112-2 selects the odd data, subjects the selected odd data to double-speed conversion processing, read order and read start position change processing, and picture signal processing for the LCD panel 114, outputs the signal SIG3 (e.g., the 1st, 5th, and 9th data) and the signal SIG4 (e.g., data within an invalid picture period, 3rd, and 7th data) which are picture signals subjected to the processing to the S/H driver 113-2 in 12-bit parallel, and also supplies the clock CLKOUT2 to the S/H driver 113-2.

Subsequently, based on the clock CLKOUT2 from the slave IC 112-2, the S/H driver 113-2 converts the signals SIG3 and SIG4 which are digital picture signals input from the slave IC 112-2 into analog picture signals, and inputs these to the LCD panel 114 three pixels at a time. That is to say, the 1st, 3rd, 5th, 7th, and 9th data are input from the S/H driver 113-2 to the odd pixels from the bottom of the drawing of the LCD panel 114 in order from the bottom.

According to the above-mentioned arrangement, in the case in which the horizontal display position setting HP is a default+2 at the time of RGT=L, the 1st through 10th data are written in the 3rd through 12th pixels (excluding the 1st and 2nd pixels from the bottom) from the bottom in the drawing of the LCD panel 114 in order from the bottom simultaneously. That is to say, an image which is shifted by two dots from the case in which the horizontal display position is a default is displayed.

As described above, in the event that an image is displayed on the LCD panel 114 by employing multiple S/H drivers 113, an arrangement is made wherein signals to be input the multiple S/H drivers 113 are selected at the master IC 112-1 and slave IC 112-2 which are the previous stages thereof based on the mirror reversed setting RGT, master/slave setting, and horizontal display position setting HP which are controlled by the microcomputer 115. Thus, as shown in the cases of a default in FIG. 6 and FIG. 7, the horizontal display positions in the LCD panel 114 where determination is made inevitably regarding whether the data from which S/H driver 113 is written in a specific pixel can be set in increments of single dots, such that the horizontal display positions can be shifted by one dot or two dots from the case of a default, whereby arbitrary data can be written in a specific pixel of the LCD panel 114.

Specifically, the selection processing of input signals to the S/H drivers 113 can be realized by data interchanging processing at the master IC 112-1 and slave IC 112-2, and data read order and read start position change processing at the read start position control units 138-1 and 138-2, which will be described next. Note that the control of the above-mentioned processing at the master IC 112-1 and slave IC 112-2 can be executed by the microcomputer 115.

Figure 8:
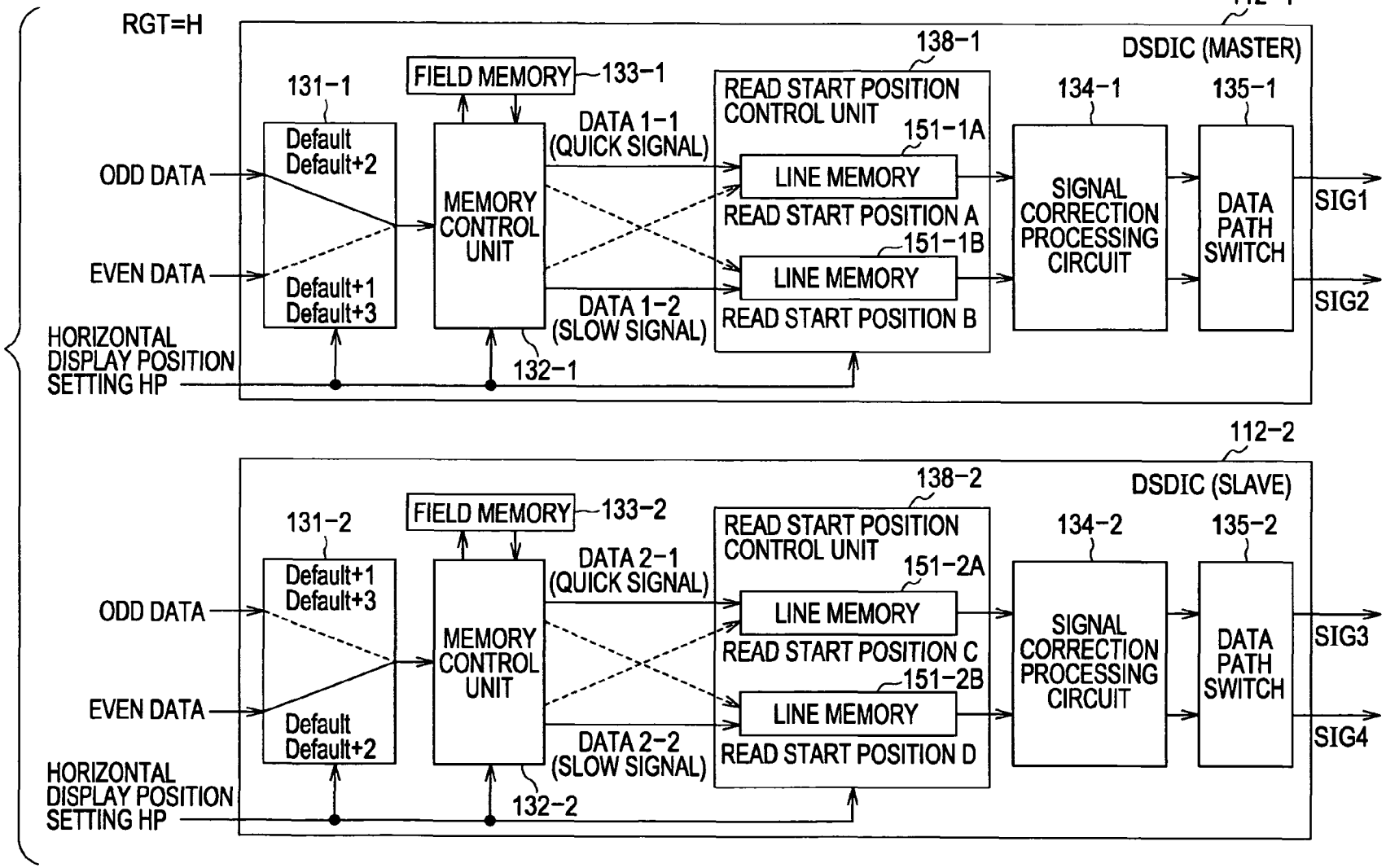
FIG. 8 is a diagram describing the operations of the master IC and the slave IC in the case of RGT=H.

FIG. 8 is a diagram describing the operations of the master IC 112-1 and slave IC 112-2 in the case of FIG. 6 (i.e., at the time of RGT=H). Note that actually, as shown in FIG. 8, the read start position control unit 138-1 of the master IC 112-1 is configured so as to include line memory 151-1A and 151-1B, and the read start position control unit 138-2 of the slave IC 112-2 is configured so as to include line memory 151-2A and 151-2B. Also, in the event that there is no need to distinguish between the line memory 151-1A, 151-1B, 151-2A, and 151-2B individually, these will also be simply referred to line memory 151.

In the case in which the horizontal display position setting HP is a default or a default+2, as shown by the solid lines, of the odd data and even data input from the scan converter 111, the data path switch 131-1 of the master IC 112-1 selects the odd data. In the case in which the horizontal display position setting HP is a default+1 or a default+3, as shown by the dotted lines, of the odd data and even data input from the scan converter 111, the data path switch 131-1 selects the even data.

In the case in which the horizontal display position setting HP is a default or a default+2, as shown by the solid lines, of the odd data and even data input from the scan converter 111, the data path switch 131-2 of the slave IC 112-2 selects the even data. In the case in which the horizontal display position setting HP is a default+1 or a default+3, as shown by the dotted lines, of the odd data and even data input from the scan converter 111, the data path switch 131-2 selects the odd data.

Thus, in the case in which the horizontal display position setting HP is a default, when the odd data and even data are selected at the master IC 112-1 and slave IC 112-2 respectively, each time one dot is shifted, there is a need to change the selection of the odd data/even data at the master IC 112-1 and slave IC 112-2.

The data selected by the data path switch 131-1 is input to the memory control unit 132-1 of the master IC 112-1. The memory control unit 132-1 writes the selected data equivalent to one field in the field memory 133-1, reads out this at double speed, and according to the horizontal display position setting HP, performs switching so as to write data 1-1 which is a signal having quick read order in time in one of the line memory 151-1A and 151-1B, and also performs switching so as to write data 1-2 which is a signal having slow read order in time in the other.

Subsequently, the read start position control unit 138-1 reads out the written data 1-1 and data 1-2 from the line memory 151-1A and line memory 151-1B, in read order corresponding to the horizontal display position setting HP, respectively. That is to say, with the read start position control unit 138-1, the read order from the line memory 151-1A and the read order from the line memory 151-1B are changed according to the horizontal display position setting HP.

Also, at this time, the read start position control unit 138-1 also changes a read start position A where the readout of data within a valid picture period is started from the line memory 151-1A, and also changes a read start position B where the readout of data within a valid picture period is started from the line memory 151-1B.

Subsequently, with the read start position control unit 138-1, the data 1-1 and data 1-2 are read out from the line memory 151-1A and line memory 151-1B in parallel based on the above-mentioned control. The readout data 1-1 and data 1-2 are subjected to predetermined correction processing at the signal correction processing circuit 134-1, and output to the S/H driver 113-1 by the data path switch 135-1 as signals SIG1 and SIG2.

The data selected by the data path switch 131-2 is input to the memory control unit 132-2 of the slave IC 112-2. The memory control unit 132-2 writes the selected data equivalent to one field in the field memory 133-2, reads out this at double speed, and according to the horizontal display position setting HP, performs interchanging so as to write data 2-1 which is a signal having quick read order in time in one of the line memory 151-2A and 151-2B, and also performs interchanging so as to write data 2-2 which is a signal having slow read order in time in the other.

Subsequently, the read start position control unit 138-2 reads out the written data 2-1 and data 2-2 from the line memory 151-2A and line memory 151-2B, in read order corresponding to the horizontal display position setting HP, respectively. That is to say, with the read start position control unit 138-2, the read order from the line memory 151-2A and the read order from the line memory 151-2B are changed according to the horizontal display position setting HP.

Also, at this time, the read start position control unit 138-2 also changes a read start position C where the readout of data within a valid picture period is started from the line memory 151-2A, and also changes a read start position D where the readout of data within a valid picture period is started from the line memory 151-2B.

Subsequently, with the read start position control unit 138-2, the data 2-1 and data 2-2 are read out from the line memory 151-2A and line memory 151-2B in parallel based on the above-mentioned control. The readout data 2-1 and data 2-2 are subjected to predetermined correction processing at the signal correction processing circuit 134-2, and output to the S/H driver 113-2 by the data path switch 135-2 as signals SIG3 and SIG4.

Next, description will be made in detail regarding the control of the read order and read start position of data according to the horizontal display position setting HP with reference to FIG. 9 through FIG. 12.

Figure 9:
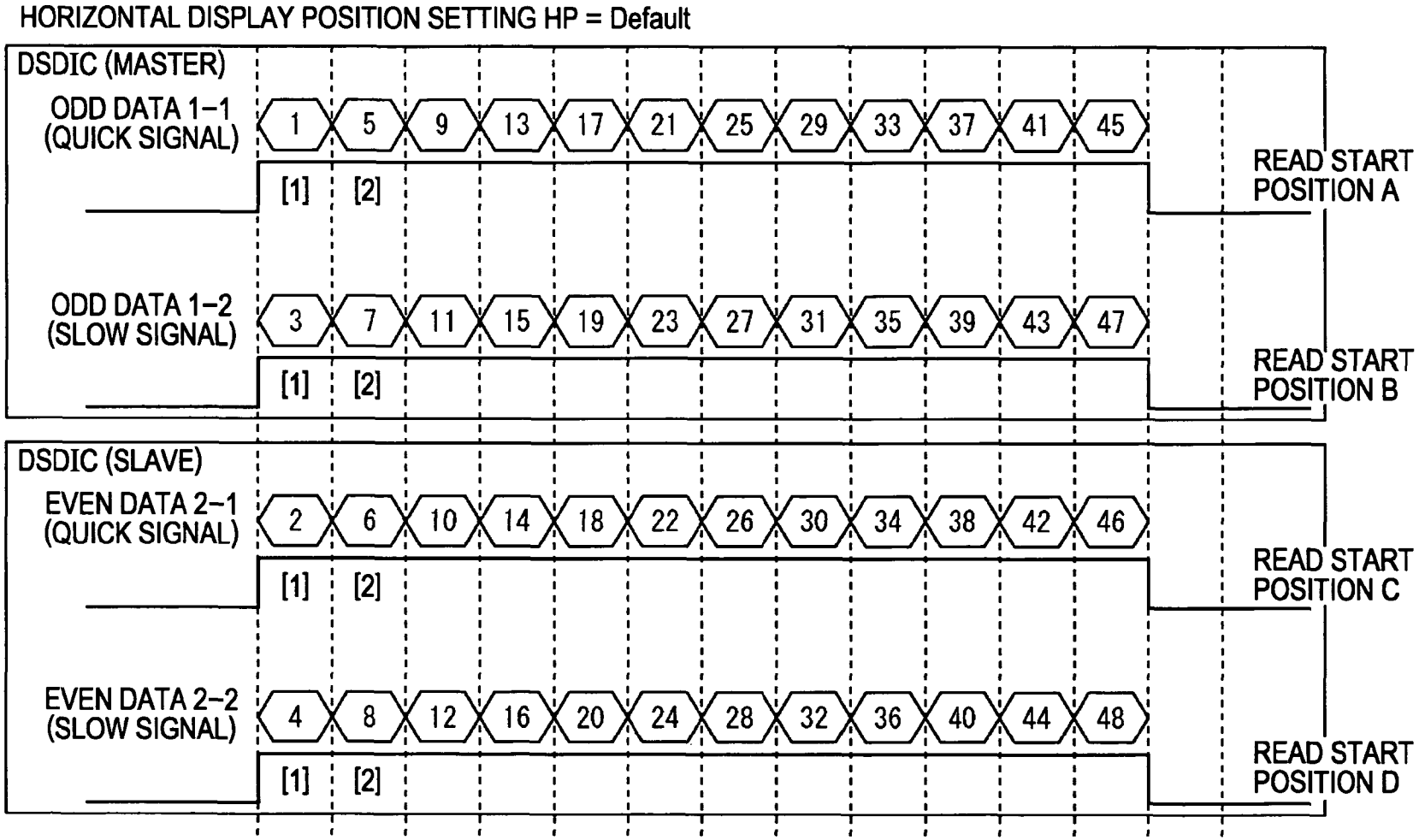
FIG. 9 is a diagram describing the read order and read start position of data in a case in which a horizontal display position setting HP is a default when RGT=H.

FIG. 9 illustrates an example of data written in the respective pixels of the LCD panel 114 in the case in which the horizontal display position setting HP is a default, and the read start position of the data thereof. Note that with the example in FIG. 9, the multiple rectangles at the first row from the top represent the respective pixels of the LCD panel 114 where the data read out from the line memory 151-1A is written, the multiple rectangles at the second row from the top represent the respective pixels of the LCD panel 114 where the data read out from the line memory 151-1B is written, the multiple rectangles at the third row from the top represent the respective pixels of the LCD panel 114 where the data read out from the line memory 151-2A is written, and the multiple rectangles at the fourth row from the top represent the respective pixels of the LCD panel 114 where the data read out from the line memory 151-2B is written. Also, the numbers appended to these rectangles represent data numbers to be written in the respective pixels, which are quick in time during a valid picture period (data numbers having quick display order).

Also, the solid line illustrated below the respective pixels represents that the position where the data to be written in the pixel where the leading edge of the solid line is positioned is read out from each line memory 151 is the read start position of a valid picture period at each line memory 151. That is to say, data within a valid picture period is written in the pixels between the leading edge and the trailing edge. Note that with the liquid crystal display system shown in FIG. 5, four sets of signal processing are performed in parallel, so as a time axis, [1] the 1st, 2nd, 3rd, and 4th data, [2] the 5th, 6th, 7th, and 8th data, and hereafter, though not shown in the drawing, similarly, [3] the 9th, 10th, 11th, and 12th data, [4] the 13th, 14th, 15th, and 16th data, and so on are processed in increments of four pieces of data.

In the case in which the horizontal display position setting HP is a default, with the master IC 112-1, the odd data selected by the data path switch 131-1 is written in the field memory 133-1, and with the slave IC 112-2, the even data selected by the data path switch 131-2 is written in the field memory 133-2.

The memory control unit 132-1 of the master IC 112-1 reads out data from the field memory 133-1 at double speed, and of the readout data, writes odd data 1-1 which is a signal having quick read order in time in the line memory 151-1A, and writes odd data 1-2 which is a signal having slow read order in time in the line memory 151-1B. Subsequently, the read start position control unit 138-1 performs control to read out the odd data 1-1 which is a signal having quick read order in time from the line memory 151-1A, and control to read out the odd data 1-2 which is a signal having slow read order in time from the line memory 151-1B.

The memory control unit 132-2 of the slave IC 112-2 reads out data from the field memory 133-2 at double speed, and of the readout data, writes even data 2-1 which is a signal having quick read order in time in the line memory 151-2A, and writes even data 2-2 which is a signal having slow read order in time in the line memory 151-2B. Subsequently, the read start position control unit 138-2 performs control to read out the even data 2-1 which is a signal having quick read order in time from the line memory 151-2A, and control to read out the even data 2-2 which is a signal having slow read order in time from the line memory 151-2B.

Also, at this time, under the control of the read start position control unit 138-1, a read start position A is set to a position where the data to be written in the leftmost pixel at the first row (the 1st data within a valid picture period in the case of FIG. 9) is read out, and a read start position B is set to a position where the data to be written in the leftmost pixel at the second row (the 3rd data within a valid picture period in the case of FIG. 9) is read out. Also, under the control of the read start position control unit 138-2, a read start position C is set to a position where the data to be written in the leftmost pixel at the third row (the 2nd data within a valid picture period in the case of FIG. 9) is read out, and a read start position D is set to a position where the data to be written in the leftmost pixel at the fourth row (the 4th data within a valid picture period in the case of FIG. 9) is read out. That is to say, in the case in which the horizontal display position setting HP is a default, each of the read start positions is set to a position where the data to be written in the leftmost pixel is read out.

Based on the above-mentioned control, the 1st, 2nd, 3rd, and 4th data equivalent to the four pixels of the processing unit of [1], the 5th, 6th, 7th, and 8th data equivalent to the four pixels of the processing unit of [2], and each piece of data equivalent to four pixels thereafter are read out from each of the line memory 151 in parallel with each of the read start positions A through D as a start position, and input to each of the pixels of the LCD panel 114 via the S/H driver 113.

According to the above-mentioned arrangement, in the case in which the horizontal display position setting HP is a default, the odd data 1-1 (the 1st, 5th, 9th, 13th, 17th, 21st, 25th, 29th, 33rd, 37th, 41st, and 45th data) read out as quick signals from the line memory 151-1A of the master IC 112-1 are, as shown in the rectangles at the first row, written in each of the pixels of the LCD panel 114 in order from the left. The odd data 1-2 (the 3rd, 7th, 11th, 15th, 19th, 23rd, 27th, 31st, 35th, 39th, 43rd, and 47th data) read out as slow signals from the line memory 151-1B of the master IC 112-1 are, as shown in the rectangles at the second row, written in each of the pixels of the LCD panel 114 in order from the left.

Also, the even data 2-1 (the 2nd, 6th, 10th, 14th, 18th, 22nd, 26th, 30th, 34th, 38th, 42nd, and 46th data) read out as quick signals from the line memory 151-2A of the slave IC 112-2 are, as shown in the rectangles at the third row, written in each of the pixels of the LCD panel 114 in order from the left. The even data 2-2 (the 4th, 8th, 12th, 16th, 20th, 24th, 28th, 32nd, 36th, 40th, 44th, and 48th data) read out as slow signals from the line memory 151-2B of the slave IC 112-2 are, as shown in the rectangles at the fourth row, written in each of the pixels of the LCD panel 114 in order from the left.

Figure 10:
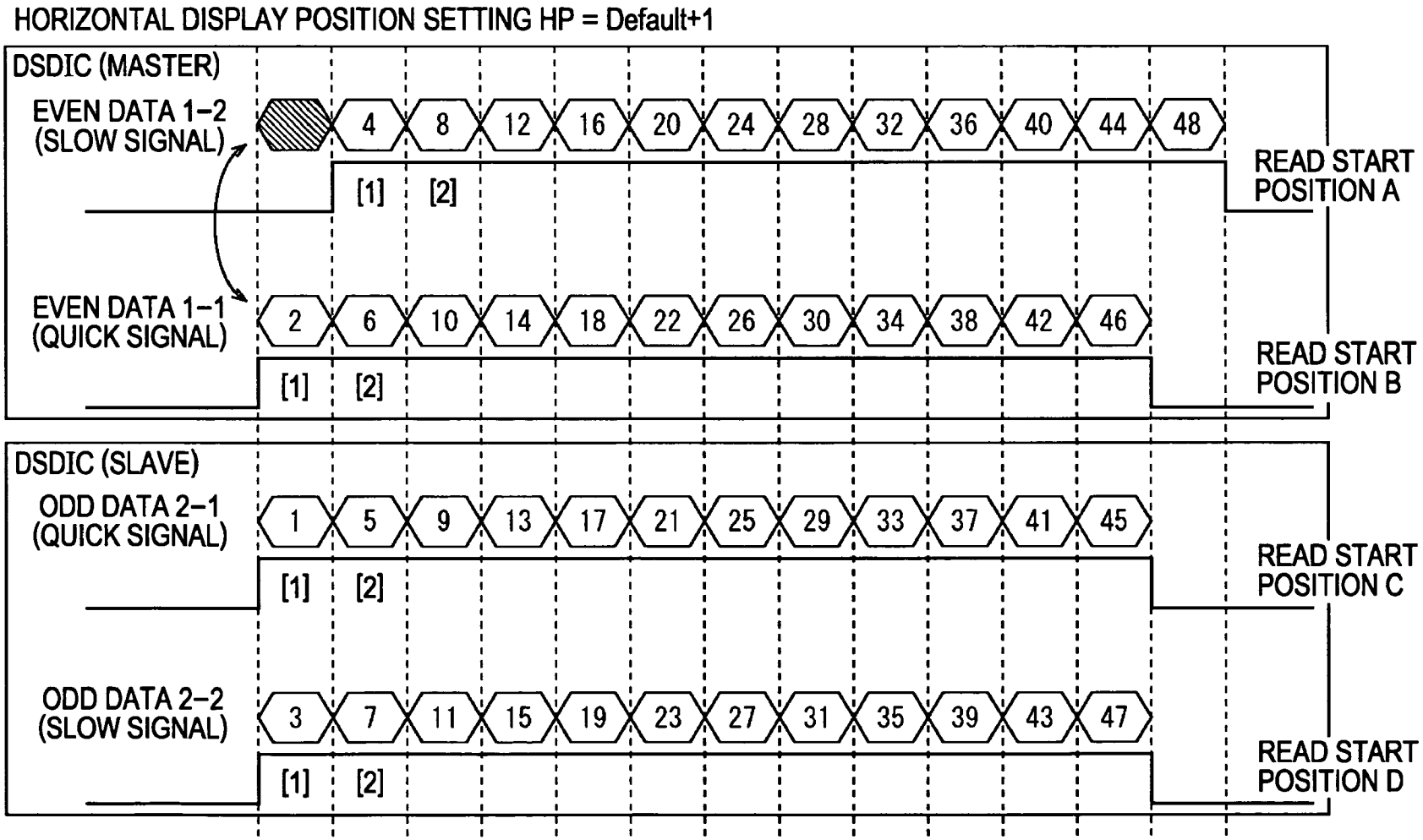
FIG. 10 is a diagram describing the read order and read start position of data in a case in which the horizontal display position setting HP is a default+1 when RGT=H.

FIG. 10 illustrates an example of data to be written in each of the pixels of the LCD panel 114, and the read start position of the data thereof in the case in which the horizontal display position setting HP is a default+1 which is shifted by one dot from the case in which the horizontal display position setting HP is a default in FIG. 9. Note that with the example in FIG. 10, the hatch appended to a rectangle represents that the data to be written in a pixel is data within an invalid picture period.

Upon the horizontal display position setting HP being changed from a default to a default+1 which is shifted by one dot from the case of a default, with the master IC 112-1, the selection of the data path switch 131-1 is changed from the odd data to the even data, and the even data selected by the data path switch 131-1 is written in the field memory 133-1. Also, with the slave IC 112-2, the selection of the data path switch 131-2 is changed from the even data to the odd data, and the odd data selected by the data path switch 131-2 is written in the field memory 133-2.

In the case in which the horizontal display position setting HP is a default+1, the memory control unit 132-1 of the master IC 112-1 reads out data from the field memory 133-1 at double speed, and of the readout data, writes even data 1-2 which is a signal having slow read order in time in the line memory 151-1A, and writes even data 1-1 which is a signal having quick read order in time in the line memory 151-1B.

Accordingly, in the case in which the horizontal display position setting HP is a default+1, the read start position control unit 138-1 interchanges the read order of data from the line memory 151-1A and the read order of data from the line memory 151-1B from the case in which the horizontal display position setting HP is a default, and performs control to read out the even data 1-2 which is a signal having slow read order in time from the line memory 151-1A, and to read out the even data 1-1 which is a signal having quick read order in time from the line memory 151-1B.

In the case in which the horizontal display position setting HP is a default+1, the memory control unit 132-2 of the slave IC 112-2 reads out data from the field memory 133-2 at double speed, and of the readout data, writes odd data 2-1 which is a signal having quick read order in time in the line memory 151-2A, and writes odd data 2-2 which is a signal having slow read order in time in the line memory 151-2B.

Accordingly, in the case in which the horizontal display position setting HP is a default+1, the read start position control unit 138-2 performs, as with the case in which the horizontal display position setting HP is a default, control to read out the odd data 2-1 which is a signal having quick read order in time from the line memory 151-2A, and to read out the odd data 2-2 which is a signal having slow read order in time from the line memory 151-2B.

Also, at this time, the read start position control unit 138-1 changes the read start position A to a position where the data is read out, which is one piece slower in time than the data in the case of a default in FIG. 9. That is to say, with the example in FIG. 10, the read start position A is changed to a position where the data (the 4th data within a valid picture period in the case of FIG. 10) to be written in the 2nd pixel from the left (the pixel in which the 5th data within a valid picture period has been written in the case of FIG. 9) is read out, which is one piece slower than the leftmost pixel at the first row where the 1st data within a valid picture period has been written in the case of a default in FIG. 9.

As with the case of a default in FIG. 9, under the control of the read start position control unit 138-1, the read start position B is set to a position where the data to be written in the leftmost pixel at the second row (the 2nd data within a valid picture period in the case of FIG. 10) is read out under the control of the read start position control unit 138-2. The read start position C is set to a position where the data to be written in the leftmost pixel at the third row (the 1st data within a valid picture period in the case of FIG. 10) is read out, and the read start position D is set to a position where the data to be written in the leftmost pixel at the fourth row (the 3rd data within a valid picture period in the case of FIG. 10) is read out.

Based on the above-mentioned control, the 1st, 2nd, 3rd, and 4th data equivalent to the four pixels of the processing unit of [1], the 5th, 6th, 7th, and 8th data equivalent to the four pixels of the processing unit of [2], and each piece of data equivalent to four pixels thereafter are read out from each of the line memory 151 in parallel with each of the read start positions A through D as a start position, and input to each of the pixels of the LCD panel 114 via the S/H driver 113.

According to the above-mentioned arrangement, in the case in which the horizontal display position setting HP is a default+1, the even data 1-2 (the 4th, 8th, 12th, 16th, 20th, 24th, 28th, 32nd, 36th, 40th, 44th, and 48th data) read out as slow signals from the line memory 151-1A of the master IC 112-1 are, as shown in the rectangles at the first row, written in each of the pixels of the LCD panel 114 in order from the left. The even data 1-1 (the 2nd, 6th, 10th, 14th, 18th, 22nd, 26th, 30th, 34th, 38th, 42nd, and 46th data within a valid picture period) read out as quick signals from the line memory 151-1B of the master IC 112-1 are, as shown in the rectangles at the second row, written in each of the pixels of the LCD panel 114 in order from the left.

The odd data 2-1 (the 1st, 5th, 9th, 13th, 17th, 21st, 25th, 29th, 33rd, 37th, 41st, and 45th data during a valid picture period) read out as quick signals from the line memory 151-2A of the slave IC 112-2 are, as shown in the rectangles at the third row, written in each of the pixels of the LCD panel 114 in order from the left. The odd data 2-2 (the 3rd, 7th, 11th, 15th, 19th, 23rd, 27th, 31st, 35th, 37th, 43rd, and 47th data within a valid picture period) read out as slow signals from the line memory 151-2B of the slave IC 112-2 are, as shown in the rectangles at the fourth row, written in each of the pixels of the LCD panel 114 in order from the left.

That is to say, with the example in FIG. 10, data within an invalid picture period is written in the pixel in which the 1st data has been written in the case of a default in FIG. 9 (the leftmost pixel at the first row), the 1st data is written in the pixel in which the 2nd data has been written (the leftmost pixel at the third row), the 2nd data is written in the pixel in which the 3rd data has been written (the leftmost pixel at the second row), the 3rd data is written in the pixel in which the 4th data has been written (the leftmost pixel at the fourth row), and the 4th data is written in the pixel in which the 5th data has been written (the 2nd pixel from the left end at the first row).

As described above, the data input to the master IC 112-1 and the data input to the slave IC 112-2 are interchanged, the read order of data from the line memory 151-1A and the read order of data from the line memory 151-1B are interchanged, and further the read start position A at the line memory 151-1A is changed, whereby the horizontal display positions can be shifted by one dot from the case of a default.

Figure 11:
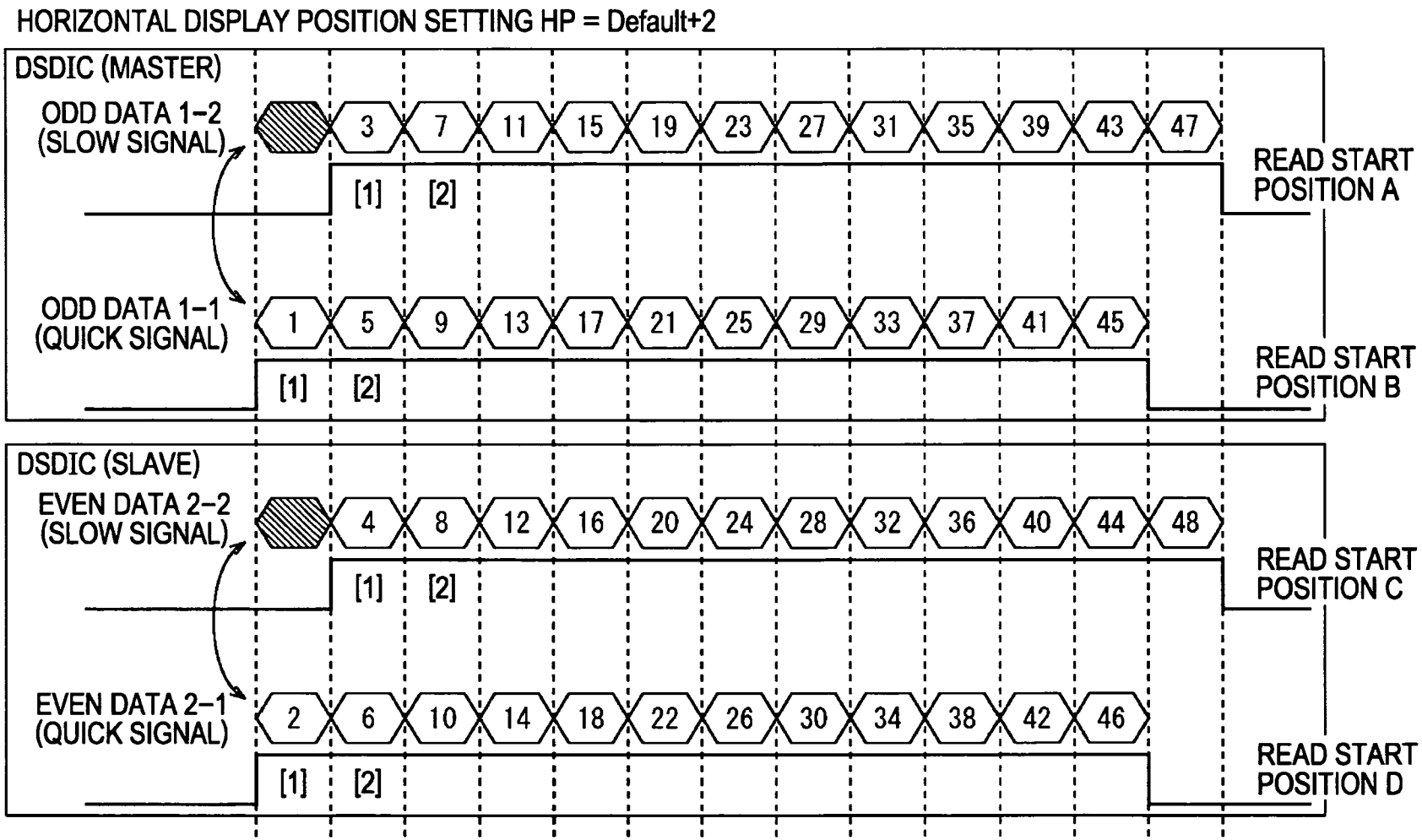
FIG. 11 is a diagram describing the read order and read start position of data in a case in which the horizontal display position setting HP is a default+2 when RGT=H.

FIG. 11 illustrates an example of data to be written in each of the pixels of the LCD panel 114, and the read start position of the data thereof in the case in which the horizontal display position setting HP is a default+2 which is shifted by two dots from the case in which the horizontal display position setting HP is a default in FIG. 9. Note that with the example in FIG. 11, the hatch appended to a rectangle represents that the data to be written in a pixel is data within an invalid picture period.

Upon the horizontal display position setting HP being changed from a default to a default+2 which is shifted by two dots from the case of a default, with the master IC 112-1, the odd data selected by the data path switch 131-1 is written in the field memory 133-1, as with the case in which the horizontal display position setting HP is a default. Also, with the slave IC 112-2, the even data selected by the data path switch 131-2 is written in the field memory 133-2, as with the case in which the horizontal display position setting HP is a default.

In the case in which the horizontal display position setting HP is a default+2, the memory control unit 132-1 of the master IC 112-1 reads out data from the field memory 133-1 at double speed, and of the readout data, writes odd data 1-2 which is a signal having slow read order in time in the line memory 151-1A, and writes odd data 1-1 which is a signal having quick read order in time in the line memory 151-1B.

Accordingly, in the case in which the horizontal display position setting HP is a default+2, the read start position control unit 138-1 interchanges the read order of data from the line memory 151-1A and the read order of data from the line memory 151-1B from the case in which the horizontal display position setting HP is a default, and performs control to read the odd data 1-2 which is a signal having slow read order in time from the line memory 151-1A, and to read the odd data 1-1 which is a signal having quick read order in time from the line memory 138-1B.

In the case in which the horizontal display position setting HP is a default+2, the memory control unit 132-2 of the slave IC 112-2 reads out data from the field memory 133-2 at double speed, and of the readout data, writes even data 2-2 which is a signal having slow read order in time in the line memory 151-2A, and writes even data 2-1 which is a signal having quick read order in time in the line memory 151-2B.

Accordingly, in the case in which the horizontal display position setting HP is a default+2, the read start position control unit 138-2 also interchanges the read order of data from the line memory 151-2A and the read order of data from the line memory 151-2B from the case in which the horizontal display position setting HP is a default, and performs control to read out the even data 2-2 which is a signal having slow read order in time from the line memory 151-2A, and to read out the even data 2-1 which is a signal having quick read order in time from the line memory 151-2B.

Also, at this time, the read start position control unit 138-1 changes the read start position A to a position where the data is read out, which is one piece slower in time than the data in the case of a default in FIG. 9, and the read start position control unit 138-2 changes the read start position C to a position where the data is read out, which is one piece slower in time than the data in the case of a default in FIG. 9.

That is to say, with the example in FIG. 11, the read start position A is changed to a position where the data (the 3rd data within a valid picture period in the case of FIG. 11) to be written in the 2nd pixel from the left (the pixel in which the 5th data within a valid picture period has been written in the case of FIG. 9) is read out, which is one piece slower than the leftmost pixel at the first row where the 1st data within a valid picture period has been written in the case of a default in FIG. 9. Also, the read start position C is changed to a position where the data (the 4th data within a valid picture period in the case of FIG. 11) to be written in the 2nd pixel from the left (the pixel in which the 6th data within a valid picture period has been written in the case of FIG. 9) is read out, which is one piece slower than the leftmost pixel at the third row where the 2nd data within a valid picture period has been written in the case of a default in FIG. 9.

As with the case of a default in FIG. 9, under the control of the read start position control unit 138-1, the read start position B is set to a position where the data to be written in the leftmost pixel at the second row (the 1st data within a valid picture period in the case of FIG. 11) is read out. Also, the read start position D is set to a position where the data to be written in the leftmost pixel at the fourth row (the 2nd data within a valid picture period in the case of FIG. 11) is read out.

Based on the above-mentioned control, the 1st, 2nd, 3rd, and 4th data equivalent to the four pixels of the processing unit of [1], the 5th, 6th, 7th, and 8th data equivalent to the four pixels of the processing unit of [2], and each piece of data equivalent to four pixels thereafter are read out from each of the line memory 151 in parallel with each of the read start positions A through D as a start position, and input to each of the pixels of the LCD panel 114 via the S/H driver 113.

According to the above-mentioned arrangement, in the case in which the horizontal display position setting HP is a default+2, the odd data 1-2 (the 3rd, 7th, 11th, 15th, 19th, 23rd, 27th, 31st, 35th, 39th, 43rd, and 47th data within a valid picture period) read out as slow signals from the line memory 151-1A of the master IC 112-1 are, as shown in the rectangles at the first row, written in each of the pixels of the LCD panel 114 in order from the left. The odd data 1-1 (the 1st, 5th, 9th, 13th, 17th, 21st, 25th, 29th, 33rd, 37th, 41st, and 45th data) read out as quick signals from the line memory 151-1B of the master IC 112-1 are, as shown in the rectangles at the second row, written in each of the pixels of the LCD panel 114 in order from the left.

The even data 2-2 (data within an invalid picture period, the 4th, 8th, 12th, 16th, 20th, 24th, 28th, 32nd, 36th, 40th, 44th, and 48th data during a valid picture period) read out as slow signals from the line memory 151-2A of the slave IC 112-2 are, as shown in the rectangles at the third row, written in each of the pixels of the LCD panel 114 in order from the left. The even data 2-1 (the 2nd, 6th, 10th, 14th, 18th, 22nd, 26th, 30th, 34th, 38th, 42nd, and 46th data) read out as slow signals from the line memory 151-2B of the slave IC 112-2 are, as shown in the rectangles at the fourth row, written in each of the pixels of the LCD panel 114 in order from the left.

That is to say, with the example in FIG. 11, data within an invalid picture period is written in the pixel in which the 1st data has been written (the leftmost pixel at the first row), and in the pixel in which the 2nd data has been written (the leftmost pixel at the third row) in the case of a default in FIG. 9, the 1st data is written in the pixel in which the 3rd data has been written (the leftmost pixel at the second row), the 2nd data is written in the pixel in which the 4th data has been written (the leftmost pixel at the fourth row), the 3rd data is written in the pixel in which the 5th data has been written (the 2nd pixel from the left end at the first row), and the 4th data is written in the pixel in which the 6th data has been written (the 2nd pixel from the left end at the third row).

As described above, the read order of data from the line memory 151-1A and the line memory 151-1B are interchanged with the read order of data from the line memory 151-2A and the line memory 151-2B, and further the read start position A at the line memory 151-1A and the read start position C at the line memory 151-2A are changed, whereby the horizontal display positions can be shifted by two dots from the case of a default.

Figure 12:
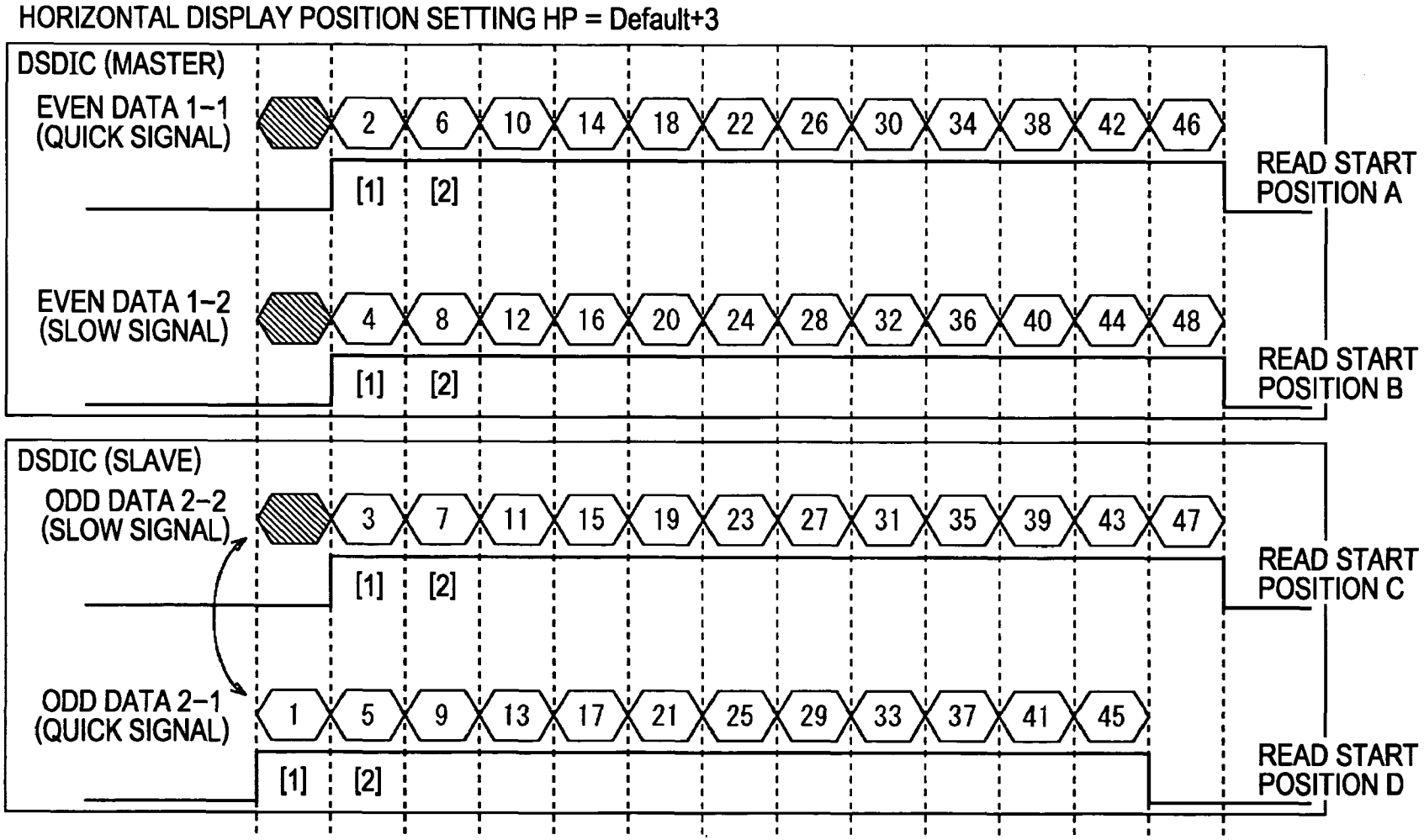
FIG. 12 is a diagram describing the read order and read start position of data in a case in which the horizontal display position setting HP is a default+3 when RGT=H.

FIG. 12 illustrates an example of data to be written in each of the pixels of the LCD panel 114, and the read start position of the data thereof in the case in which the horizontal display position setting HP is a default+3 which is shifted by three dots from the case in which the horizontal display position setting HP is a default in FIG. 9. Note that with the example in FIG. 12, the hatch appended to a rectangle represents that the data to be written in a pixel is data within an invalid picture period.

Upon the horizontal display position setting HP being changed from a default to a default+3 which is shifted by three dots from the case of a default, with the master IC 112-1, as with the case of a default+1 in FIG. 10, the selection of the data path switch 131-1 is changed from odd data to even data, and the selected even data is written in the field memory 133-1. Also, with the slave IC 112-2, the selection of the data path switch 131-2 is changed from odd data to even data, and the selected odd data is written in the field memory 133-2.

In the case in which the horizontal display position setting HP is a default+3, the memory control unit 132-1 of the master IC 112-1 reads out data from the field memory 133-1 at double speed, and of the readout data, writes even data 1-1 which is a signal having quick read order in time in the line memory 151-1A, and writes even data 1-2 which is a signal having slow read order in time in the line memory 151-1B.

Accordingly, in the case in which the horizontal display position setting HP is a default+3, the read start position control unit 138-1 performs, as with the case in which the horizontal display position setting HP is a default, control to read out the even data 1-1 which is a signal having quick read order in time from the line memory 151-1A, and to read out the even data 1-2 which is a signal having slow read order in time from the line memory 151-1B.

In the case in which the horizontal display position setting HP is a default+3, the memory control unit 132-2 of the slave IC 112-2 reads out data from the field memory 133-2 at double speed, and of the readout data, writes odd data 2-2 which is a signal having slow read order in time in the line memory 151-2A, and writes odd data 2-1 which is a signal having quick read order in time in the line memory 151-2B.

Accordingly, in the case in which the horizontal display position setting HP is a default+3, the read start position control unit 138-2 interchanges the read order of data from the line memory 151-2A and the read order of data from the line memory 151-2B from the case in which the horizontal display position setting HP is a default, and performs control to read out the odd data 2-2 which is a signal having slow read order in time from the line memory 151-2A, and to read out the odd data 2-1 which is a signal having quick read order in time from the line memory 151-2B.

Also, at this time, the read start position control unit 138-1 changes the read start positions A and B to a position where the data is read out, which is one piece slower in time than the data in the case of a default in FIG. 9, and the read start position control unit 138-2 changes the read start position C to a position where the data is read out, which is one piece slower in time than the data in the case of a default in FIG. 9.

That is to say, with the example in FIG. 12, the read start position A is changed to a position where the data (the 2nd data within a valid picture period in the case of FIG. 12) to be written in the 2nd pixel from the left (the pixel in which the 5th data within a valid picture period has been written in the case of FIG. 9) is read out, which is one piece slower than the leftmost pixel at the first row where the 1st data within a valid picture period has been written in the case of a default in FIG. 9. The read start position B is changed to a position where the data (the 4th data within a valid picture period in the case of FIG. 12) to be written in the 2nd pixel from the left (the pixel in which the 7th data within a valid picture period has been written in the case of FIG. 9) is read out, which is one piece slower than the leftmost pixel at the first row where the 3rd data within a valid picture period has been written in the case of a default in FIG. 9.

Also, the read start position C is changed to a position where the data (the 3rd data within a valid picture period in the case of FIG. 12) to be written in the 2nd pixel from the left (the pixel in which the 6th data within a valid picture period has been written in the case of FIG. 9) is read out, which is one piece slower than the leftmost pixel at the third row where the 2nd data within a valid picture period has been written in the case of a default in FIG. 9.

As with the case of a default in FIG. 9, under the control of the read start position control unit 138-2, the read start position D is set to a position where the data to be written in the leftmost pixel at the fourth row (the 1st data within a valid picture period in the case of FIG. 12) is read out.

Based on the above-mentioned control, the 1st, 2nd, 3rd, and 4th data equivalent to the four pixels of the processing unit of [1], the 5th, 6th, 7th, and 8th data equivalent to the four pixels of the processing unit of [2], and each piece of data equivalent to four pixels thereafter are read out from each of the line memory 151 in parallel with each of the read start positions A through D as a start position, and input to each of the pixels of the LCD panel 114 via the S/H driver 113.

According to the above-mentioned arrangement, in the case in which the horizontal display position setting HP is a default+3, the even data 1-1 (data within an invalid picture period, and the 2nd, 6th, 10th, 14th, 18th, 22nd, 26th, 30th, 34th, 38th, 42nd, and 46th data within a valid picture period) read out as quick signals from the line memory 151-1A of the master IC 112-1 are, as shown in the rectangles at the first row, written in each of the pixels of the LCD panel 114 in order from the left. The even data 1-2 (data within an invalid picture period, and the 4th, 8th, 12th, 16th, 20th, 24th, 28th, 32nd, 36th, 40th, 44th, and 48th data within a valid picture period) read out as slow signals from the line memory 151-1B of the master IC 112-1 are, as shown in the rectangles at the second row, written in each of the pixels of the LCD panel 114 in order from the left.

The odd data 2-2 (data within an invalid picture period, the 3rd, 7th, 11th, 15th, 19th, 23rd, 27th, 31st, 35th, 39th, 43rd, and 47th data during a valid picture period) read out as slow signals from the line memory 151-2A of the slave IC 112-2 are, as shown in the rectangles at the third row, written in each of the pixels of the LCD panel 114 in order from the left. The odd data 2-1 (the 1st, 5th, 9th, 13th, 17th, 21st, 25th, 29th, 33rd, 37th, 41st, and 45th data within valid picture period) read out as slow signals from the line memory 151-2B of the slave IC 112-2 are, as shown in the rectangles at the fourth row, written in each of the pixels of the LCD panel 114 in order from the left.

That is to say, with the example in FIG. 12, data within an invalid picture period is written in the pixel in which the 1st data has been written (the leftmost pixel at the first row), in the pixel in which the 2nd data has been written (the leftmost pixel at the third row), and in the pixel in which the 3rd data has been written (the leftmost pixel at the second row) in the case of a default in FIG. 9, the 1st data is written in the pixel in which the 4th data has been written (the leftmost pixel at the fourth row), the 2nd data is written in the pixel in which the 5th data has been written (the 2nd pixel from the left end at the first row), the 3rd data is written in the pixel in which the 6th data has been written (the 2nd pixel from the left end at the third row), and the 4th data is written in the pixel in which the 7th data has been written (the 2nd pixel from the left end at the second row).

As described above, the data to be input to the master IC 112-1 and the data to be input to the slave IC 112-2 are interchanged, the read order of data from the line memory 151-2A and the read order of data from the line memory 151-2B are interchanged, and further the read start position A at the line memory 151-1A, the read start position B at the line memory 151-1B, and the read start position C at the line memory 151-2A are changed, whereby the horizontal display positions can be shifted by three dots from the case of a default.

Figure 13:
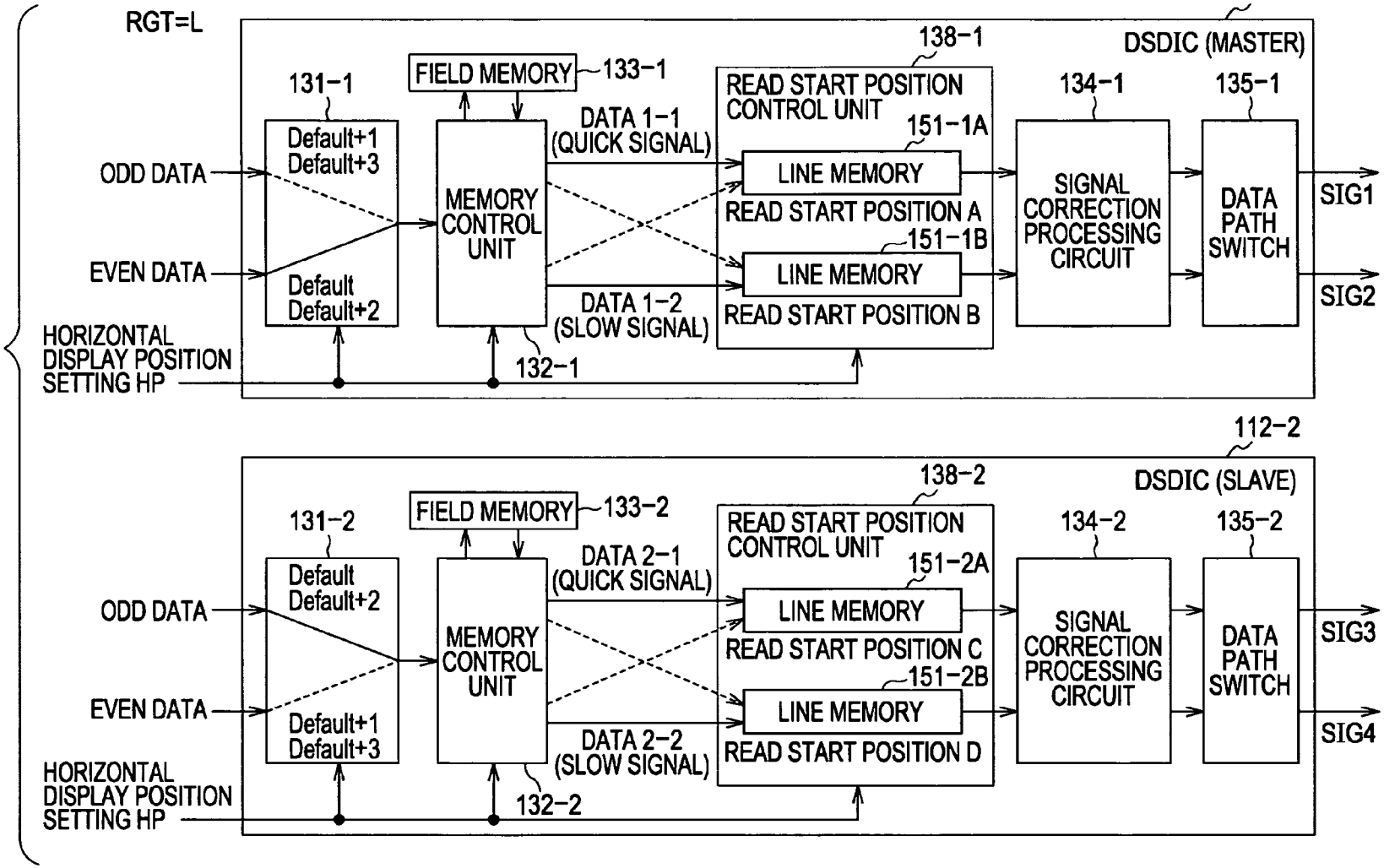
FIG. 13 is a diagram describing the operations of the master IC and the slave IC in the case of RGT=L.

FIG. 13 is a diagram describing the operations of the master IC 112-1 and slave IC 112-2 in the case of FIG. 7 (i.e., at the time of RGT=L). Note that with the example in FIG. 13, as with the case of FIG. 8, the read start position control unit 138-1 of the master IC 112-1 is configured so as to include the line memory 151-1A and 151-1B, and the read start position control unit 138-2 of the slave IC 112-2 is configured so as to include the line memory 151-2A and 151-2B.

In the case in which the horizontal display position setting HP is a default or a default+2, as shown by the solid lines, of the odd data and even data input from the scan converter 111, the data path switch 131-1 of the master IC 112-1 selects the even data. In the case in which the horizontal display position setting HP is a default+1 or a default+3, as shown by the dotted lines, of the odd data and even data input from the scan converter 111, the data path switch 131-1 selects the odd data.

In the case in which the horizontal display position setting HP is a default or a default+2, as shown by the solid lines, of the odd data and even data input from the scan converter 111, the data path switch 131-2 of the slave IC 112-2 selects the odd data. In the case in which the horizontal display position setting HP is a default+1 or a default+3, as shown by the dotted lines, of the odd data and even data input from the scan converter 111, the data path switch 131-2 selects the even data.

Thus, even in the case of reversing the mirror reversed setting RGT (i.e., in the case of RGT=L) from the case of RGT=H described in FIG. 8, in the case in which the horizontal display position setting HP in FIG. 8 is a default, when the odd data and even data are selected at the master IC 112-1 and slave IC 112-2 respectively, there is a need to change the selection of the odd data/even data at each of the master IC 112-1 and slave IC 112-2. Also, in the case of RGT=L as well, when shifting one dot from the case in which the horizontal display position setting HP is a default, each time one dot is shifted, there is a need to change the selection of the odd data/even data at each of the master IC 112-1 and slave IC 112-2.

The data selected by the data path switch 131-1 is input to the memory control unit 132-1 of the master IC 112-1. The memory control unit 132-1 of the master IC 112-1 writes the selected data equivalent to one field in the field memory 133-1, reads out this at double speed, and according to the horizontal display position setting HP, performs switching so as to write data 1-1 which is a signal having quick read order in time in one of the line memory 151-1A and 151-1B, and also performs switching so as to write data 1-2 which is a signal having slow read order in time in the other.

Subsequently, the read start position control unit 138-1 reads out the written data 1-1 and data 1-2 from the line memory 151-1A and line memory 151-1B, in read order corresponding to the horizontal display position setting HP, respectively. That is to say, with the read start position control unit 138-1, the read order from the line memory 151-1A and the read order from the line memory 151-1B are changed according to the horizontal display position setting HP.

Also, at this time, the read start position control unit 138-1 also changes a read start position A where the readout of data is started from the line memory 151-1A, and also changes a read start position B where the readout of data is started from the line memory 151-1B.

Subsequently, with the read start position control unit 138-1, the data 1-1 and data 1-2 are read out from the line memory 151-1A and line memory 151-1B in parallel based on the above-mentioned control. The readout data 1-1 and data 1-2 are subjected to predetermined correction processing at the signal correction processing circuit 134-1, and output to the S/H driver 113-1 by the data path switch 135-1 as signals SIG1 and SIG2.

The data selected by the data path switch 131-2 is input to the memory control unit 132-2 of the slave IC 112-2. The memory control unit 132-2 of the slave IC 112-2 writes the selected data equivalent to one field in the field memory 133-2, reads out this at double speed, and according to the horizontal display position setting HP, performs interchanging so as to write data 2-1 which is a signal having quick read order in time in one of the line memory 151-2A and 151-2B, and also performs interchanging so as to write data 2-2 which is a signal having slow read order in time in the other.

Subsequently, the read start position control unit 138-2 reads out the written data 2-1 and data 2-2 from the line memory 151-2A and line memory 151-2B, in read order corresponding to the horizontal display position setting HP, respectively. That is to say, with the read start position control unit 138-2, the read order from the line memory 151-2A and the read order from the line memory 151-2B are changed according to the horizontal display position setting HP.

Also, at this time, the read start position control unit 138-2 also changes a read start position C where the readout of data within a valid picture period is started from the line memory 151-2A, and also changes a read start position D where the readout of data within a valid picture period is started from the line memory 151-2B.

Subsequently, with the read start position control unit 138-2, the data 2-1 and data 2-2 are read out from the line memory 151-2A and line memory 151-2B in parallel based on the above-mentioned control. The readout data 2-1 and data 2-2 are subjected to predetermined correction processing at the signal correction processing circuit 134-2, and output to the S/H driver 113-2 by the data path switch 135-2 as signals SIG3 and SIG4.

Note that the control of the read order and read start position according to the horizontal display position setting HP at the time of RGT=L is basically the same as that at the time of RGT=H described above with reference to FIG. 9 through FIG. 12, so description thereof will be redundant, so will be omitted, but in the case of RGT=L, the data to be input to the master IC 112-1 and the data to be input to the slave IC 112-2 are interchanged, the read order of data from the line memory 151-2A and the read order of data from the line memory 151-2B are interchanged, and further the read start position C of data at the line memory 151-2A is changed, whereby the horizontal display positions can be shifted by one dot from the case of a default.

Also, in the case of RGT=L, the read order of data from the line memory 151-1A and the read order of data from the line memory 151-1B are interchanged, the read order of data from the line memory 151-2A and the read order of data from the line memory 151-2B are interchanged, and further the read start position B of data at the line memory 151-1B, and the read start position C of data at the line memory 151-1A are changed, whereby the horizontal display positions can be shifted by two dots from the case of a default.

Further, in the case of RGT=L, the data to be input to the master IC 112-1 and the data to be input to the slave IC 112-2 are interchanged, the read order of data from the line memory 151-1A and the read order of data from the line memory 151-1B are interchanged, and further the read start position B of data at the line memory 151-1B, the read start position C of data at the line memory 151-2A, and the read start position D of data at the line memory 151-2B are changed, whereby the horizontal display positions can be shifted by three dots from the case of a default.

As described above, an arrangement has been made wherein the data interchanging processing between the master IC 112-1 and the slave IC 112-2, and the read order and read start position change processing from the line memory 151-1 and 151-2 are controlled by the microcomputer 115, so even in the event of displaying an image on the LCD panel 114 by using the multiple S/H drivers 113 and the multiple DSDICs 112, the horizontal display positions at the LCD panel 114 can be shifted by one dot or two dots from the case of a default, and the like, and accordingly, settings in increments of single dots can be performed, and arbitrary data can be written in a specific pixel.

Also, an arrangement has been made wherein the adjustment of the horizontal display positions at the LCD panel 114 is performed by the readout control from each line memory 151, whereby correction processing in increments of single dots can be performed, even in the case of displaying an image on the LCD panel 114 by using multiple S/H drivers 113, and the multiple DSDICs 112.

That is to say, luminescent-spot correction, color unevenness correction, and so forth performed by the signal correction processing circuits 134-1 and 134-2 are functions for correcting a problem occurring at a specific pixel or specific place of the LCD panel 114. With an existing arrangement, correction is performed by adding adjustment equivalent to correction to a picture signal to be displayed on a specific pixel or specific place beforehand, and accordingly, display positions are adjusted by the driving timing pulse of an LCD panel, as shown in FIG. 14, the driving timing pulse and a correction point are not synchronized, and consequently, it is necessary to set a correction point again when moving display positions.

Figure 14:
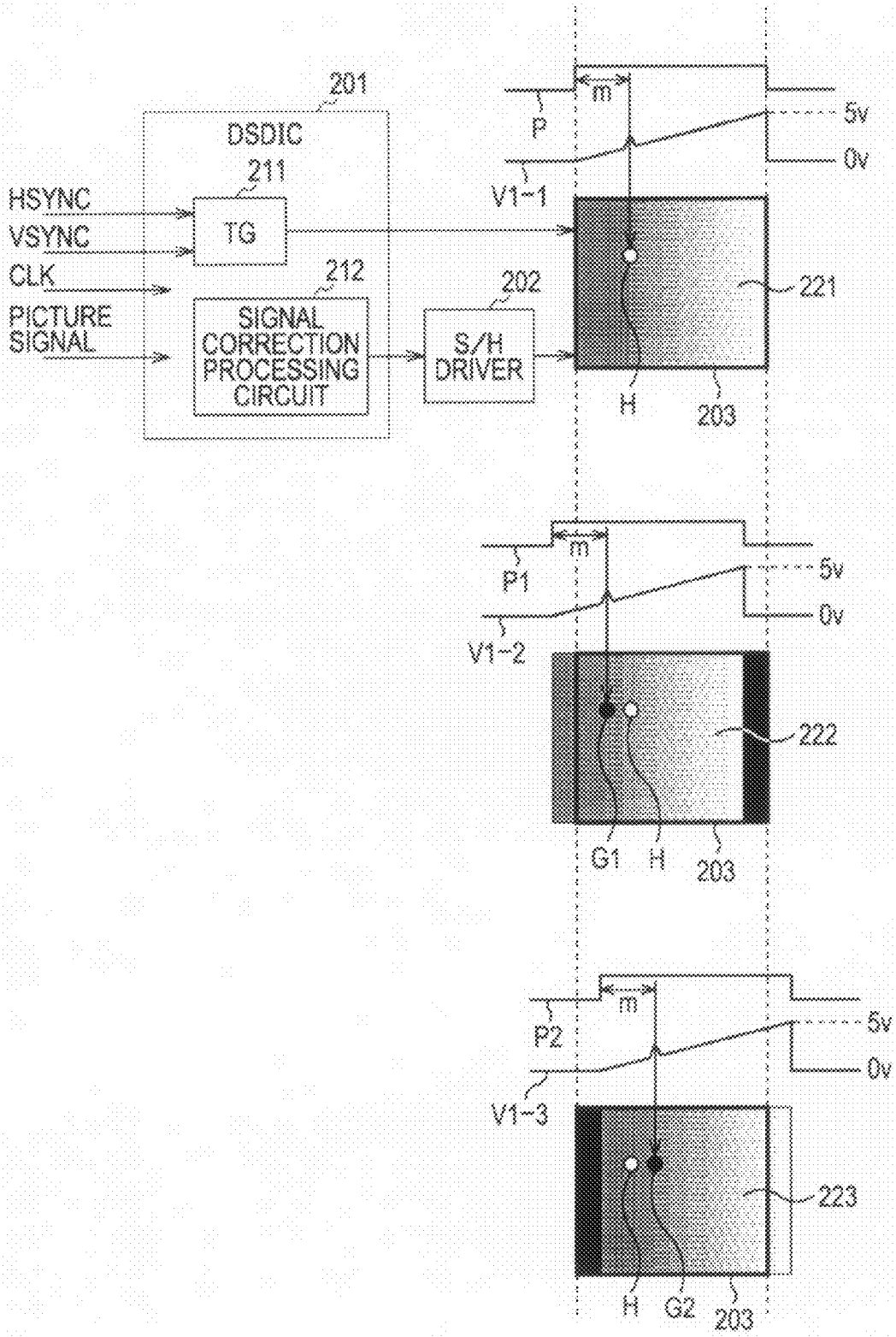
FIG. 14 is a diagram illustrating the relation between an existing driving timing pulse and a correction position in an existing LCD panel.

FIG. 14 is a diagram illustrating the relation between a driving timing pulse and a correction position at an LCD panel in the past. A picture signal, master clock CLK, the horizontal synchronizing signal HSYNC, and vertical signal VSYNC of the picture signal are input from an unshown scan converter to an existing digital signal driver (DSD) IC 201.

Note that with the example in FIG. 14, only a timing generator (TG) 211 and a signal correction processing circuit 212 are illustrated in the digital signal driver IC 201 for the sake of simplicity of description.

Also, three display regions 203 of the LCD panel are illustrated, and on the respective display regions 203, in order from the top in the drawing, a picture 221 to be displayed at the horizontal display position of a default, a picture 222 to be displayed at the horizontal display position which is changed in the left direction in the drawing as to the horizontal display position of a default by the adjustment of a driving timing pulse, and a picture 223 to be displayed at the horizontal display position which is changed in the right direction in the drawing as to the horizontal display position of a default by the adjustment of a driving timing pulse are displayed. These pictures 221 through 223 make up a gradation image from black to white from the left to the right in the drawing.

Further, on the upper portion of each of the display regions 203, driving timing pulses P, P1, and P2 of the LCD panel, and voltage V1-1, V1-2, and V1-3 of the LCD panel where the pictures 221 through 223 are displayed are illustrated.

The setting of the horizontal display positions, and the settings of the correction points of various types of correction (e.g., a correction point m of luminescent-spot correction) are stored in an unshown register of the digital signal driver IC 201. The correction point m is a value showing what pixel number a pixel to be corrected is from the leading edge of the driving timing pulse.

The timing generator 211 of the digital signal driver IC 201 generates the driving timing pulse P of the horizontal display position (before change of the horizontal display position) of a default based on the settings of the register, master clock CLK, horizontal synchronizing signal HSYNC, and vertical synchronizing signal VSYNC, and supplies the generated driving timing pulse P to the LCD panel.

The signal correction processing circuit 212 of the digital signal driver IC 201 subjects the picture signal at a correction position H of the display region 203 of the LCD panel to luminescent-spot correction based on the leading edge of the driving timing pulse P and the correction point m of the register. The picture signal after the correction is input to the LCD panel via the S/H driver 202. The LCD panel writes the picture signal of which the correction position H has been subjected to luminescent-spot correction based on the driving timing pulse P. Thus, with the display region 203 of the LCD panel, the picture 221 corresponding to the picture signal of which the correction position H has been subjected to luminescent-spot correction is displayed on the display position of a default.

At this time, the picture 221 is a gradation image from black to white from the left to the right in the drawing, so the voltage V1-1 of the LCD panel in the horizontal direction where the correction position H is positioned takes values which become smooth from the left to the right in the drawing, e.g., values which become a straight line from 0 V (ground) to 5 V, but only the voltage of the correction position H becomes a value deviated from the straight line thereof on the drawing. This is caused by the luminescent-spot correction of the picture signal of the correction position H, and thus, it can be found that the picture signal of the correction position H has been subjected to luminescent-spot correction.

Now, in the event that the setting of the horizontal display position of the register is changed in the left direction in the drawing as to the display region 203 according to the operation of the user, the timing generator 211 generates the driving timing pulse P1 of the horizontal display position changed in the left direction in the drawing in response to the setting of the register, and supplies the generated driving timing pulse P1 to the LCD panel.

Note however, in the past, a driving timing pulse and a correction point are not synchronized, so consequently, the signal correction processing circuit 212 subjects the picture signal of a position G1 of the display region 203 of the LCD panel to luminescent-spot correction based on the leading edge of the driving timing pulse P1 and the correction point m of the register.

The picture signal after the correction is input to the LCD panel via the S/H driver 202, so the LCD panel writes the picture signal of which the position G1 has been subjected to luminescent-spot correction based on the driving timing pulse P1. Thus, with the display region 203 of the LCD panel, the picture 222 corresponding to the picture signal of which the position G1 has been subjected to luminescent-spot correction is displayed at the horizontal display position changed in the left direction in the drawing as to the display region 203. Note that with the display region 203, a black picture corresponding to data other than a display picture period of the picture signal is displayed at the right side of the picture 222 in accordance with the change in the horizontal display position.

At this time, the picture 222 is a gradation image from black to white from the left to the right in the drawing, so the voltage V1-2 of the LCD panel in the horizontal direction where the correction position H is positioned takes values which become smooth from the left to the right in the drawing, e.g., values which become a straight line from 0 V (ground) to 5 V, but only the voltage of a position G1 becomes a value deviated from the straight line thereof on the drawing. This is caused by the luminescent-spot correction of the picture signal of the position G1, and thus, it can be found that the picture signal of the position G1 has been subjected to luminescent-spot correction.

Further, in the event that the setting of the horizontal display position of the register is changed in the right direction in the drawing as to the display region 203 according to the operation of the user, the timing generator 211 generates the driving timing pulse P2 of the horizontal display position changed in the right direction in the drawing in response to the setting of the register, and supplies the generated driving timing pulse P2 to the LCD panel.

As described above, in the past, the driving timing pulse and correction point are not synchronized, so consequently, the signal correction processing circuit 212 subjects the picture signal of the position G2 of the display region 203 of the LCD panel to luminescent-spot correction based on the leading edge of the driving timing pulse P2 and the correction point m of the register.

The picture signal after the correction is input to the LCD panel via the S/H driver 202, so the LCD panel writes the picture signal of which the position G2 has been subjected to luminescent-spot correction based on the driving timing pulse P2. Thus, with the display region 203 of the LCD panel, the picture 223 corresponding to the picture signal of which the position G2 has been subjected to luminescent-spot correction is displayed at the horizontal display position changed in the right direction in the drawing as to the display region 203. Note that with the display region 203, a black picture corresponding to data other than a display picture period of the picture signal is displayed at the left side of the picture 223 in accordance with the change in the horizontal display position.

At this time, the picture 223 is a gradation image from black to white from the left to the right in the drawing, so the voltage V1-3 of the LCD panel in the horizontal direction where the correction position H is positioned takes the value of 0 V equivalent to the deviation of the horizontal display position, and subsequently, takes values which become smooth from the left to the right in the drawing, e.g., values which become a straight line from 0 V (ground) to 5 V, but only the voltage of the position G2 becomes a value deviated from the straight line thereof on the drawing. This is caused by the luminescent-spot correction of the picture signal of the position G2, and thus, it can be found that the picture signal of the position G2 has been subjected to luminescent-spot correction.

As described above, in the past, the driving timing pulse and correction point are not synchronized, so consequently, upon the horizontal display position being moved with the driving timing pulse, the picture signal subjected to correction is accordingly moved, the pixel or place to be originally subjected to correction is not subjected to correction, and the pixel or place not to be subjected to correction is subjected to correction. Thus, in the event of moving the horizontal display position, there is a need to set a correction point again.

On the other hand, with the liquid crystal display system in FIG. 5, as described above, the read start position is controlled by the read start position control unit 138-1 or 138-2, whereby the horizontal display positions can be moved.

Figure 15:
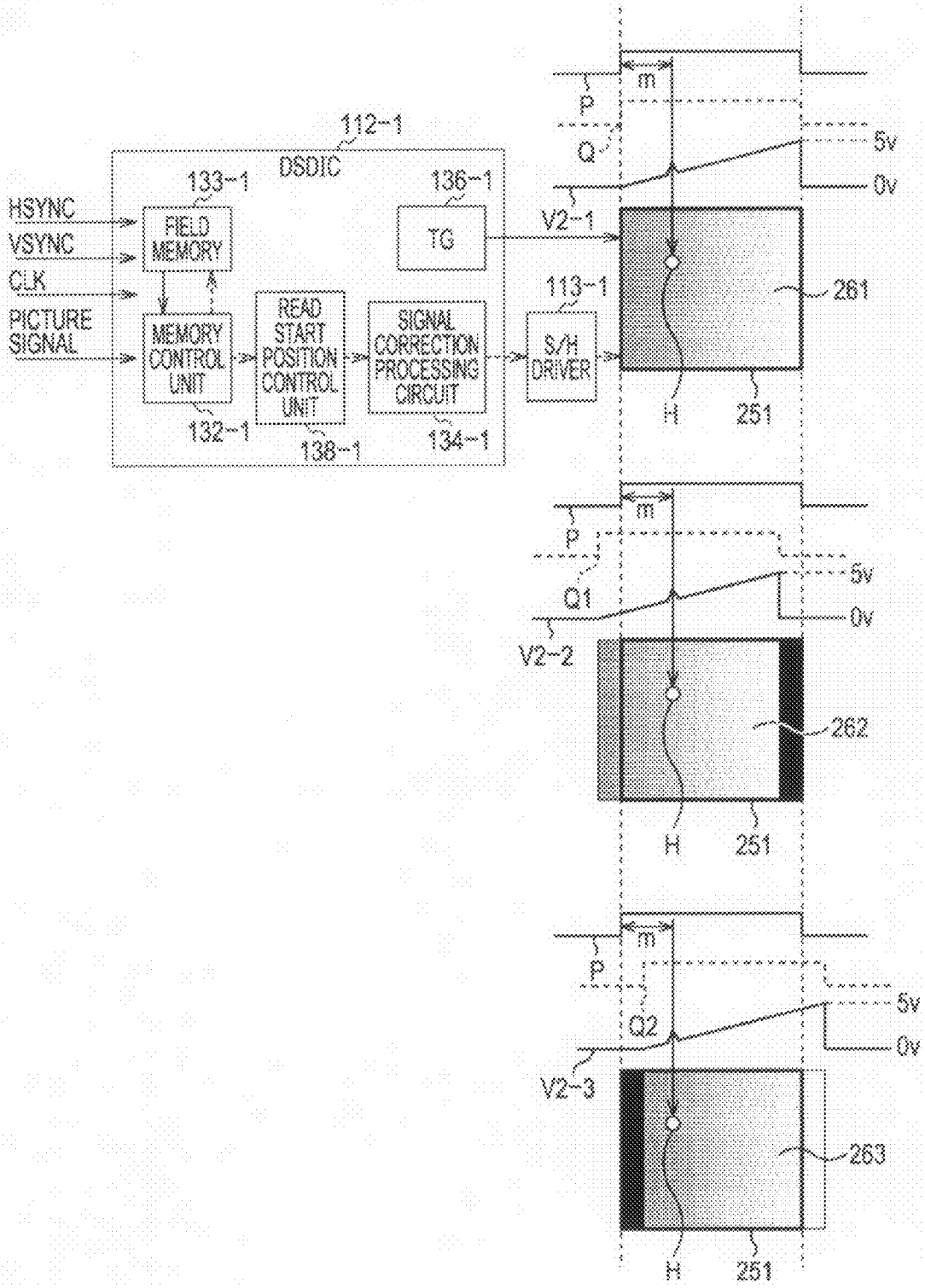
FIG. 15 is a diagram illustrating the relation between a driving timing pulse, a memory read start position, and a correction position in the LCD panel of the liquid crystal display system in FIG. 5.

FIG. 15 is a diagram illustrating the relation between the driving timing pulses, and memory read start positions of the liquid crystal display system in FIG. 5, and the correction positions of the LCD panel. Note that with the example in FIG. 15, for the sake of simplicity of description, only the digital signal driver IC 112-1 and S/H driver 113-1 are illustrated, and further, only the memory control unit 132-1, field memory 133-1, signal correction processing circuit 134-1, timing generator 136-1, and read start position control unit 138-1 are illustrated within the digital signal driver IC 112-1.

Also, three display regions 251 of the LCD panel 114 are illustrated, and on the respective display regions 251, in order from the top in the drawing, a picture 261 to be displayed at the horizontal display position of a default, a picture 262 to be displayed at the horizontal display position which is changed in the left direction in the drawing as to the horizontal display position of a default by the control of a memory read start position, and a picture 263 to be displayed at the horizontal display position which is changed in the right direction in the drawing as to the horizontal display position of a default by the control of a memory read start position are displayed. These pictures 261 through 263 make up a gradation image from black to white from the left to the right in the drawing.

Further, on the upper portion of each of the display regions 251, a driving timing pulse P of the LCD panel 114, memory read start positions Q, Q1, and Q2, and voltage V2-1, V2-2, and V2-3 of the LCD panel 114 where the pictures 261 through 263 are displayed are illustrated.

A picture signal, the master clock CLK, the horizontal synchronizing signal HSYNC and vertical synchronizing signal VSYNC of the picture signal are input to the digital signal driver IC 112-1 from the unshown scan converter. Also, as with the case in the past, the setting of the horizontal display positions, and the settings of the correction points of various types of correction (e.g., a correction point m of luminescent-spot correction) are stored in the register 137-1 (FIG. 5) of the digital signal driver IC 112-1. The correction point m is a value showing what pixel number a pixel to be corrected is from the leading edge of the driving timing pulse.

The timing generator 136-1 generates the driving timing pulse P based on the master clock CLK, horizontal synchronizing signal HSYNC, and vertical synchronizing signal VSYNC, and supplies the generated driving timing pulse P to the LCD panel 114.

The memory control unit 132-1 writes the data of a picture signal in the field memory 133-1, and also reads out the data written in the field memory twice to output the picture signals to the read start position control unit 138-1.

The read start position control unit 138-1 sets, for example, the start data position of a valid picture period as the memory read start position Q which is a default such that the valid picture period of a picture signal (i.e., picture 261) is display on the display region 251 based on the setting of the horizontal display position of a default of the register 137-1. Subsequently, the read start position control unit 138-1 writes the data of the picture signal in the built-in line memory 151-1A and 151-1B, and also reads out the data written in the line memory 151-1A and 151-1B based on the memory read start position Q of a default to output the picture signal to the signal correction processing unit 134-1.

The signal correction processing circuit 134-1 subjects the picture signal of a correction position H of the display region 251 of the LCD panel 114 to luminescent-spot correction based on the driving pulse P and the correction point m of the register. The picture signal after the correction is input to the LCD panel 114 via the S/H driver 113-1. The LCD panel 114 writes the picture signal of which the correction position H has been subjected to luminescent-spot correction based on the driving timing pulse P. Thus, with the display region 251 of the LCD panel 114, the picture 261 corresponding to the picture signal of which the correction position H has been subjected to luminescent-spot correction is displayed at the horizontal display position of a default.

At this time, the picture 261 is a gradation image from black to white from the left to the right in the drawing, so the voltage V2-1 of the LCD panel 114 in the horizontal direction where the correction position H is positioned takes values which become smooth from the left to the right in the drawing, e.g., values which become a straight line from 0 V (ground) to 5 V, but only the voltage of the correction position H becomes a value deviated from the straight line thereof on the drawing. This is caused by the luminescent-spot correction of the picture signal of the correction position H, and thus, it can be found that the picture signal of the correction position H has been subjected to luminescent-spot correction.

Now, in the event that the setting of the horizontal display positions of the register 137-1 is changed in the left direction in the drawing as to the display region 251 according to the operation of the user, the read start position control unit 138-1 sets, for example, a data position which is quicker than a valid picture period in time as the memory read start position Q1, such that the valid picture period of the picture signal (i.e., picture 262) is shifted at the left side in the drawing as to the display region 251 based on the setting of the changed horizontal display position of the register 137-1. Subsequently, the read start position control unit 138-1 writes the data of the picture signal in the built-in line memory 151-1A and 151-1B, and also reads out the data written in the line memory 151-1A and 151-1B based on the memory read start position Q1 to output the picture signal to the signal correction processing unit 134-1.

Note that at this time, the timing generator 136-1 generates the driving timing pulse P based on the master clock CLK, horizontal synchronizing signal HSYNC, and vertical synchronizing signal VSYNC, and supplies the generated driving timing pulse P to the LCD panel 114.

The signal correction processing circuit 134-1 subjects the picture signal of a correction position H of the display region 251 of the LCD panel 114 to luminescent-spot correction based on the driving pulse P and the correction point m of the register. The picture signal after the correction is input to the LCD panel 114 via the S/H driver 113-1.

The LCD panel 114 writes the picture signal of which the correction position H has been subjected to luminescent-spot correction based on the driving timing pulse P. Thus, with the display region 251 of the LCD panel 114, the picture 262 corresponding to the picture signal of which the correction position H has been subjected to luminescent-spot correction is displayed at the horizontal display position changed in the left direction in the drawing as to the display region 251. Note that with the display region 251, a black picture corresponding to data within an invalid picture period of a picture signal according to the change in the horizontal display position is also displayed at the right side of the picture 262.

At this time, the picture 262 is a gradation image from black to white from the left to the right in the drawing, so the voltage V2-2 of the LCD panel 114 in the horizontal direction where the correction position H is positioned takes values which become smooth from the left to the right in the drawing, e.g., values which become a straight line from 0 V (ground) to 5 V, and takes the values of 0 V equivalent to the deviation of the display position, but only the voltage of the correction position H becomes a value deviated from the straight line thereof on the drawing. This is caused by the luminescent-spot correction of the picture signal of the correction position H, and thus, it can be found that the picture signal of the correction position H has been subjected to luminescent-spot correction.

Further, in the event that the setting of the horizontal display position of the register 137-1 is changed in the left direction in the drawing as to the display region 251 according to the operation of the user, the read start position control unit 138-1 sets, for example, a data position which is slower than a valid picture period in time as the memory read start position Q2, such that the valid picture period of the picture signal (i.e., picture 263) is shifted at the right side in the drawing as to the display region 251 based on the setting of the changed horizontal display position of the register 137-1. Subsequently, the read start position control unit 138-1 writes the data of the picture signal in the built-in line memory 151-1A and 151-1B, and also reads out the data written in the line memory 151-1A and 151-1B based on the memory read start position Q2 to output the picture signal to the signal correction processing unit 134-1.

Note that at this time, the timing generator 136-1 generates the driving timing pulse P based on the master clock CLK, horizontal synchronizing signal HSYNC, and vertical synchronizing signal VSYNC, and supplies the generated driving timing pulse P to the LCD panel 114.

Accordingly, the signal correction processing circuit 134-1 subjects the picture signal of a correction position H of the display region 251 of the LCD panel 114 to luminescent-spot correction based on the driving pulse P and the correction point m of the register. The picture signal after the correction is input to the LCD panel 114 via the S/H driver 113-1.

The LCD panel 114 writes the picture signal of which the correction position H has been subjected to luminescent-spot correction based on the driving timing pulse P. Thus, with the display region 251 of the LCD panel 114, the picture 263 corresponding to the picture signal of which the correction position H has been subjected to luminescent-spot correction is displayed at the horizontal display position changed in the right direction in the drawing as to the display region 251.

Note that with the display region 251, a black picture corresponding to data within an invalid picture period of a picture signal according to the change in the horizontal display position is also displayed at the left side of the picture 263.

At this time, the picture 263 is a gradation image from black to white from the left to the right in the drawing, so the voltage V2-3 of the LCD panel 114 in the horizontal direction where the correction position H is positioned takes the values of 0 V equivalent to the deviation of the display position, and subsequently, takes values which become smooth from the left to the right in the drawing, e.g., values which become a straight line from 0 V (ground) to 5 V, but only the voltage of the correction position H becomes a value deviated from the straight line thereof on the drawing. This is caused by the luminescent-spot correction of the picture signal of the correction position H, and thus, it can be found that the picture signal of the correction position H has been subjected to luminescent-spot correction.

As described above, with the liquid crystal display system in FIG. 5, an arrangement has been made wherein the horizontal display positions are adjusted by controlling the read start position of the line memory 151 of the read start position control unit 138, so there is no need to move the driving timing pulse of the display panel 114, and accordingly, even changing the horizontal display positions prevents the position to be subjected to luminescent-spot correction from changing. Thus, the adjustment of a correction position, such as luminescent-spot correction, and color unevenness correction, can be readily performed.

Note that even in the case of changing the horizontal display positions by using a driving timing pulse, this case can be handled by the correction point being synchronized with the driving timing pulse.

Figure 16:
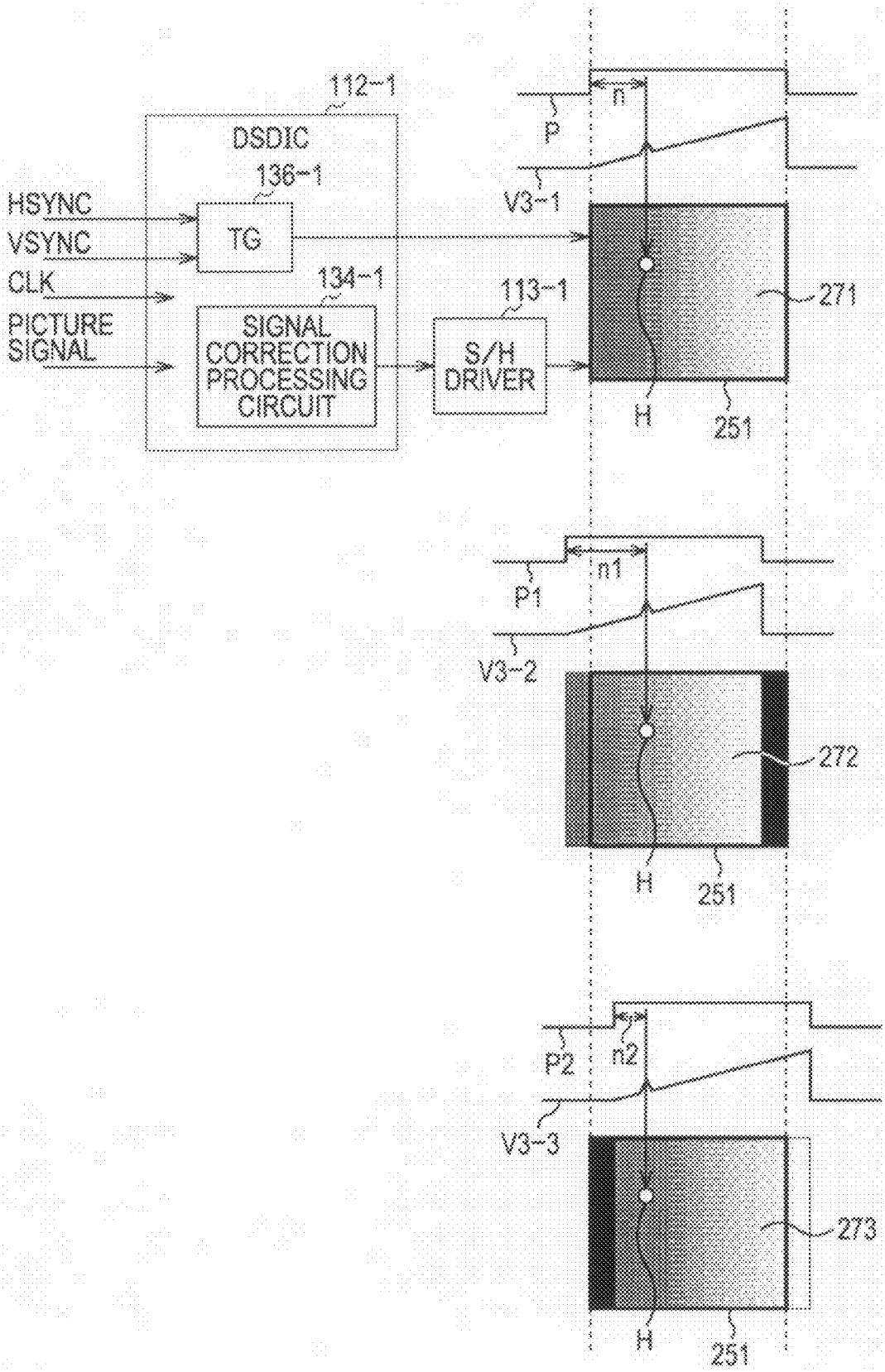
FIG. 16 is a diagram illustrating the relation between the driving timing pulse and the correction position in the LCD panel in the case of synchronizing a correction point with a driving timing pulse.

FIG. 16 is a diagram illustrating the relation between driving timing pulses, and the correction positions of the LCD panel in the case of changing the horizontal display positions by using a driving timing pulse.

Note that with the example in FIG. 16, for the sake of simplicity of description, only the digital signal driver IC 112-1 and S/H driver 113-1 are illustrated, and further, only the signal correction processing circuit 134-1, and timing generator 136-1 are illustrated within the digital signal driver IC 112-1.

Also, three display regions 251 of the LCD panel 114 are illustrated, and on the respective display regions 251, in order from the top in the drawing, a picture 271 to be displayed at the default horizontal display position, a picture 272 to be displayed at the horizontal display position which is changed in the left direction in the drawing as to the horizontal display position of a default by the adjustment of a driving timing pulse, and a picture 273 to be displayed at the horizontal display position which is changed in the right direction in the drawing as to the horizontal display position of a default by the adjustment of a driving timing pulse are displayed. These pictures 271 through 273 make up a gradation image from black to white from the left to the right in the drawing.

Further, on the upper portion of each of the display regions 251, driving timing pulses P, P1, and P2 of the LCD panel 114, and voltage V3-1, V3-2, and V3-3 of the LCD panel 114 where the pictures 271 through 273 are displayed are illustrated.

A picture signal, the master clock CLK, the horizontal synchronizing signal HSYNC and vertical synchronizing signal VSYNC of the picture signal are input to the digital signal driver IC 112-1 from the unshown scan converter. Also, as with the case in the past, the setting of the horizontal display positions, and the settings of the correction points of various types of correction (e.g., a correction point n of luminescent-spot correction) are stored in the register 137-1 (FIG. 5) of the digital signal driver IC 112-1. The correction point n is a value showing what pixel number a pixel to be corrected is from the leading edge of the driving timing pulse, which is changed by being synchronized with a driving timing pulse.

The timing generator 136-1 generates the driving timing pulse P based on the settings of the register 137-1, the master clock CLK, horizontal synchronizing signal HSYNC, and vertical synchronizing signal VSYNC, and supplies the generated driving timing pulse P to the LCD panel 114.

The signal correction processing circuit 134-1 subjects the picture signal of a correction position H of the display region 251 of the LCD panel 114 to luminescent-spot correction based on the leading edge of the driving pulse P and the correction point n of the register. The picture signal after the correction is input to the LCD panel 114 via the S/H driver 113-1. The LCD panel 114 writes the picture signal of which the correction position H has been subjected to luminescent-spot correction based on the driving timing pulse P. Thus, with the display region 251 of the LCD panel 114, the picture 271 corresponding to the picture signal of which the correction position H has been subjected to luminescent-spot correction is displayed at the horizontal display position of a default.

At this time, the picture 271 is a gradation image from black to white from the left to the right in the drawing, so the voltage V3-1 of the LCD panel 114 in the horizontal direction where the correction position H is positioned takes values which become smooth from the left to the right in the drawing, e.g., values which become a straight line from 0 V (ground) to 5 V, but only the voltage of the correction position H becomes a value deviated from the straight line thereof on the drawing. This is caused by the luminescent-spot correction of the picture signal of the correction position H, and thus, it can be found that the picture signal of the correction position H has been subjected to luminescent-spot correction.

Now, in the event that the setting of the horizontal display position of the register 137-1 is changed in the left direction in the drawing as to the display region 251 according to the operation of the user, the timing generator 136-1 generates the driving timing pulse P1 of the horizontal display position changed in the left direction in the drawing in response to the setting of the register 137-1, and supplies the generated driving timing pulse P1 to the LCD panel 114. Note that at this time, the setting of a correction point at the register 137-1 is also changed, for example, to a correction point n1 in sync with the change in the driving pulse P1.

The signal correction processing circuit 212 subjects the picture signal of a correction position H of the display region 251 of the LCD panel 114 to luminescent-spot correction based on the leading edge of the driving pulse P1 and the changed correction point n1 of the register 137-1. The picture signal after the correction is input to the LCD panel 114 via the S/H driver 113-1.

The LCD panel 114 writes the picture signal of which the correction position H has been subjected to luminescent-spot correction based on the driving timing pulse P1. Thus, with the display region 251 of the LCD panel 114, the picture 272 corresponding to the picture signal of which the correction position H has been subjected to luminescent-spot correction is displayed at the horizontal display position changed in the left direction in the drawing as to the display region 251. Note that with the display region 251, a black picture corresponding to data within an invalid picture period of a picture signal according to the change in the horizontal display position is also displayed at the right side of the picture 272.

At this time, the picture 272 is a gradation image from black to white from the left to the right in the drawing, so the voltage V3-2 of the LCD panel 114 in the horizontal direction where the correction position H is positioned takes values which become smooth from the left to the right in the drawing, e.g., values which become a straight line from 0 V (ground) to 5 V, and takes the values of 0 V equivalent to the deviation of the display position, but only the voltage of the correction position H becomes a value deviated from the straight line thereof on the drawing. This is caused by the luminescent-spot correction of the picture signal of the correction position H, and thus, it can be found that the picture signal of the correction position H has been subjected to luminescent-spot correction.

Further, in the event that the setting of the horizontal display position of the register 137-1 is changed in the right direction in the drawing as to the display region 251 according to the operation of the user, the timing generator 136-1 generates the driving timing pulse P2 of the horizontal display position changed in the right direction in the drawing in response to the setting of the register 137-1, and supplies the generated driving timing pulse P2 to the LCD panel 114. Note that at this time, the setting of a correction point at the register 137-1 is also changed, for example, to a correction point n2 in sync with the change in the driving pulse P2.

The signal correction processing circuit 212 subjects the picture signal of a correction position H of the display region 251 of the LCD panel 114 to luminescent-spot correction based on the leading edge of the driving pulse P2 and the changed correction point n2 of the register 137-1. The picture signal after the correction is input to the LCD panel 114 via the S/H driver 113-1.

The LCD panel 114 writes the picture signal of which the correction position H has been subjected to luminescent-spot correction based on the driving timing pulse P2. Thus, with the display region 251 of the LCD panel 114, the picture 273 corresponding to the picture signal of which the correction position H has been subjected to luminescent-spot correction is displayed at the horizontal display position changed in the right direction in the drawing as to the display region 251. Note that with the display region 251, a black picture corresponding to data within an invalid picture period of a picture signal according to the change in the horizontal display position is also displayed at the left side of the picture 273.

At this time; the picture 273 is a gradation image from black to white from the left to the right in the drawing, so the voltage V3-3 of the LCD panel 114 in the horizontal direction where the correction position H is positioned takes the values of 0 V equivalent to the deviation of the display position, and subsequently, takes values which become smooth from the left to the right in the drawing, e.g., values which become a straight line from 0 V (ground) to 5 V, but only the voltage of the correction position H becomes a value deviated from the straight line thereof on the drawing. This is caused by the luminescent-spot correction of the picture signal of the correction position H, and thus, it can be found that the picture signal of the correction position H has been subjected to luminescent-spot correction.

As described above, even in the event of changing the horizontal display position by using a driving timing pulse, even changing the horizontal display position by synchronizing a correction point with the driving timing pulse prevents the position to be subjected to luminescent-spot correction from changing. Thus, the adjustment of a correction position, such as luminescent-spot correction, and color unevenness correction, can be readily performed.

Note that with above description has been made regarding the case in the horizontal direction, but even in the vertical direction, the read start position control which the read start position control unit 138 has performed upon the line memory 151 in the case of the horizontal direction is also performed by the memory control unit 132 upon the field memory 133 in the same way, whereby the adjustment of a correction position, such as luminescent-spot correction, and color unevenness correction, can be realized.

Next, description will be made regarding signal processing for displaying a picture signal on the LCD panel 114 by the liquid crystal display system in FIG. 5 with reference to the flowchart in FIG. 17.

In step S11, the microcomputer 115 performs various types of settings of the liquid crystal display system (e.g., mirror reversed setting RGT, master/slave setting, and horizontal display position setting HP), writes the value corresponding to each of the various types of settings in the register 137-1 embedded in the master IC 112-1, and the register 137-2 embedded in the slave IC 112-2, and sets the values of the registers 137-1 and 137-2.

In step S13 and thereafter, processing is performed in parallel by each of the master IC 112-1 and slave IC 112-2 based on the values of the registers 137-1 and 137-2.

An analog picture signal is serially input to the scan converter 111 from an unshown outside (e.g., personal computer). In step S12, the scan converter 111 subjects an input signal (analog picture signal) to A/D conversion, number-of-pixel conversion, number-of-line conversion, frequency conversion, or the like, and outputs the converted picture signal to both of the master IC 112-1 and the slave IC 112-2 in parallel.

That is to say, both (two systems of data) of the odd data (odd data) of a picture signal and the even data (even data) of a picture signal are input to both of the data path switch 131-1 of the master IC 112-1, and the data patch switch 131-2 of the slave IC 112-2, respectively. Also, the master clock CLK, the horizontal synchronizing signal HSYNC and vertical synchronizing signal VSYNC of a picture signal are supplied from the scan converter 111 to the master IC 112-1 and slave IC 112-2.

In step S13, the data path switch 131-1 and data path switch 131-2 select the odd data or even data based on the registers 137-1 and 137-2, respectively.

For example, in the event that the mirror reversed setting RGT=H, master/slave setting (digital signal driver IC 112-1=master), and horizontal display position setting HP=default+1 are stored in the registers 137-1 and 137-2, the data path switch 131-1 selects the even data, and outputs the selected data to memory control unit 132-1 based on the timing pulse from the timing generator 136-1. On the other hand, the data path switch 131-2 selects the odd data, and outputs the selected data to memory control unit 132-2 based on the timing pulse from the timing generator 136-2.

In step S14, the memory control units 132-1 and 132-2 write data equivalent to one field within one vertical period based on the timing pulse from the timing generators 136-1 and 136-2, and also read out the data at double speed from the field memory 133-1 and 133-2, and write each piece of the data to the line memory 151-1 and 151-2 based on the values of the registers 137-1 and 137-2, respectively.

In step S15, the read start position control unit 138-1 reads out each piece of the data from the line memory 151-1 and 151-2 in the read order and at the read start position based on the values of the registers 137-1 and 137-2, and outputs each piece of the data to the signal correction processing circuits 134-1 and 134-2.

Specifically, in the event that the mirror reversed setting RGT=H, master/slave setting (digital signal driver IC 112-1=master), and horizontal display position setting HP=default+1 are stored in the registers 137-1 and 137-2, as described above with reference to FIG. 8 through FIG. 10, the memory control unit 132-1 writes even data 1-2 which is slow data in time in the line memory 151-1A, and writes even data 1-1 which is quick data in time in the line memory 151-1B.

Subsequently, the read start position control unit 138-1 performs control so as to read out the even data 1-2 which is slow data in time (data within an invalid picture period, the 4th, 8th, 12th, 16th, and 20th data) from the read start position A of the line memory 151-1A changed to a position where data is read out, which is one piece slower data in time than the case of the horizontal display position setting HP=default, and so as to read out the even data 1-1 which is quick data in time (the 2nd, 6th, 10th, 14th, and 18th data) from the same read start position B of the line memory 151-1B as the case of the horizontal display position setting HP=default.

That is to say, in the event that the horizontal display position HP is a default+1, the read start position control unit 138-1 interchanges the read order of data from the case in which the horizontal display position setting HP in FIG. 9 is a default, and further changes the read start position A of the line memory 151-1A to a position where one piece slower data in time is read, and reads out the even data 1-2 and 1-1 from the line memory 151-1A and 151-1B, respectively.

On the other hand, the memory control unit 132-2 writes the odd data 2-1 which is quick data in time in the line memory 151-2A, and writes the odd data 2-2 which is slow data in time in the line memory 151-2B.

Subsequently, the read start position control unit 138-2 performs control so as to read out the odd data 2-1 which is quick data in time (the 1st, 5th, 9th, 13th, and 17th data) from the same read start position C of the line memory 151-2A as the case of the horizontal display position setting HP=default, and so as to read out the odd data 2-2 which is slow data in time (the 3rd, 7th, 11th, 15th, and 19th data) from the same read start position D of the line memory 151-2B as the case of the horizontal display position setting HP=default.

That is to say, in the event that the horizontal display position HP is default+1, the read start position control unit 138-2 reads out the odd data 2-1 and 2-2 from the line memory 151-2A and 151-2B respectively without changing the read order of data, and each of the read start positions of data from the case in which the horizontal display position setting HP in FIG. 9 is a default.

Note that with the above-mentioned double speeding up processing in step S14, the timing generators 136-1 and 136-2 supplies a timing pulse based on the vertical synchronizing signal after the double speeding up (hereafter, also referred to as a double speed vertical synchronizing signal) to be generated based on the vertical synchronizing signal from the scan converter 111 (hereafter, also referred to as an input vertical synchronizing signal) to the memory control units 132-1 and 132-2.

Now, description will be made regarding the double speeding up processing of a vertical synchronizing signal. With driving of a general active-matrix type liquid crystal device such as the LCD panel 114, in order to prevent the deterioration of liquid crystal, and burn-in on an orientation film from occurring, alternating-current driving is performed of alternating-current driving methods for liquid crystal panel, in the event of performing driving using a field reversal driving method for reversing the polarity of a picture signal input to a panel for each field unit, in order to prevent flicker, there is a need to perform driving with a frame rate of at least 90 Hz or more. Accordingly, in the event that the frame rate of a picture signal to be input to the digital signal driver IC 112 is slower than that, the picture signal is subjected to double speed conversion within the digital signal driver IC 112, and output to the LCD panel 114.

At this time, in order to prevent DC components from applying to the LCD panel 114, there is a need to generate a double speed vertical synchronizing signal such that two frame periods to be generated by double speed become the same. Note however, in the past, the generation position of a double speed vertical synchronizing signal is retained in the register 301 of the digital signal driver IC, and a double speed vertical synchronizing signal has been able to be generated such that two frame periods become constant only regarding a specific frame rate.

Figure 18:
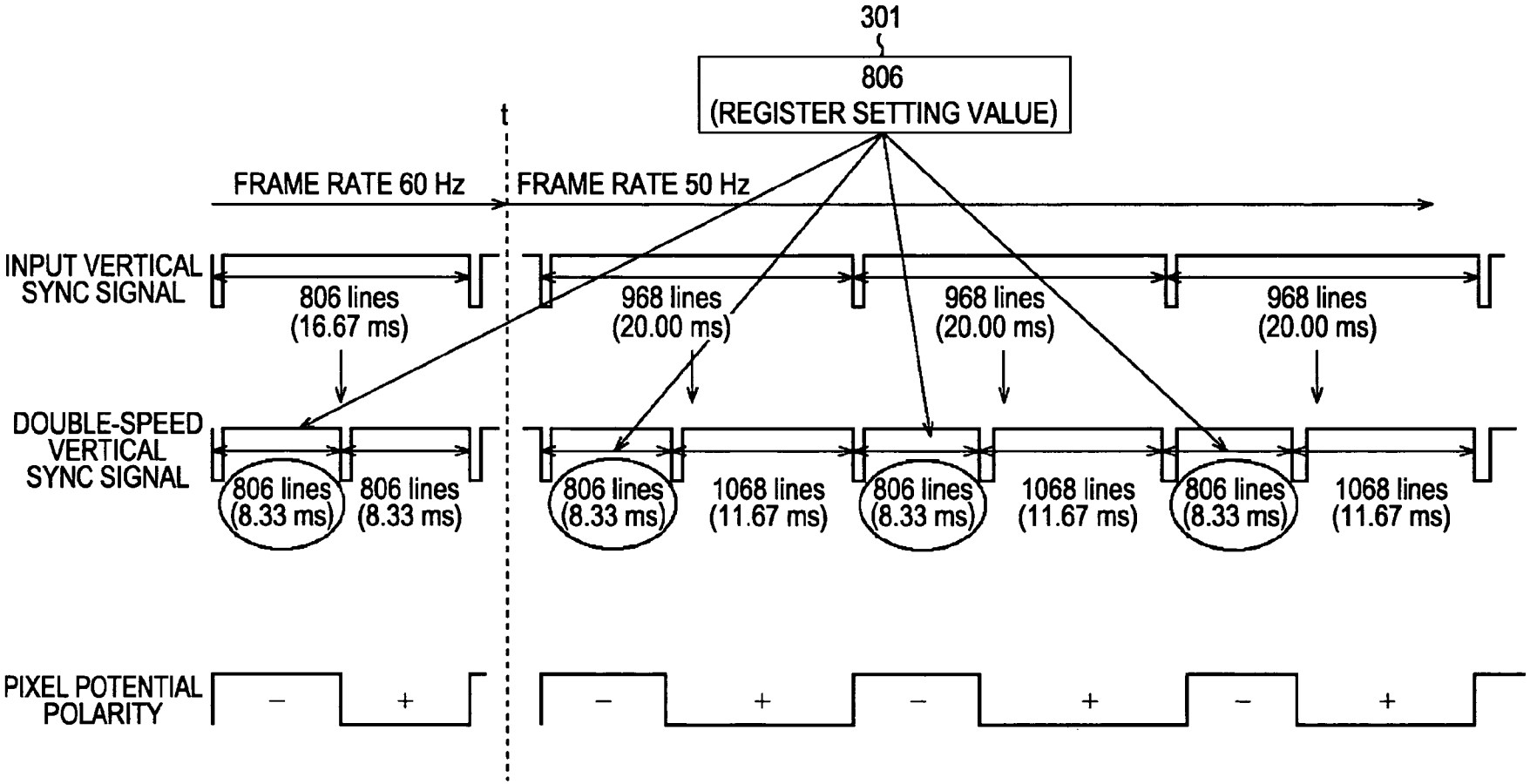
FIG. 18 is a diagram describing existing double speed processing.

The example in FIG. 18 illustrates existing double speeding up processing for comparing with the double speeding up processing of the timing generators 136-1 and 136-2.

For example, a frame rate input to the existing digital signal driver IC is changed from 60 Hz to 50 Hz with point-in-time t as a border. Note that with the example in FIG. 18, 806 (register setting value) which is the number of filed lines in the case in which the frame rate is 60 Hz is stored in the register 301 of the existing digital signal driver IC as the generation position of a double speed vertical synchronizing signal.

At point-in-time t or before point-in-time t, a picture signal of 16.67 ms with 806 lines which are the number filed lines is input to the existing digital signal driver IC. The timing generator of the existing digital signal driver IC has referred to the 806 filed lines stored in the register 301, and has generated a double speed synchronizing signal at the position of the number of lines 806 thereof, and has supplied a timing pulse based on the generated vertical synchronizing signal subjected to double speeding up to an existing memory control unit.

According to this arrangement, a picture signal of 8.33 ms with 806 lines which are the number of filed lines has been read out from existing field memory twice.

On the other hand, after point-in-time t, a picture signal of 20.00 ms with 968 lines which are the number filed lines is input to the existing digital signal driver IC. Note however, the number of lines 806 in the register 301 is not changed, so in this case as well, the timing generator has generated a double speed vertical synchronizing signal at the position of the number of lines 806 of the register 301, and has supplied a timing pulse based on the generated vertical synchronizing signal subjected to double speeding up to the existing memory control unit.

According to this arrangement, a picture signal of 8.33 ms with 806 lines which are the number of filed lines, and a picture signal of 11.67 ms with 1068 lines which are the number of filed lines have been read out from the existing field memory.

Therefore, as shown in the bottom in FIG. 18, at point-in-time t or before point-in-time t, the pixel potential polarity of an existing LCD panel has repeated negative polarity (−) and positive polarity (+) by the same number of times, but after point-in-time t, with the pixel potential polarity, the ratio of positive polarity (+) has become greater than the ratio of negative polarity (−), and consequently, the potential between positive polarity and negative polarity to be applied to the pixels of the LCD panel has been biased (i.e., DC applies to the pixels), leading to the deterioration of burn-in of the LCD panel due to double speed driving.

In order to handle this, there is a need to change the generation position of a double speed vertical synchronizing signal at a microcomputer or the like for controlling the register 301.

Figure 19:
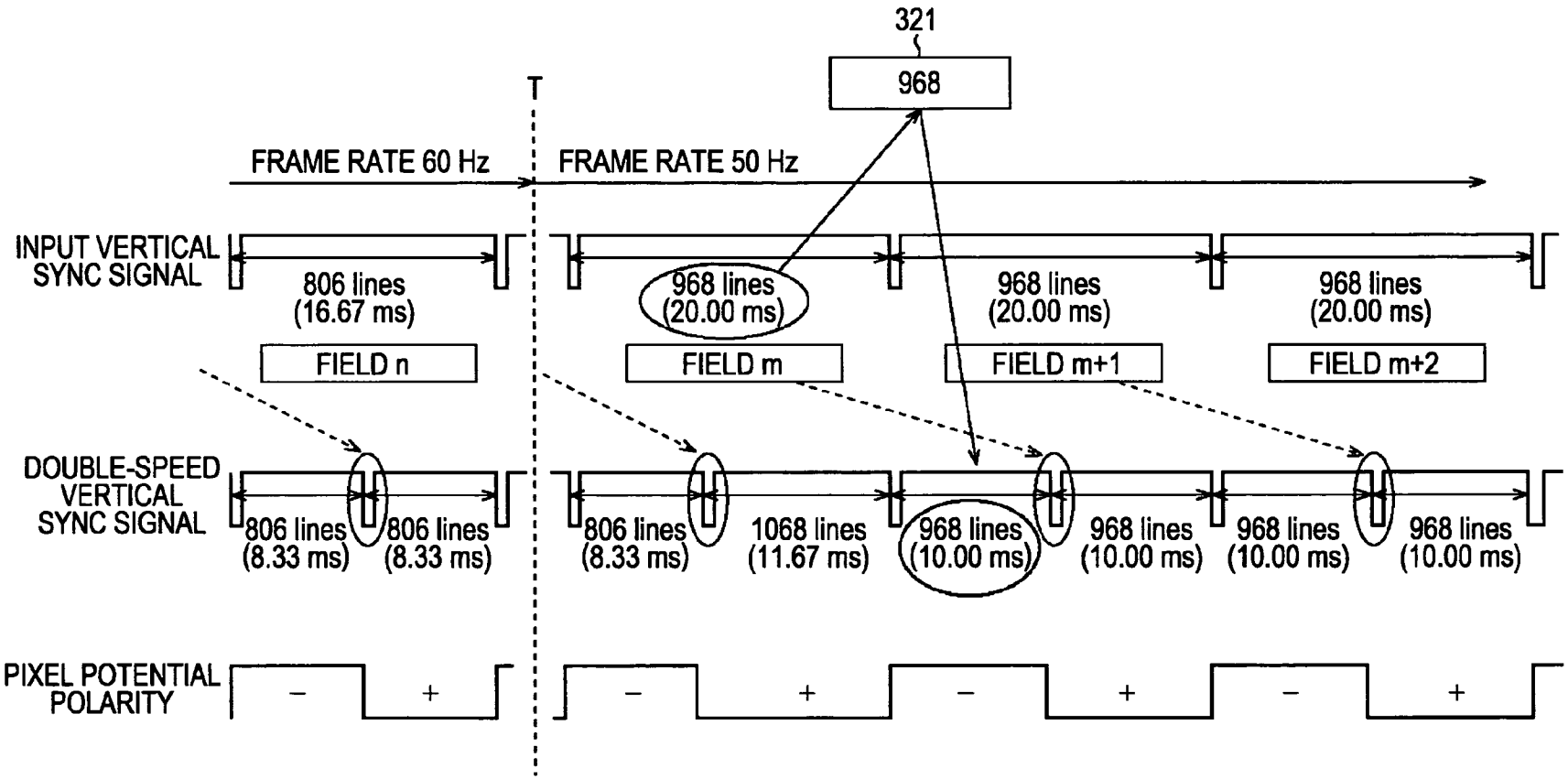
FIG. 19 is a diagram describing the double speed processing of the liquid crystal display system in FIG. 5.

On the other hand, the timing generators 136-1 and 136-2 of the liquid crystal display system in FIG. 5 each include an unshown line counter and memory 321 in FIG. 19, refer to the vertical synchronizing signal from the scan converter 111, count the number of lines of each filed by using the line counter, and hold this in the memory 321.

Subsequently, the timing generators 136-1 and 136-2 each generate a vertical synchronizing signal subjected to double speeding up of the next field at the position of the number of lines held in the memory 321, and supplies a timing pulse based on the generated vertical synchronizing signal subjected to double speeding up to the memory control units 132-1 and 132-2.

Description will be made in detail with reference to FIG. 19. Note that in FIG. 19, the case of the master IC 112-1 will be described as an example, but the same processing will be performed even in the slave IC 112-2. Note that with the example in FIG. 5, the illustration thereof has been omitted, but a picture signal is also input to the timing generator 136-1.

As with the example in FIG. 18, a frame rate input to the master IC 112-1 is changed from 60 Hz to 50 Hz with point-in-time T as a border.

At point-in-time T or before point-in-time T, a picture signal of 16.67 ms with 806 lines which are the number filed lines is input to the master IC 112-1. The timing generator 136-1 refers to the vertical synchronizing signal from the scan converter 111, counts the number of lines (806) at the unshown n−1'th field, holds this in the memory 321, generates a double speed vertical synchronizing signal subjected to double speeding up at the n'th field at the position of the held number of lines (806), and supplies a timing pulse based on the generated double speed vertical synchronizing signal to the memory control unit 132-1.

According to this arrangement, a picture signal of 8.33 ms with 806 lines which are the number of filed lines is read out from the field memory 133-1 twice.

On the other hand, after point-in-time T, a picture signal of 20.00 ms with 968 lines which are the number filed lines is input to the master IC 112-1. The timing generator 136-1 refers to the input vertical synchronizing signal from the scan converter 111, counts the number of lines (968) at the m'th field, holds this in the memory 321, generates a double speed vertical synchronizing signal subjected to double speeding up at the m+1'th field at the position of the held number of lines (968), and supplies a timing pulse based on the generated double speed vertical synchronizing signal to the memory control unit 132-1.

According to this arrangement, a picture signal of 10.00 ms with 968 lines which are the number of filed lines is read out from the field memory 133-1 twice.

According to the above-mentioned arrangements, even if the number of lines making up one field is what kind of value, or even if the number of total lines varies on the way, a double speed vertical synchronizing signal can be constantly generated at the center of the input vertical synchronizing signal.

According to this arrangement, as shown in the bottom of FIG. 19, the pixel potential polarity repeats negative polarity (−) and positive polarity (+) by the same number of times, and accordingly, the potential between positive polarity and negative polarity to be applied to the pixels of the LCD panel 114 is not biased (i.e., no DC applies to the pixels), and consequently, the deterioration of the LCD panel 114 due to burn-in from double speed driving caused in the past case shown in FIG. 18 can be prevented.

Note that the field (e.g., field m) immediately after switching of the frame rate is based on the number of lines (e.g., 806 lines which is the number of lines of an unshown field m−1) before switching, so as shown in FIG. 19, the potential is biased like the past, but from the next field (e.g., field m+1) a double speed vertical synchronizing signal is generated with generally a half of the number of lines before double speeding, and the bias of potential is eliminated, and accordingly, there are almost no effects of burn-in of the LCD panel.

Also, with the example in FIG. 19, description has been made regarding an example wherein the double speed vertical synchronizing signal of the next field (e.g., field m+1) is generated from the previous field (e.g., field m), but for example, an arrangement may be made wherein the number of total lines of multiple fields (e.g., fields m−3 through m) before a field of which the double speed synchronizing signal is generated (e.g., field m+1) is held in the memory 321, and the double speed synchronizing signal of the field m+1 is generated from the average value thereof. Thus, the variation of an input vertical synchronizing signal or the like due to the deterioration of an analog tape serving as a signal source or the like can be handled.

Further, with the above description, an example of a vertical synchronizing signal has been described, but with regard to a horizontal synchronizing signal as well, an arrangement may be made wherein the number of total clocks at the m'th line is counted, the counted value thereof is held in the memory, and the horizontal synchronizing signal at the m+1'th line is generated by employing the value thereof.

Now, returning to FIG. 17, according to the processing in step S15, the even data 1-2 (data within an invalid picture period, the 4th, 8th, 12th, 16th, and 20th data) which has been read out slow in time from the line memory 151-1A, and the even data 1-1 (the 2nd, 6th, 10th, 14th, and 18th data) which has been read out quick in time from the line memory 151-1B are input to the signal correction processing circuit 134-1. Also, the odd data 2-1 (the 1st, 5th, 9th, 13th, and 17th data) which has been read out quick in time from the line memory 151-2A, and the odd data 2-2 (the 3rd, 7th, 11th, 15th, and 19th data) which has been read out slow in time from the line memory 151-2B are input to the signal correction processing circuit 134-2.

In step S16, the signal correction processing circuit 134-1 subjects the even data 1-2 and even data 1-1 input from the read start position control unit 138-1 to signal correction processing in parallel, such as gamma correction, luminescent-spot correction, a sharpness function, vertical stripe correction, or color unevenness correction, based on the timing pulse supplied from the timing generator 136-1 with reference to the mirror reversed setting RGT of the register 137-1, master/slave setting, and horizontal display position setting HP.

Similarly, the signal correction processing circuit 134-2 subjects the odd data 2-1 and odd data 2-2 input from the memory control unit 132-2 to signal correction processing in parallel, such as gamma correction, luminescent-spot correction, a sharpness function, vertical stripe correction, or color unevenness correction, based on the timing pulse supplied from the timing generator 136-2, and the timing pulse for reflecting the mirror reversed setting RGT from the timing generator 136-1 with reference to the mirror reversed setting RGT of the register 137-2, master/slave setting, and horizontal display position setting HP.

At the time of color unevenness correction or the like, the signal correction processing circuit 134-1 and signal correction processing circuit 134-2 perform a linear interpolation calculation with the headmost data of pixels equivalent to one port as reference, obtains the value of linear interpolation equivalent to each piece of data in four parallels necessary for correction (each piece of data equivalent to the four pixels of the LCD panel 114). Of the obtained linear interpolation values, the signal correction processing circuit 134-1 and signal correction processing circuit 134-2 select the value of linear interpolation corresponding to the data to be processed, thereby performing the correction of the data to be processed by employing the selected linear interpolation value.

That is to say, in the event of employing multiple digital signal driver ICs, in order to perform linear interpolation accurately, there is a need to synchronize with the setting value of the linear interpolation of another digital signal driver IC, and consequently, the setting values and calculation become complex. Accordingly, in the past, for example, in the event of four parallel processing, all of the correction settings as to the data to be written in four pixels (e.g., the 1st, 2nd, 3rd, and 4th data of which the time axes are the same [1] in FIG. 9) of the LCD panel 114 have been set to the same. Note however, with an existing method, the correction amount of data equivalent to four pixels becomes the same, which deteriorates the accuracy of the color unevenness function.

In order to avoid this, with the liquid crystal display system in FIG. 5, the linear interpolation calculation of data equivalent to the same four pixels is performed by each of the signal correction processing circuit 134-1 of the master IC 112-1 and the signal correction processing circuit 134-2 of the slave IC 112-2. The signal correction processing circuits 134-1 and 134-2 obtain the values (e.g., F1, F2, F3, and F4) of the linear interpolation of data equivalent to the four pixels with the headmost data of pixels equivalent to one port as reference.

Subsequently, the signal correction processing circuit 134-1 replaces the value of linear interpolation with F1 as to the 1st data to be written in the leftmost pixel at the first row in FIG. 9 to perform color unevenness correction, and replaces the value of linear interpolation with F3 as to the 3rd data to be written in the leftmost pixel at the second row in FIG. 9 to perform color unevenness correction. Similarly, the signal correction processing circuit 134-2 replaces the value of linear interpolation with F2 as to the 2nd data to be written in the leftmost pixel at the third row in FIG. 9 to perform color unevenness correction, and replaces the value of linear interpolation with F4 as to the 4th data to be written in the leftmost pixel at the fourth row in FIG. 9 to perform color unevenness correction.

Thus, each of the signal correction processing circuits 134-1 and 134-2 performs the same linear interpolation calculation, so there is no need to exchange data between both, and each of the signal correction processing circuits 134-1 and 134-2 also obtains the value of linear interpolation obtained by the linear interpolation calculation individually, whereby color unevenness correction can be readily accurately performed.

The even data 1-2 (data within an invalid picture period, the 4th, 8th, 12th, 16th, and 20th data) and even data 1-1 (the 2nd, 6th, 10th, 14th, and 18th data) after the signal correction processing are input to the S/H driver 113-1 via the data path switch 135-1 as signals SIG1 and SIG2. The odd data 2-1 (the 1st, 5th, 9th, 13th, and 17th data) and odd data 2-2 (the 3rd, 7th, 11th, 15th, and 19th data) after the signal correction processing are input to the S/H driver 113-2 via the data path switch 135-2 as signals SIG3 and SIG4.

Note that at this time, with the even data 1-2 and even data 1-1, the signals SIG1 and SIG2 can be interchanged as signals SIG2 and SIG1, and with the odd data 2-1 and odd data 2-2, the signals SIG3 and SIG4 can be interchanged as signals SIG4 and SIG3.

In step S17, the S/H driver 113-1 converts the signals SIG1 and SIG2, which are digital picture signals input from the master IC 112-1, into analog picture signals based on the clock CLKOUT1 from the master IC 112-1, and in the event that the LCD panel 114 is a 12-bit simultaneous writing panel, inputs three pixels at a time to the LCD panel 114. That is to say, data within an invalid picture period and the 2nd, 4th, 6th, 8th, and 10th data within a valid picture period are input to the odd pixels in the horizontal direction from the left end of the LCD panel 114 from the S/H driver 113-1.

Also, the S/H driver 113-2 converts the signals SIG3 and SIG4, which are digital picture signals input from the slave IC 112-2, into analog picture signals based on the clock CLKOUT2 from the slave IC 112-2, and inputs three pixels at a time to the LCD panel 114. That is to say, the 1st, 3rd, 5th, 7th, 9th, and 11th data within a valid picture period are input to the even pixels in the horizontal direction from the left end of the LCD panel 114 from the S/H driver 113-2.

According to this arrangement, in the event that the horizontal display position setting HP at the time of RGT=H is a default+1, as shown in FIG. 6, the 1st through 11th data within a valid picture period are written simultaneously in the 2nd through 12th pixels (excluding the 1st pixel) from the top in the drawing of the LCD panel 114 in order from the top. That is to say, an image shifted by one dot from the case in which the horizontal display position is a default is displayed on the LCD panel 114.

As described above, with the liquid crystal display system in FIG. 5, an arrangement has been made wherein the data interchanging processing at the master IC 112-1 and slave IC 112-2, and the change processing of the read order and read start position from the line memory 151-1 and 151-2 are controlled by the microcomputer 115 in a synchronizing manner, whereby even in the event of displaying an image on the LCD panel 114 by employing multiple S/H drivers 113 and DSDICs 112, a setting in increments of single dots can be performed, such that the horizontal display positions in the LCD panel 114 can be shifted by one dot or two dots (pixels) from the case of a default, and consequently, arbitrary data can be written in a specific pixel.

Also, an arrangement has been made wherein the adjustment of the horizontal display positions in the LCD panel 114 is performed by the readout control from the respective line memory 151, whereby even in the event of displaying an image on the LCD panel 114 by employing multiple S/H drivers 113 and DSDICs 112, correction processing in increments of single dots can be performed.

Note that with the above description, the case of horizontal display positions has been described, but multiple DSDICs are synchronized and controlled by a microcomputer, whereby the case of vertical display positions can be also set in increments of one line, and also correction processing in increments of one line can be performed.

Also, with the above description, an example has been described wherein luminescent-spot correction processing, processing for shifting display positions, and so forth are performed by using an LCD panel employing liquid crystal cells serving as pixel display elements, but the present invention is not restricted to an LCD panel, and accordingly, for example, can be applied to display apparatuses employing a dot line inversion driving method at large, such as a display system for performing signal processing for displaying a picture signal on a liquid crystal projector.

Further, the above description has been made by simply employing picture signals, but the setting of display positions in increments of single dots can be performed even as to each picture signal of R, G, and B, and accordingly, arbitrary data can be written in a specific pixel.

The setting of display positions in increments of single dots can be performed for each of RGB, so for example, in the event of attempting to display a picture by using the three plate method of RGB, misregistration can be suppressed, which is caused from the corresponding pixels between three plates being unmatched since the three colors make up one pixel.

Note that with the present specification, steps for describing a program to be stored in a program recording medium include not only processing to be performed in a time-oriented manner along the described order but also processing not to be performed in a time-oriented manner but to be performed in parallel or individually. Also, with the present specification, the term "system" represents the entirety of apparatuses made up of multiple apparatuses.

Note that the embodiments of the present invention are not restricted to the above embodiments, and various types of modifications can be made without departing from the spirit and scope of the present invention. It should be understood by those skilled in the art that various modifications, combinations, sub-combinations and alterations may occur depending on design requirements and other factors insofar as they are within the scope of the appended claims or the equivalents thereof.

What is claimed is:

1. A signal processing circuit configured to process a picture signal to output to a display unit made up of a collective entity of pixels, comprising:

more than two digital signal processing means which operate in parallel each including selecting means configured to select one of a plurality of systems of picture signals which are input based on a mirror reversed setting, a master/slave setting associated with the plurality of digital signal processing means, and a display position setting, and output the selected picture signals to double-speed converting means, the display position setting indicating a number of dots shifted from a default position, wherein the mirror reversed setting, master/slave setting and display position setting are stored in a register located in each of the digital signal processing means, and wherein the display position setting includes a default setting, a default +1 setting in which each of the data is shifted and written onto a subsequent dot in relation to the default setting, and a default +2 setting in which the data is shifted and written onto a subsequent dot in relation to the default +1 setting, the double-speed converting means configured to write the data equivalent to one field of the picture signal selected by said selecting means in field memory, and simultaneously read said data equivalent to one field from said field memory twice at double speed, thereby converting the frequency of said picture signal into double speed, wherein the double-speed converting means further implements a serial-to-parallel conversion of the read data;

reading means configured to read out the picture signal converted into double speed by said double-speed converting means, and temporarily stored in line memory, and correction processing means configured to subject the picture signal read out by said reading means to predetermined correction processing; and switch means configured to output one data of two data that are subjected to the correction processing means to an external driver, wherein each digital signal processing means receives both odd data and even data of a picture; and control means configured to perform a selection control of said plurality of systems of picture signals using said selecting means, and to perform a read position control of a picture signal from said line memory using said reading means.

2. The signal processing circuit according to claim 1, wherein said correction processing means of said plurality of digital signal processing means obtain a value of a linear interpolation calculation regarding each of all of the picture signals to be corrected, which have been converted into double speed by said double-speed converting means of said plurality of digital signal processing means, and subject the picture signals to be corrected which have been converted into double speed by said own double-speed converting means to said predetermined correction processing using the corresponding values of linear interpolation, of the obtained values of linear interpolation.

3. A signal processing method of a signal processing circuit including more than two digital signal processing means configured to perform processing in parallel wherein the data equivalent to one field of a picture signal to be input is written in field memory, and simultaneously read said data equivalent to one field from said field memory twice at double speed, thereby converting the frequency of said picture signal into double speed to output to a display unit made up of a collective entity of pixels, said method comprising the steps of:

performing a selection control of one of a plurality of systems of picture signals which are input based on a mirror reversed setting, a master/slave setting associated with the plurality of digital signal processing means, and a display position setting, and performing a read position control of the picture temporarily stored in line memory included in said plurality of digital signal processing means, the display position setting indicating a number of dots shifted from a default position, wherein the mirror reversed setting, master/slave setting and display position setting are stored in a register located in each of the digital signal processing means, and wherein the display position setting includes a default setting, a default +1 setting in which each of the data is shifted and written onto a subsequent dot in relation to the default setting, and a default +2 setting in which the data is shifted and written onto a subsequent dot in relation to the default +1 setting;

selecting one of said plurality of systems of picture signals based on said selection control and outputting the selected picture signals to double-speed converting means;

writing the data equivalent to one field of the selected picture signal in said field memory, and simultaneously reading said data equivalent to one field from said field memory twice at double speed, thereby converting the frequency of said picture signal into double speed;

implementing a serial-to-parallel conversion of the read data;

reading out the picture signal converted into double speed, and temporarily stored in said line memory based on said read position control; and subjecting the read picture signal to predetermined correction processing, outputting one data of two data of the subjecting step to an external driver, wherein each digital signal processing means receives both odd data and even data of a picture.

4. A signal processing circuit configured to process a picture signal to output to a display unit made up of a collective entity of pixels, comprising:

more than two digital signal processing units which operate in parallel each including a selecting unit configured to select one of a plurality of systems of picture signals which are input based on a mirror reversed setting, a master/slave setting associated with the plurality of digital signal processing means, and a display position setting, and output the selected picture signals to a double-speed converting unit, the display position setting indicating a number of dots shifted from a default position, wherein the mirror reversed setting, master/slave setting and display position setting are stored in a register located in each of the digital signal processing means, and wherein the display position setting includes a default setting, a default +1 setting in which each of the data is shifted and written onto a subsequent dot in relation to the default setting, and a default +2 setting in which the data is shifted and written onto a subsequent dot in relation to the default +1 setting, the double-speed converting unit configured to write the data equivalent to one field of the picture signal selected by said selecting unit in field memory, and simultaneously read said data equivalent to one field from said field memory twice at double speed, thereby converting the frequency of said picture signal into double speed, wherein the double-speed converting means further implements a serial-to-parallel conversion of the read data;

a reading unit configured to read out the picture signal converted into double speed by said double-speed converting unit, and temporarily stored in line memory, and a correction processing unit configured to subject the picture signal read out by said reading unit to predetermined correction processing; and a switch unit configured to output one data of two data that are subjected to the correction processing unit to an external driver, wherein each digital signal processing unit receives both odd data and even data of a picture; and a control unit configured to perform a selection control of said plurality of systems of picture signals using said selecting unit, and to perform a read position control of a picture signal from said line memory using said reading unit.

5. A signal processing method of a signal processing circuit including more than two digital signal processing units configured to perform processing in parallel wherein the data equivalent to one field of a picture signal to be input is written in field memory, and simultaneously read said data equivalent to one field from said field memory twice at double speed, thereby converting the frequency of said picture signal into double speed to output to a display unit made up of a collective entity of pixels, said method comprising the steps of:

performing a selection control of one of a plurality of systems of picture signals which are input based on a mirror reversed setting, a master/slave setting associated with the plurality of digital signal processing units, and a display position setting, and performing a read position control of the picture temporarily stored in line memory included in said plurality of digital signal processing units, wherein the mirror reversed setting, master/slave setting and display position setting are stored in a register located in each of the digital signal processing means, and wherein the display position setting includes a default setting, a default +1 setting in which each of the data is shifted and written onto a subsequent dot in relation to the default setting, and a default +2 setting in which the data is shifted and written onto a subsequent dot in relation to the default +1 setting;

selecting one of said plurality of systems of picture signals based on said selection control and outputting the selected picture signals to a double-speed converting unit;

writing the data equivalent to one field of the selected picture signal in said field memory, and simultaneously reading said data equivalent to one field from said field memory twice at double speed, thereby converting the frequency of said picture signal into double speed;

implementing a serial-to-parallel conversion of the read data;

reading out the picture signal converted into double speed, and temporarily stored in said line memory based on said read position control; and subjecting the read picture signal to predetermined correction processing, outputting one data of two data of the subjecting step to an external driver, wherein each digital signal processing unit receives both odd data and even data of a picture.

* * * * *